US008584809B2

(12) United States Patent
Sun et al.

(10) Patent No.: US 8,584,809 B2
(45) Date of Patent: Nov. 19, 2013

(54) SAFETY DEVICE FOR ELEVATOR

(75) Inventors: Xiao Sun, Shanghai (CN); Weifeng Chen, Shanghai (CN); Kunpeng Yang, Shanghai (CN); Hiroshi Kashiwakura, Shiga (JP); Takuya Fujii, Shiga (JP); Keishiro Hirohata, Shiga (JP)

(73) Assignee: Fujitec Co., Ltd., Hikone-shi (JP)

( * ) Notice: Subject to any disclaimer, the term of this patent is extended or adjusted under 35 U.S.C. 154(b) by 412 days.

(21) Appl. No.: 13/061,679

(22) PCT Filed: Aug. 24, 2009

(86) PCT No.: PCT/JP2009/064714

§ 371 (c)(1),
(2), (4) Date: Mar. 1, 2011

(87) PCT Pub. No.: WO2010/024215

PCT Pub. Date: Mar. 4, 2010

(65) Prior Publication Data

US 2011/0155511 A1 Jun. 30, 2011

(30) Foreign Application Priority Data

Sep. 1, 2008 (JP) ..... 2008-223730
Oct. 3, 2008 (JP) ..... 2008-258069

(51) Int. Cl.
*B66B 13/14* (2006.01)

(52) U.S. Cl.
USPC ..... 187/316; 187/393; 49/26

(58) Field of Classification Search
USPC ..... 187/247, 248, 313, 316, 317, 391–393; 49/25–28; 318/16, 466–480
See application file for complete search history.

(56) References Cited

U.S. PATENT DOCUMENTS 4,029,176 A * 6/1977 Mills ..... 187/317
4,621,452 A * 11/1986 Deeg ..... 49/28

(Continued)

FOREIGN PATENT DOCUMENTS

EP 0 081 110 A1 6/1983
FR 2 685 496 A1 6/1993

(Continued)

OTHER PUBLICATIONS

Extended European Search Report dated Feb. 13, 2013, issued in corresponding European patent application No. 09809866.8.

(Continued)

*Primary Examiner* — Anthony Salata
(74) *Attorney, Agent, or Firm* — Westerman, Hattori, Daniels & Adrian, LLP

(57) ABSTRACT

In a safety device for an elevator, on one car door among a pair of car doors, a light-emitting/light-receiving unit is disposed facing downward at an upper end position of a vertical line separated by a predetermined distance from an end face in a closing direction, which is to abut the other car door, toward the side of the other car door, and a first reflecting member is disposed facing upward at a lower end position of the vertical line. A housing space that houses the light-emitting/light-receiving unit in a state where both car doors are closed is formed on the other car door, and a second reflecting member is disposed facing upward at a bottom portion of the housing space and extends from the same position as an end face in a closing direction of the other car door toward the back of the housing space.

31 Claims, 62 Drawing Sheets

(56) References Cited

U.S. PATENT DOCUMENTS

| | | | | | |
|---|---|---|---|---|---|
| 4,794,248 | A | * | 12/1988 | Gray | 250/221 |
| 4,866,881 | A | * | 9/1989 | Morrow et al. | 49/25 |
| 4,914,859 | A | * | 4/1990 | Gionet et al. | 49/25 |
| 5,149,921 | A | * | 9/1992 | Picado | 187/317 |
| 5,569,888 | A | * | 10/1996 | Kamani et al. | 187/317 |
| 5,698,824 | A | * | 12/1997 | Platt | 187/317 |
| 6,525,659 | B2 | * | 2/2003 | Jaffe et al. | 340/545.6 |
| 7,093,692 | B2 | * | 8/2006 | Koura | 187/316 |
| 7,771,080 | B2 | * | 8/2010 | Platt | 362/231 |
| 8,115,162 | B2 | * | 2/2012 | Shikai et al. | 250/221 |
| 2003/0209391 | A1 | | 11/2003 | Shikai et al. | |
| 2011/0192684 | A1 | * | 8/2011 | Kashiwakura et al. | 187/317 |

FOREIGN PATENT DOCUMENTS

| | | | |
|---|---|---|---|
| JP | 48-009328 | Y1 | 3/1973 |
| JP | 52-044936 | | 4/1977 |
| JP | 52-044936 | A | 4/1977 |
| JP | 61-203680 | U | 12/1986 |
| JP | 1-176673 | U | 12/1989 |
| JP | 2008-169009 | A | 7/2008 |
| JP | 2009-208867 | A | 9/2009 |

OTHER PUBLICATIONS

International Search Report of PCT/JP2009/064714, mailing date Dec. 8, 2009.

* cited by examiner

FIG. 15(a)
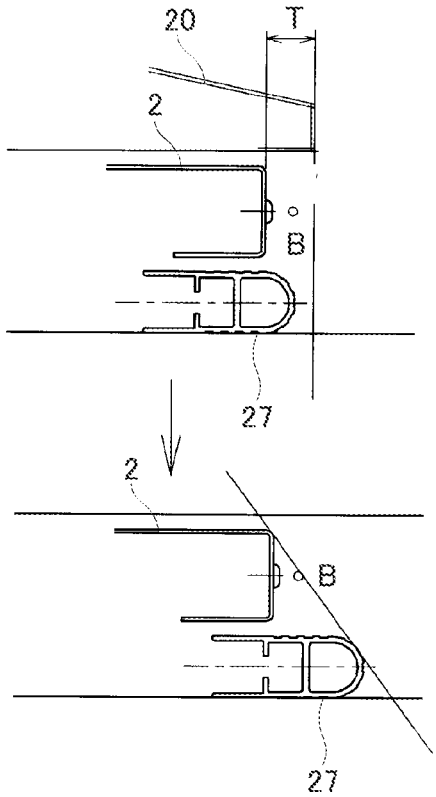
FIG. 15(b)
FIG. 16(a)
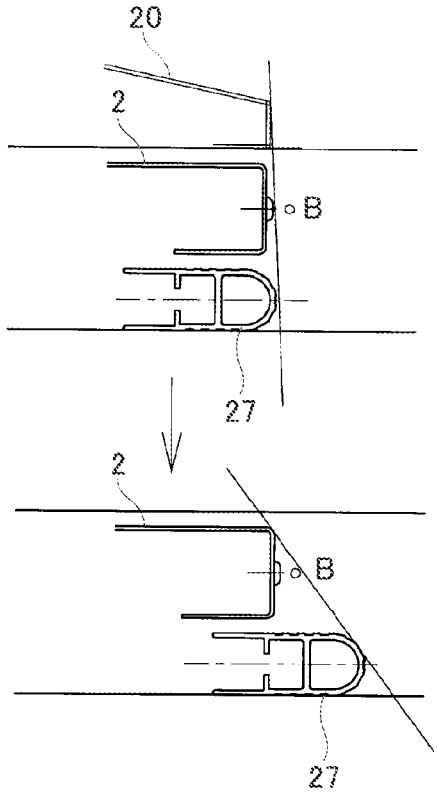
FIG. 16(b)

SAFETY DEVICE FOR ELEVATOR

TECHNICAL FIELD

The present invention relates to a safety device for an elevator, and more specifically, to a safety device for an elevator for achieving safety when a string-like foreign object is caught during closing of a car door.

BACKGROUND ART

With an elevator, for example, when a person accompanied by a pet such as a dog on a leash boards an elevator car while the pet is still on a landing floor, a car door and a landing door close while the leash is stretched taut so as to straddle the inside of the elevator car and the landing floor and the elevator ascends or descends. As a result, a hand of the person is forcefully pulled by the leash on the pet and may sometimes create a risk of severe injury to a wrist or the like.

A car door of an elevator is mounted with a safety shoe frame which protrudes from an end face of the car door in a closing direction and moves relative to the car door and which is arranged so that when the safety shoe frame bumps into a person or a foreign object during closing of the car door and a force acts on the safety shoe frame, closing operations of the car door and a landing door are reversed to opening operations.

In addition, an arrangement is adopted where an optical beam horizontally transversing an entrance of an elevator car is generated and closing operations of a car door and a landing door are reversed to an opening operation when the optical beam is blocked by a person or a foreign object.

However, conventional foreign object detecting methods that use the aforementioned safety shoe frame or horizontal optical beam are incapable of accurately detecting an elongated foreign object such as a string or a rope.

In consideration thereof, a string-like foreign object is conceivably detected by utilizing a vertical scanning method (refer to Patent Literature 1) involving arranging a light-emitting unit at an upper end position on a vertical line separated by a predetermined distance from an end face in a closing direction of a car door and arranging a light-receiving unit at a lower end position on the vertical line, and detecting light outputted from the light-emitting unit by the light-receiving unit.

In addition, a string-like foreign object is also conceivably detected by utilizing a vertical scanning method (refer to Patent Literature 2) involving arranging a light-emitting unit on a threshold at a position on a vertical line that extends vertically from an abutting position where a pair of car doors abut each other in a fully closed state, arranging a light-receiving unit on a frame above an entrance, and detecting light outputted from the light-emitting unit by the light-receiving unit.

By adopting the vertical scanning methods described above, since an optical scanning line transverses a string during closing of a car door in a state where a string passes through an entrance of an elevator car and stretches at a position with a certain height, the string can be detected based on an output signal of a light-receiving unit.

CITATION LIST

Patent Literature

Patent Literature 1: Japanese Utility Model Laid-Open No. 61-203680

Patent Literature 2: Japanese Patent Laid-Open No. 2008-169009

DISCLOSURE OF THE INVENTION

Problems to be Solved by the Invention

With an elevator in which a light-emitting unit is arranged on a car door (refer to Patent Literature 1), since a light-emitting unit is installed at a position protruding from an end face in a closing direction of the car door, a housing space for the light-emitting unit must be formed on another car door or a doorstop frame in order to prevent the light-emitting unit from colliding with the other car door or the doorstop frame during closing of the car door from a position immediately previous to a fully closed state (almost-fully closed position) to a fully closed position.

Therefore, during closing of the car door from the almost-fully closed position to the fully closed position, light outputted from the light-emitting unit is blocked by the other car door or the doorstop frame and fails to reach the light-receiving unit.

At this point, since an interruption of light detection by the light-receiving unit cannot be determined to be a detection of a foreign object, a foreign object detection function by the light-emitting unit and the light-receiving unit must be disabled during closing of the car door from the almost-fully closed position to the fully closed position.

In this case, since the foreign object detection function by the light-emitting unit and the light-receiving unit is disabled, there is a problem that a string-like foreign object cannot be detected if the string-like foreign object is stretched and in contact with the end face in a closing direction of a car door on which the light-emitting unit is installed.

Although an elevator in which a light-emitting unit is arranged on a threshold of a frame (refer to Patent Literature 2) can solve this problem, there is a risk that light outputted from the light-emitting unit is blocked by the adhesion of dirt or vandalism committed on the light-emitting unit, resulting in an interruption of light detection by a light-receiving unit and an erroneous determination that a foreign object is detected.

For example, while a pressure sensor whose sensitivity range is the entire area from an upper end to a lower end of an end face in a closing direction a car door can conceivably be mounted to the end face, such an arrangement problematically necessitates significant retrofitting of the car door and therefore high retrofit cost.

In consideration of the above, it is an object of the present invention to provide a safety device for an elevator capable of accurately detecting a string-like foreign object regardless of a position thereof with a simple structure.

Means for Solving the Problems

A first elevator safety device according to the present invention includes a pair of car doors (2) and (3) that move in a direction approaching/separating from each other to open/close an entrance, wherein a light-emitting/light-receiving unit (4) is disposed facing downward at an upper end position of a straight line vertically extending parallel to an end face in a closing direction (2*a*) of one car door (2) that is to abut the other car door (3) from a position separated by a predetermined distance from the end face in a closing direction (2*a*) toward the side of the other car door (3), a first reflecting member (5) is disposed facing upward at a lower end position of the straight line, and the light-emitting/light-receiving unit (4) is capable of outputting an optical beam and detecting an incident optical beam.

A housing space (30) that houses the light-emitting/light-receiving unit (4) in a state where both car doors (2) and (3) are closed is formed on the other car door (3), a second reflecting member (6) is disposed facing upward at a bottom portion of the housing space (30) and extends from the same position as an end face in a closing direction (3*a*) of the other car door (3) toward the back of the housing space (30).

The light-emitting/light-receiving unit (4) generates a foreign object detection signal when detection of an optical beam is interrupted during closing of both car doors (2) and (3).

As a result, the presence of a foreign object is recognized and a closing operation of both car doors (2) and (3) is aborted.

According to the first elevator safety device described above, when a foreign object is absent from the entrance of the elevator car, during a movement of both car doors (2) and (3) from a fully open state to a fully closed state, an optical beam outputted from the light-emitting/light-receiving unit (4) is reflected by the first reflecting member (5) and enters the light-emitting/light-receiving unit (4) until the light-emitting/light-receiving unit (4) penetrates into the housing space (30), and after the light-emitting/light-receiving unit (4) penetrates into the housing space (30), an optical beam outputted from the light-emitting/light-receiving unit (4) is reflected by the second reflecting member (6) and enters the light-emitting/light-receiving unit (4).

Consequently, detection of an optical beam by the light-emitting/light-receiving unit (4) is not interrupted during closing of both car doors (2) and (3) and a foreign object detection signal is not generated.

In contrast, when a string-like foreign object is present across the entrance, since an optical beam outputted from the light-emitting/light-receiving unit (4) is blocked by the foreign object during closing of both car doors (2) and (3), detection of the optical beam by the light-emitting/light-receiving unit (4) is interrupted and, as a result, a foreign object detection signal is generated.

At this point, even when the string-like foreign object is stretched and is in contact with the end face in a closing direction (3*a*) of the other car door (3), since an optical beam detection operation by the light-emitting/light-receiving unit (4) is ongoing and an optical beam outputted from the light-emitting/light-receiving unit (4) is blocked by the foreign object until both car doors (2) and (3) reach a fully closed state, the presence of the foreign object can be detected.

In a specific configuration, a cleaning tool (70) that cleans a surface of the first reflecting member (5) during closing of both car doors (2) and (3) from an almost-fully closed state to a fully closed state is mounted on the other car door (3).

According to the specific configuration, since the surface of the first reflecting member (5) is cleaned by the cleaning tool (70) every time both car doors (2) and (3) close from an almost-fully closed state to a fully closed state, the surface of the first reflecting member (5) is constantly maintained as a favorable reflecting surface.

In addition, in a specific configuration, a cleaning tool (701) that cleans a surface of the second reflecting member (6) during closing of both car doors (2) and (3) from an almost-fully closed state to a fully closed state is mounted on the one car door (2) further toward the side of the other car door (3) than the light-emitting/light-receiving unit (4).

According to the specific configuration, since the surface of the second reflecting member (6) is cleaned by the cleaning tool (701) every time both car doors (2) and (3) close from an almost-fully closed state to a fully closed state, the surface of the second reflecting member (6) is constantly maintained as a favorable reflecting surface.

Furthermore, in a specific configuration, a foreign object penetration preventing member (9) that fills up a gap formed between a lower end of the end face in a closing direction (3*a*) of the other car door (3) and a surface of a threshold (82) is mounted at a lower end portion of the other car door (3).

According to the specific configuration, since the foreign object penetration preventing member (9) prevents penetration of a string-like foreign object into a gap formed between the lower end of the end face in a closing direction (3*a*) of the car door (3) and the surface of the threshold (82), a string-like foreign object can be reliably detected during closing of both car doors (2) and (3).

Moreover, in a specific configuration, a foreign object pushing member (90) which fills up a gap formed between a lower end of the end face in a closing direction (2*a*) of the one car door (2) and the surface of the threshold (82) and which protrudes further toward the side of the other car door (3) than the gap is mounted at a lower end portion of the one car door (2).

According to the specific configuration, since the foreign object pushing member (90) prevents penetration of a string-like foreign object into a gap formed between the lower end of the end face in a closing direction (2*a*) of the car door (2) and the surface of the threshold (82) and the foreign object is pushed further forward than the gap during closing of both car doors (2) and (3), an optical beam is invariably blocked by the foreign object during closing of both car doors (2) and (3) and, as a result, the string-like foreign object can be reliably detected.

In addition, in a specific configuration, at least one of the car doors among the pair of car doors (2) and (3) is mounted with a safety shoe frame (27) that moves relative to the car door, and a lower end face of the safety shoe frame (27) forms a slope (28) which has a predetermined inclination angle with respect to a horizontal plane and which faces toward the side of the other car door.

According to the specific configuration, even if a string-like foreign object slips under the lower end face of the safety shoe frame (27) during closing of both car doors (2) and (3), by pulling the foreign object upward, the foreign object is guided by the slope (28) of the safety shoe frame (27) and can readily extricate itself from underneath the safety shoe frame (27).

Furthermore, in a specific configuration, both car doors (2) and (3) close from a fully open state to a fully closed state via a first almost-fully closed state and a second almost-fully closed state and the configuration includes detecting means that switches from OFF to ON at a predetermined point in time during closing of both car doors (2) and (3) from the first almost-fully closed state to the second almost-fully closed state, wherein the second reflecting member (6) is arranged so as to reflect an optical beam outputted from the light-emitting/light-receiving unit (4) during closing of both car doors (2) and (3) from the first almost-fully closed state to the second almost-fully closed state and to hardly reflect an optical beam outputted from the light-emitting/light-receiving unit (4) during closing of both car doors (2) and (3) from the second almost-fully closed state to the fully closed state.

A control unit (100) determines that an abnormality has occurred at the light-emitting/light-receiving unit (4) when a foreign object detection signal is not generated after the detecting means is switched on.

According to the specific configuration, when both car doors (2) and (3) close to the first almost-fully closed state, an optical beam outputted from the light-emitting/light-receiving unit (4) is reflected by a reflecting portion (601) of the second reflecting member (6) and returns to the light-emitting/light-receiving unit (4). At this point, the detecting means has been switched off. Subsequently, while both car doors (2) and (3) are closing to the second almost-fully closed state, an optical beam outputted from the light-emitting/light-receiving unit (4) is reflected by the second reflecting member (6) and returns to the light-emitting/light-receiving unit (4) with an amount of light equal to or exceeding a certain level and, at the same time, the detecting means is switched on at the predetermined point in time. When both car doors (2) and (3) further close from the second almost-fully closed position, since an optical beam outputted from the light-emitting/light-receiving unit (4) is hardly reflected by the second reflecting member (6) and does not return to the light-emitting/light-receiving unit (4) with an amount of light equal to or exceeding a certain level, a foreign object detection signal is generated. At this point, the detecting means is still turned on. Therefore, as long as the light-emitting/light-receiving unit (4) is operating normally, in a fully closed state, the detecting means switches on and, at the same time, a foreign object detection signal is generated.

However, if some kind of abnormality has occurred at the light-emitting/light-receiving unit (4), in a fully closed state, the detecting means is switched on but a foreign object detection signal is not generated. Consequently, it can be determined that some kind of abnormality has occurred at the light-emitting/light-receiving unit (4) when a foreign object detection signal is not generated after the detecting means is switched on.

A second elevator safety device according to the present invention includes at least one car door (23) that moves in a direction approaching/separating from a doorstop frame (12) to open/close an entrance, wherein a light-emitting/light-receiving unit (4) is disposed facing downward at an upper end position of a straight line vertically extending parallel to an end face in a closing direction (23*a*) of the car door (23) that is to abut the doorstop frame (12) from a position separated by a predetermined distance from the end face in a closing direction (23*a*) toward the side of the doorstop frame (12), a first reflecting member (5) is disposed facing upward at a lower end position of the straight line, and the light-emitting/light-receiving unit (4) is capable of outputting an optical beam and detecting an incident optical beam.

A housing space (30) that houses the light-emitting/light-receiving unit (4) in a state where the car door (23) is closed is formed on the doorstop frame (12), a second reflecting member (6) is disposed facing upward at a bottom portion of the housing space (30) and extends from the same position as an end face (12*a*) of the doorstop frame (12), which the car door (23) is to abut, toward the back of the housing space (30).

The light-emitting/light-receiving unit (4) generates a foreign object detection signal when detection of an optical beam is interrupted during closing of the car door (23).

As a result, the presence of a foreign object is recognized and a closing operation of the car door (23) is aborted.

According to the second elevator safety device described above, when a foreign object is absent from the entrance of the elevator car, during a movement of the car door (23) from a fully open state to a fully closed state, an optical beam outputted from the light-emitting/light-receiving unit (4) is reflected by the first reflecting member (5) and enters the light-emitting/light-receiving unit (4) until the light-emitting/light-receiving unit (4) penetrates into the housing space (30), and after the light-emitting/light-receiving unit (4) penetrates into the housing space (30), an optical beam outputted from the light-emitting/light-receiving unit (4) is reflected by the second reflecting member (6) and enters the light-emitting/light-receiving unit (4).

Consequently, detection of an optical beam by the light-emitting/light-receiving unit (4) is not interrupted during closing of the car door (23) and a foreign object detection signal is not generated.

In contrast, when a string-like foreign object is present across the entrance, since an optical beam outputted from the light-emitting/light-receiving unit (4) is blocked by the foreign object during closing of the car door (23), detection of the optical beam by the light-emitting/light-receiving unit (4) is interrupted and, as a result, a foreign object detection signal is generated.

At this point, even when the string-like foreign object is stretched and is in contact with the end face (12*a*) of the doorstop frame (12), since an optical beam detection operation by the light-emitting/light-receiving unit (4) is ongoing and an optical beam outputted from the light-emitting/light-receiving unit (4) is blocked by the foreign object until the car door (23) reaches a fully closed state, the presence of the foreign object can be detected.

In a specific configuration, a cleaning tool (70) that cleans a surface of the first reflecting member (5) during closing of the car door (23) from an almost-fully closed state to a fully closed state is mounted on the doorstop frame (12).

According to the specific configuration, since the surface of the first reflecting member (5) is cleaned by the cleaning tool (70) every time the car door (23) closes from an almost-fully closed state to a fully closed state, the surface of the first reflecting member (5) is constantly maintained as a favorable reflecting surface.

In addition, in a specific configuration, a cleaning tool (701) that cleans a surface of the second reflecting member (6) during closing of the car door (23) from an almost-fully closed state to a fully closed state is mounted on the car door (23) further toward the side of the doorstop frame (12) than the light-emitting/light-receiving unit (4).

According to the specific configuration, since the surface of the second reflecting member (6) is cleaned by the cleaning tool (701) every time the car door (23) closes from an almost-fully closed state to a fully closed state, the surface of the second reflecting member (6) is constantly maintained as a favorable reflecting surface.

Moreover, in a specific configuration, a foreign object pushing member (90) which fills up a gap formed between a lower end of the end face in a closing direction (23*a*) of the car door (23) and a surface of a threshold (86) and which protrudes further toward the side of the doorstop frame (12) than the gap is mounted at a lower end portion of the car door (23).

According to the specific configuration, since the foreign object pushing member (90) prevents penetration of a string-like foreign object into the gap formed between the lower end of the end face in a closing direction (23*a*) of the car door (23) and the surface of the threshold (82) and the foreign object is pushed further forward than the gap during closing of the car door (23), an optical beam is invariably blocked by the foreign object during closing of the car door (23) and, as a result, the string-like foreign object can be reliably detected.

In addition, in a specific configuration, the car door (23) is mounted with a safety shoe frame (29) that moves relative to the car door (23), and a lower end face of the safety shoe frame (29) forms a slope (28) which has a predetermined inclination angle with respect to a horizontal plane and which faces toward the side of another car door.

According to the specific configuration, even if a string-like foreign object slips under the lower end face of the safety shoe frame (29) during closing of the car door (23), by pulling the foreign object upward, the foreign object is guided by the slope (28) of the safety shoe frame (29) and can readily extricate itself from underneath the safety shoe frame (29).

Furthermore, in a specific configuration, the car door (23) closes to a fully closed state from a first almost-fully closed state via a second almost-fully closed state and includes detecting means that switches from OFF to ON at a predetermined point in time during closing of the car door (23) from the first almost-fully closed state to the second almost-fully closed state, wherein the second reflecting member (6) is arranged so as to reflect an optical beam outputted from the light-emitting/light-receiving unit (4) during closing of the car door (23) from the first almost-fully closed state to the second almost-fully closed state and to hardly reflect an optical beam outputted from the light-emitting/light-receiving unit (4) during closing of the car door (23) from the second almost-fully closed state to the fully closed state.

A control unit (100) determines that an abnormality has occurred at the light-emitting/light-receiving unit (4) when a foreign object detection signal is not generated after the detecting means is switched on.

According to the specific configuration, when the car door (23) closes to the first almost-fully closed state, an optical beam outputted from the light-emitting/light-receiving unit (4) is reflected by the second reflecting member (6) and returns to the light-emitting/light-receiving unit (4). At this point, the detecting means has been switched off. Subsequently, while the car door (23) is closing to the second almost-fully closed state, an optical beam outputted from the light-emitting/light-receiving unit (4) is reflected by a reflecting portion (601) of the second reflecting member (6) and returns to the light-emitting/light-receiving unit (4) with an amount of light equal to or exceeding a certain level and, at the same time, the detecting means is switched on at the predetermined point in time. When the car door (23) further closes from the second almost-fully closed position, since an optical beam outputted from the light-emitting/light-receiving unit (4) is not reflected by the second reflecting member (6) and does not return to the light-emitting/light-receiving unit (4) with an amount of light equal to or exceeding a certain level, a foreign object detection signal is generated. At this point, the detecting means is still turned on. Therefore, as long as the light-emitting/light-receiving unit (4) is operating normally, in a fully closed state, the detecting means switches on and, at the same time, a foreign object detection signal is generated.

However, if some kind of abnormality has occurred at the light-emitting/light-receiving unit (4), in a fully closed state, the detecting means is switched on but a foreign object detection signal is not generated. Consequently, it can be determined that some kind of abnormality has occurred at the light-emitting/light-receiving unit (4) when a foreign object detection signal is not generated after the detecting means is switched on.

A third elevator safety device according to the present invention includes a pair of car doors (2) and (3) that move in a direction approaching/separating from each other to open/close an entrance, a frame (81) disposed above the entrance, and a threshold (82) disposed below the entrance, wherein a light-emitting/light-receiving unit (4) is disposed facing downward on the frame (81) and a reflecting member (50) is disposed facing upward on the threshold (82) at a position on a straight line vertically extending from an abutting position where the pair of car doors (2) and (3) abut each other in a fully closed state, and the light-emitting/light-receiving unit (4) is capable of outputting an optical beam and detecting an incident optical beam.

The light-emitting/light-receiving unit (4) generates a foreign object detection signal when detection of an optical beam is interrupted during closing of both car doors (2) and (3).

As a result, the presence of a foreign object is recognized and a closing operation of both car doors (2) and (3) is aborted.

Moreover, in a specific configuration, a pair of depressed portions (2*b*) and (3*b*) or a pair of notched portions (2*c*) and (3*c*) extending along the straight line are formed on end faces in a closing direction (2*a*) and (3*a*) of the pair of car doors (2) and (3) to abut each other in a fully closed state of the pair of car doors (2) and (3), and when both car doors (2) and (3) are in a fully closed state, a pathway (105) through which an optical beam passes is formed by the pair of depressed portions (2*b*) and (3*b*) or the pair of notched portions (2*c*) and (3*c*).

According to the third elevator safety device described above, when a foreign object is absent from the entrance of the elevator car, during a movement of both car doors (2) and (3) from an almost-fully closed state to a fully closed state, an optical beam outputted from the light-emitting/light-receiving unit (4) is reflected by the reflecting member (50) and enters the light-emitting/light-receiving unit (4).

Consequently, detection of an optical beam by the light-emitting/light-receiving unit (4) is not interrupted during closing of both car doors (2) and (3) and a foreign object detection signal is not generated.

In contrast, if a string-like foreign object is present across the entrance, since an optical beam outputted from the light-emitting/light-receiving unit (4) is blocked by the foreign object when both car doors (2) and (3) reach a fully closed state, detection of the optical beam by the light-emitting/light-receiving unit (4) is interrupted and, as a result, a foreign object detection signal is generated.

In addition, since the light-emitting/light-receiving unit (4) is disposed on the frame (81), the influence of a vibration, an impact made on the elevator car, or the like caused during opening or closing of the car doors (2) and (3) or, more specifically, a variance in an amount of light received of an incident optical beam, a displacement of an irradiation position of an optical beam, or the like can be avoided. As a result, foreign object detection accuracy can be enhanced. In a similar manner, since the reflecting member (50) is disposed on the threshold (82), the influence of a vibration, an impact made on the elevator car, or the like caused during opening or closing of the car doors can be avoided.

In a specific configuration, the reflecting member (50) is disposed below the threshold (82) and a through-hole (821) through which the optical beam passes is formed on the threshold (82).

According to the specific configuration, since the presence of the reflecting member (50) is less likely to be noticed by a user, vandalism can be prevented. In addition, a reflecting surface of the reflecting member (50) is less likely to become stained.

Furthermore, in a specific configuration, a cleaning mechanism (7) that cleans a surface of the reflecting member (50) is disposed on the threshold (82) and the car door (3), wherein the cleaning mechanism (7) includes a cleaning tool (71) which is slidable along the surface of the reflecting member (50) and which is spring-biased in an opening direction or a closing direction of the car door (3) and a pressing unit (32)

that presses the cleaning tool (71) against the spring bias during closing or opening of the car door (3).

According to the specific configuration, during closing of the car door (3), due to the pressing unit (32) pressing the cleaning tool (71) in a closing direction against the spring bias, the cleaning tool (71) moves in a closing direction and cleans the surface of the reflecting member (50). On the other hand, during opening of the car door (3), the cleaning tool (71) moves in an opening direction due to the spring bias and once again cleans the surface of the reflecting member (50).

Alternatively, during opening of the car door (3), due to the pressing unit (32) pressing the cleaning tool (71) in an opening direction against the spring bias, the cleaning tool (71) moves in an opening direction and cleans the surface of the reflecting member (50). On the other hand, during closing of the car door (3), the cleaning tool (71) moves in a closing direction due to the spring bias and once again cleans the surface of the reflecting member (50).

Therefore, since the surface of the reflecting member (50) is cleaned by the cleaning tool (71) every time both car doors (2) and (3) open/close, the surface of the reflecting member (50) is constantly maintained as a favorable reflecting surface.

A fourth elevator safety device according to the present invention includes a pair of car doors (2) and (3) that move in a direction approaching/separating from each other to open/close an entrance, and a frame (81) disposed above the entrance, wherein a light-emitting/light-receiving unit (4) is disposed facing downward on the frame (81) at a position on a straight line vertically extending from an abutting position where the pair of car doors (2) and (3) abut each other in a fully closed state, a reflecting member (50) is disposed facing upward at a lower end position of an end face in a closing direction (3*a*) of one car door (3) that is to abut the other car door (2), and the light-emitting/light-receiving unit (4) is capable of outputting an optical beam and detecting an incident optical beam.

The light-emitting/light-receiving unit (4) generates a foreign object detection signal when detection of an optical beam is interrupted during closing of both car doors (2) and (3).

As a result, the presence of a foreign object is recognized and a closing operation of both car doors (2) and (3) is aborted.

Moreover, in a specific configuration, the reflecting member (50) is held inside a groove (83) of a threshold (82), in which the one car door (3) fits so as to be slidable, so as to be movable along the groove (83).

In addition, a pair of depressed portions (2*b*) and (3*b*) or a pair of notched portions (2*c*) and (3*c*) extending along the straight line are formed on end faces in a closing direction (2*a*) and (3*a*) of the pair of car doors (2) and (3) that are to abut each other in a fully closed state of the pair of car doors (2) and (3), and when the pair of car doors (2) and (3) are in a fully closed state, a pathway (105) through which an optical beam passes is formed by the pair of depressed portions (2*b*) and (3*b*) or the pair of notched portions (2*c*) and (3*c*).

According to the fourth elevator safety device described above, if a string-like foreign object is present across the entrance, since an optical beam outputted from the light-emitting/light-receiving unit (4) is blocked by the foreign object when both car doors (2) and (3) reach a fully closed state, detection of the optical beam by the light-emitting/light-receiving unit (4) is interrupted and, as a result, a foreign object detection signal is generated.

In addition, since the light-emitting/light-receiving unit (4) is disposed on the frame (81), the influence of a vibration, an impact made on the elevator car, or the like caused during opening or closing of the car doors (2) and (3) or, more specifically, a variance in an amount of light received of an incident optical beam, a displacement of an irradiation position of an optical beam, or the like can be avoided. As a result, foreign object detection accuracy can be enhanced.

Furthermore, in a specific configuration, a cleaning tool (77) that cleans a surface of the reflecting member (50) during closing of both car doors (2) and (3) is mounted inside the groove (83) of the threshold (82).

According to the specific configuration, since the surface of the reflecting member (50) is cleaned by the cleaning tool (77) every time both car doors (2) and (3) close, the surface of the reflecting member (50) is constantly maintained as a favorable reflecting surface.

A fifth elevator safety device according to the present invention includes at least one car door (23) that moves in a direction approaching/separating from a doorstop frame (84) to open/close an entrance, wherein a light-emitting/light-receiving unit (4) is disposed facing downward on the doorstop frame (84) at an upper end position of a straight line vertically extending from a position separated by a predetermined distance from an end face (84*a*) that the car door (23) is to abut toward the side of the car door (23), a first reflecting member (61) is disposed facing upward at a lower end position of the straight line, and the light-emitting/light-receiving unit (4) is capable of outputting an optical beam and detecting an incident optical beam.

A housing space (30) that houses the light-emitting/light-receiving unit (4) in a state where the car door (23) is closed is formed on the car door (23), and a second reflecting member (62) is disposed facing upward at a bottom portion of the housing space (30) and extends from the same position as the end face in a closing direction (23*a*) of the car door (23), which is to abut the doorstop frame (84), toward the back of the housing space (30).

The light-emitting/light-receiving unit (4) generates a foreign object detection signal when detection of an optical beam is interrupted during closing of the car door (23).

As a result, the presence of a foreign object is recognized and a closing operation of the car door (23) is aborted.

Moreover, in a specific configuration, the first reflecting member (61) is held inside a groove (87) of a threshold (86) in which the car door (23) fits so as to be slidable.

According to the fifth elevator safety device described above, when a foreign object is absent from the entrance of the elevator car, during a movement of the car door (23) from a fully open state to a fully closed state, an optical beam outputted from the light-emitting/light-receiving unit (4) is reflected by the first reflecting member (61) and enters the light-emitting/light-receiving unit (4) until the light-emitting/light-receiving unit (4) penetrates into the housing space (30), and after the light-emitting/light-receiving unit (4) penetrates into the housing space (30), an optical beam outputted from the light-emitting/light-receiving unit (4) is reflected by the second reflecting member (62) and enters the light-emitting/light-receiving unit (4).

Consequently, detection of an optical beam by the light-emitting/light-receiving unit (4) is not interrupted during closing of the car door (23) and a foreign object detection signal is not generated.

In contrast, when a string-like foreign object is present across the entrance, since an optical beam outputted from the light-emitting/light-receiving unit (4) is blocked by the foreign object during closing of the car door (23), detection of the optical beam by the light-emitting/light-receiving unit (4) is interrupted and, as a result, a foreign object detection signal is generated.

In addition, since the light-emitting/light-receiving unit (4) is disposed on the doorstop frame (84), the influence of a vibration, an impact made on the elevator car, or the like caused during opening or closing of the car door (23) or, more specifically, a variance in an amount of light received of an incident optical beam, a displacement of an irradiation position of an optical beam, or the like can be avoided. As a result, foreign object detection accuracy can be enhanced. In a similar manner, since the first reflecting member (61) is disposed at a lower end position of the doorstop frame (84), the influence of a vibration, an impact made on the elevator car, or the like caused during opening or closing of the car door (23) can be avoided.

In a specific configuration, a safety shoe frame (29) that moves relative to the car door (23) is mounted on the car door (23), wherein a protruding member (94) that extends along the straight line is formed on the end face (84*a*) of the doorstop frame (84), the protruding member (94) having a protruding length from the end face (84*a*) that is shorter than the predetermined distance, and positioned on the side of the safety shoe frame (29) with respect to the position of the straight line and overlaps the safety shoe frame (29) during closing of the car door (23).

According to the specific configuration, when a string-like foreign object is present across the entrance, the protruding member (94) overlaps the safety shoe frame (29) during closing of the car door (23) to sandwich a part of the foreign object between itself and the safety shoe frame (29) and causes the part to follow the closing direction. Therefore, the foreign object is pushed by a tip of the protruding member (94) toward the side of the end face in a closing direction (23*a*) of the car door (23). As a result, an optical beam outputted from the light-emitting/light-receiving unit (4) is to be blocked by the foreign object.

In addition, in a specific configuration, a foreign object pushing member (93) that protrudes further toward the side of the car door (23) than the end face (84*a*) of the doorstop frame (84) is disposed at a lower end portion of the doorstop frame (84).

According to the specific configuration, since a foreign object is pushed more forward than the end face (84*a*) of the doorstop frame (84) by the foreign object pushing member (93), an optical beam is invariably blocked by the foreign object and, as a result, the string-like foreign object can be reliably detected.

Furthermore, in a specific configuration, a cleaning tool (78) that cleans a surface of the first reflecting member (61) during closing of the car door (23) is mounted on the car door (23).

According to the specific configuration, since the surface of the first reflecting member (61) is cleaned by the cleaning tool (78) every time the car door (23) closes, the surface of the first reflecting member (61) is constantly maintained as a favorable reflecting surface.

Moreover, in a specific configuration, a cleaning tool (79) is mounted further toward the side of the car door (23) than the light-emitting/light-receiving unit (4) on the doorstop frame (84), wherein the cleaning tool (79) cleans a surface of the second reflecting member (62) during closing of the car door (23).

According to the specific configuration, since the surface of the second reflecting member (62) is cleaned by the cleaning tool (79) every time the car door (23) closes, the surface of the second reflecting member (62) is constantly maintained as a favorable reflecting surface.

Furthermore, in a specific configuration, the safety device is arranged such that the car door (23) closes from a fully open state to a fully closed state via a first almost-fully closed state and a second almost-fully closed state, the safety device including detecting means that switches from OFF to ON at a predetermined point in time during closing of the car door (23) from the first almost-fully closed state to the second almost-fully closed state, wherein the second reflecting member (62) reflects an optical beam outputted from the light-emitting/light-receiving unit (4) during closing of the car door (23) from the first almost-fully closed state to the second almost-fully closed state and hardly reflects an optical beam outputted from the light-emitting/light-receiving unit (4) during closing of the car door (23) from the second almost-fully closed state to the fully closed state.

A control unit (100) determines that an abnormality has occurred at the light-emitting/light-receiving unit (4) when a foreign object detection signal is not generated after the detecting means is switched on.

According to the specific configuration, when the car door (23) closes to the first almost-fully closed state, an optical beam outputted from the light-emitting/light-receiving unit (4) is reflected by the second reflecting member (62) and returns to the light-emitting/light-receiving unit (4). At this point, the detecting means has been switched off. Subsequently, while the car door (23) is closing to the second almost-fully closed state, an optical beam outputted from the light-emitting/light-receiving unit (4) is reflected by a reflecting portion (621) of the second reflecting member (62) and returns to the light-emitting/light-receiving unit (4) with an amount of light equal to or exceeding a certain level and, at the same time, the detecting means is switched on at the predetermined point in time. When the car door (23) further closes from the second almost-fully closed position, since an optical beam outputted from the light-emitting/light-receiving unit (4) is not reflected by the second reflecting member (62) and does not return to the light-emitting/light-receiving unit (4) with an amount of light equal to or exceeding a certain level, a foreign object detection signal is generated. At this point, the detecting means is still turned on. Therefore, as long as the light-emitting/light-receiving unit (4) is operating normally, in a fully closed state, the detecting means switches on and, at the same time, a foreign object detection signal is generated.

However, if some kind of abnormality has occurred at the light-emitting/light-receiving unit (4), in a fully closed state, the detecting means is switched on but a foreign object detection signal is not generated. Consequently, it can be determined that some kind of abnormality has occurred at the light-emitting/light-receiving unit (4) when a foreign object detection signal is not generated after the detecting means is switched on.

A sixth elevator safety device according to the present invention includes at least one car door (23) that moves in a direction approaching/separating from a doorstop frame (84) to open/close an entrance, wherein a light-emitting/light-receiving unit (4) is disposed facing downward at an upper end position of a straight line vertically extending from an abutting position, which the car door (23) abuts in a fully closed state, of the doorstop frame (84), a reflecting member (61) is disposed on the doorstop frame (84) facing upward at a lower end position of the straight line, and the light-emitting/light-receiving unit (4) is capable of outputting an optical beam and detecting an incident optical beam.

A pair of depressed portions (84*b*) and (23*b*) or a pair of notched portions (84*c*) and (23*c*) extending along the straight line are formed on an end face (84*a*) of the doorstop frame (84) that the car door (23) is to abut and an end face in a closing direction (23*a*) of the car door (23) that is to abut the doorstop frame (84), and when the car door (23) is in a fully closed state, a pathway (115) through which an optical beam passes is formed by the pair of depressed portions (84*b*) and (23*b*) or the pair of notched portions (84*c*) and (23*c*). The light-emitting/light-receiving unit (4) generates a foreign object detection signal when detection of an optical beam is interrupted during closing of the car door (23).

As a result, the presence of a foreign object is recognized and a closing operation of the car door (23) is aborted.

Moreover, in a specific configuration, the reflecting member (61) is held inside a groove (87) of a threshold (86) in which the car door (23) fits so as to be slidable.

According to the sixth elevator safety device described above, when a foreign object is absent from the entrance of the elevator car, during a movement of the car door (23) from a fully open state to a fully closed state, an optical beam outputted from the light-emitting/light-receiving unit (4) is reflected by the reflecting member (61) and enters the light-emitting/light-receiving unit (4). Consequently, detection of an optical beam by the light-emitting/light-receiving unit (4) is not interrupted during closing of the car door (23) and a foreign object detection signal is not generated.

In contrast, if a string-like foreign object is present across the entrance, since an optical beam outputted from the light-emitting/light-receiving unit (4) is blocked by the foreign object when the car door (23) reaches a fully closed state, detection of the optical beam by the light-emitting/light-receiving unit (4) is interrupted and, as a result, a foreign object detection signal is generated.

In addition, since the light-emitting/light-receiving unit (4) is disposed on the doorstop frame (84), the influence of a vibration, an impact made on the elevator car, or the like caused during opening or closing of the car door (23) or, more specifically, a variance in an amount of light received of an incident optical beam, a displacement of an irradiation position of an optical beam, or the like can be avoided. As a result, foreign object detection accuracy can be enhanced. In a similar manner, since the reflecting member (61) is disposed at a lower end position of the doorstop frame (84), the influence of a vibration, an impact made on the elevator car, or the like caused during opening or closing of the car door can be avoided.

In a specific configuration, a cleaning tool that cleans a surface of the reflecting member (61) during closing of the car door (23) is mounted on the car door (23).

According to the specific configuration, since the surface of the reflecting member (61) is cleaned by the cleaning tool every time the car door (23) closes, the surface of the reflecting member (61) is constantly maintained as a favorable reflecting surface.

In a specific configuration of the third to sixth elevator safety devices described above, output of an optical beam by the light-emitting/light-receiving unit (4) is executed during closing of the car door from an almost-fully closed state to a fully closed state.

According to the specific configuration, by outputting an optical beam from an almost-fully closed state, a person can be prevented from peeking into the light-emitting/light-receiving unit (4) during output of the optical beam.

Furthermore, in a specific configuration, foreign object penetration preventing members (91) and (92) that fill up a gap formed between a lower end of the end face in a closing direction of the car door and a surface of a threshold are mounted at a lower end portion of the car door.

According to the specific configuration, since the foreign object penetration preventing members (91) and (92) prevent penetration of a string-like foreign object into the gap formed between the lower end of the end face in a closing direction of the car door and the surface of the threshold, a string-like foreign object can be reliably detected during closing of the car door.

In another specific configuration of the first to sixth elevator safety devices, the safety device includes reverse door opening means, forced door closing means, and announcing means. When a foreign object detection signal is generated during closing of the car door, the reverse door opening means executes a reverse door opening operation for reversing the operation and opening the car door. The forced door closing means disables a reverse door opening operation by the reverse door opening means and forcibly executes a door closing operation of the car door regardless of whether a foreign object detection signal is generated or not. The announcing means announces execution of the forced door closing operation either before the execution of the forced door closing operation by the forced door closing means or in parallel with the execution of the forced door closing operation by the forced door closing means.

When, after a door closing operation of a car door starts, the door closing operation is not completed, it is likely that the door closing operation of the car door cannot be completed due to a circumstance other than a string-like foreign object being present across the entrance. In consideration thereof, in the specific configuration described above, a door closing operation of the car door is forcibly executed by the forced door closing means. Even when a forced door closing operation is executed in this manner, according to the specific configuration described above, since the execution of the forced door closing operation is announced by the announcing means, an occurrence of an accident due to the execution of the forced door closing operation can be prevented.

In a further specific configuration, the safety device described above further includes elevator car controlling means and second announcing means. The elevator car controlling means causes the elevator car to start running after completion of a forced door closing operation by the forced door closing means. When a foreign object detection signal is generated during an execution of a forced door closing operation by the forced door closing means, the second announcing means announces a start of a run of the elevator car before the run of the elevator car is started by the elevator car controlling means.

ADVANTAGE(S) OF THE INVENTION

A safety device for an elevator according to the present invention is capable of constantly reliably detecting a string-like foreign object regardless of a position thereof with a simple configuration that merely involves disposing a light-emitting/light-receiving unit and a reflecting member, and without having to make a significant modification to a conventional car door.

Figure 17A:
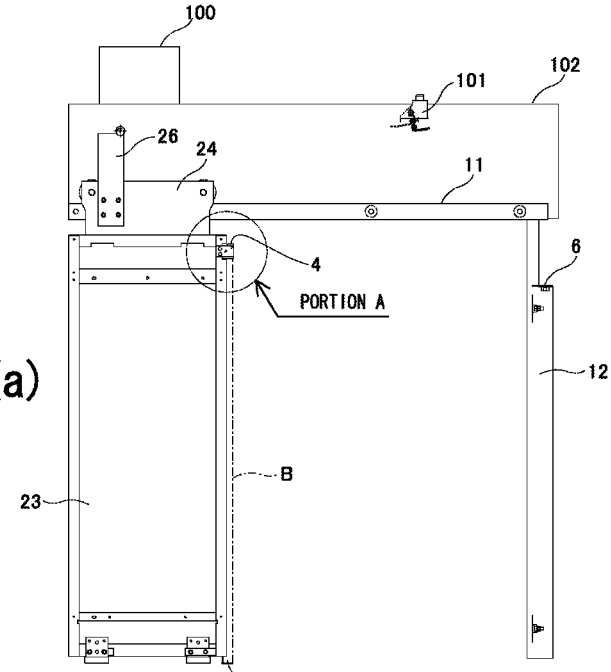
Figure 17B:
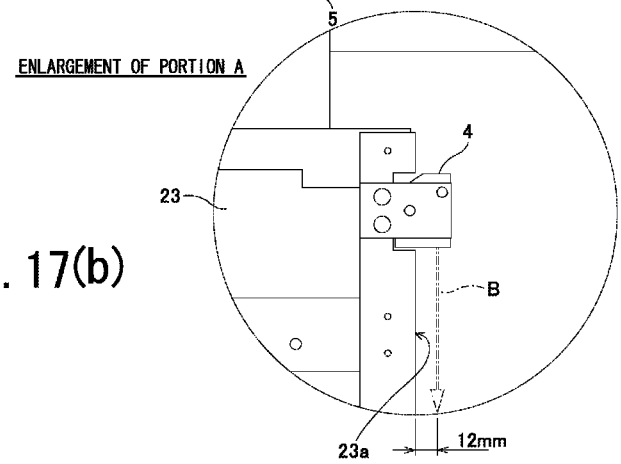
Figure 18A:
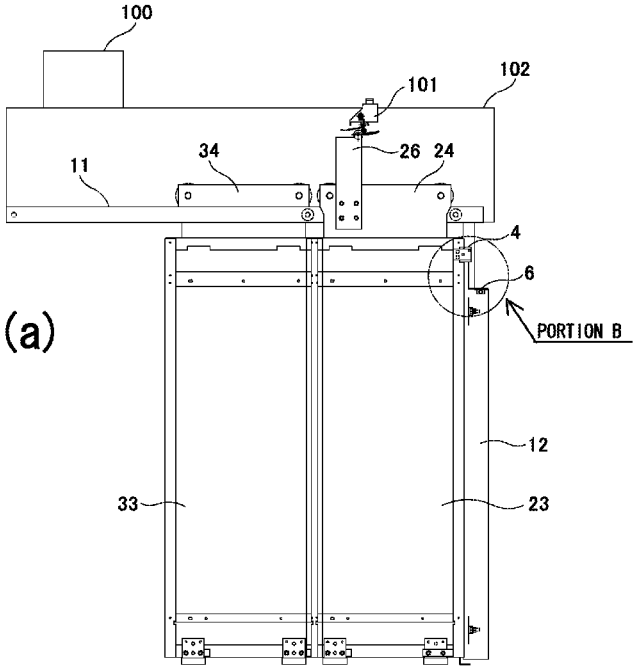
Figure 18B:
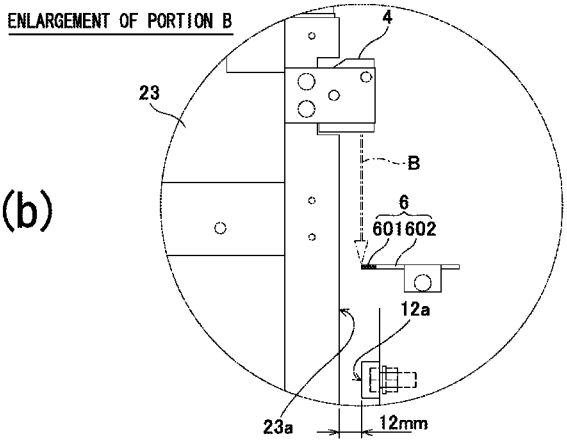
Figure 19A:
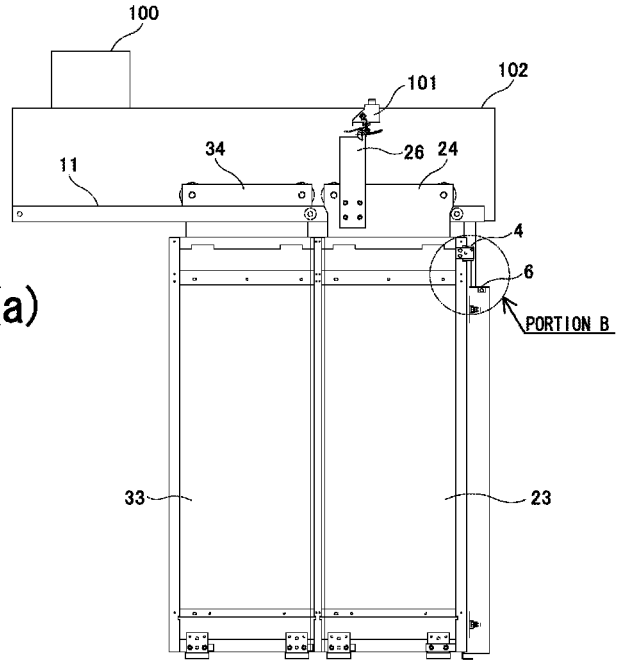
Figure 19B:
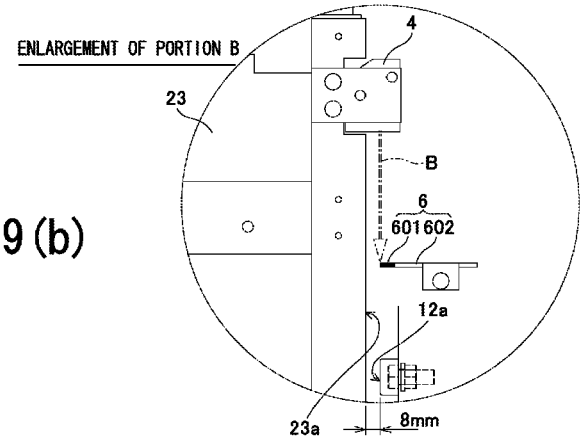
Figure 20A:
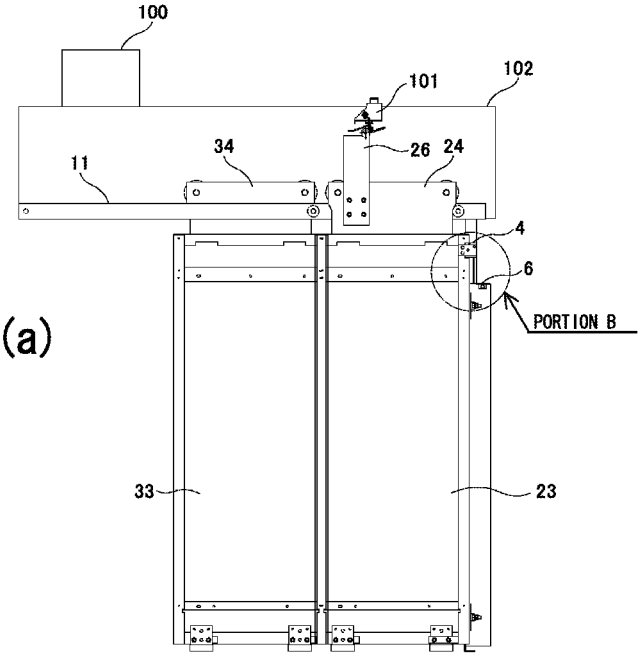
Figure 20B:
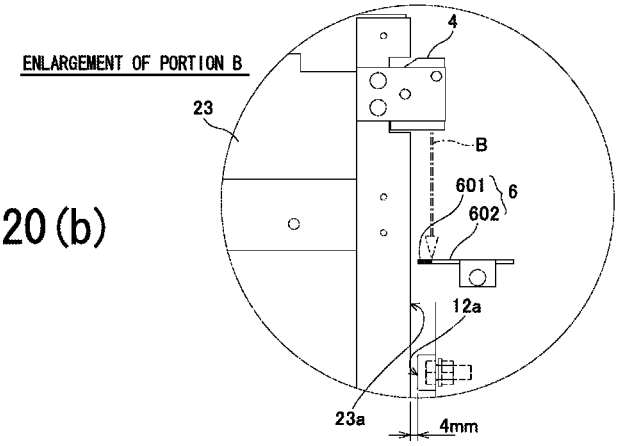
Figure 21:
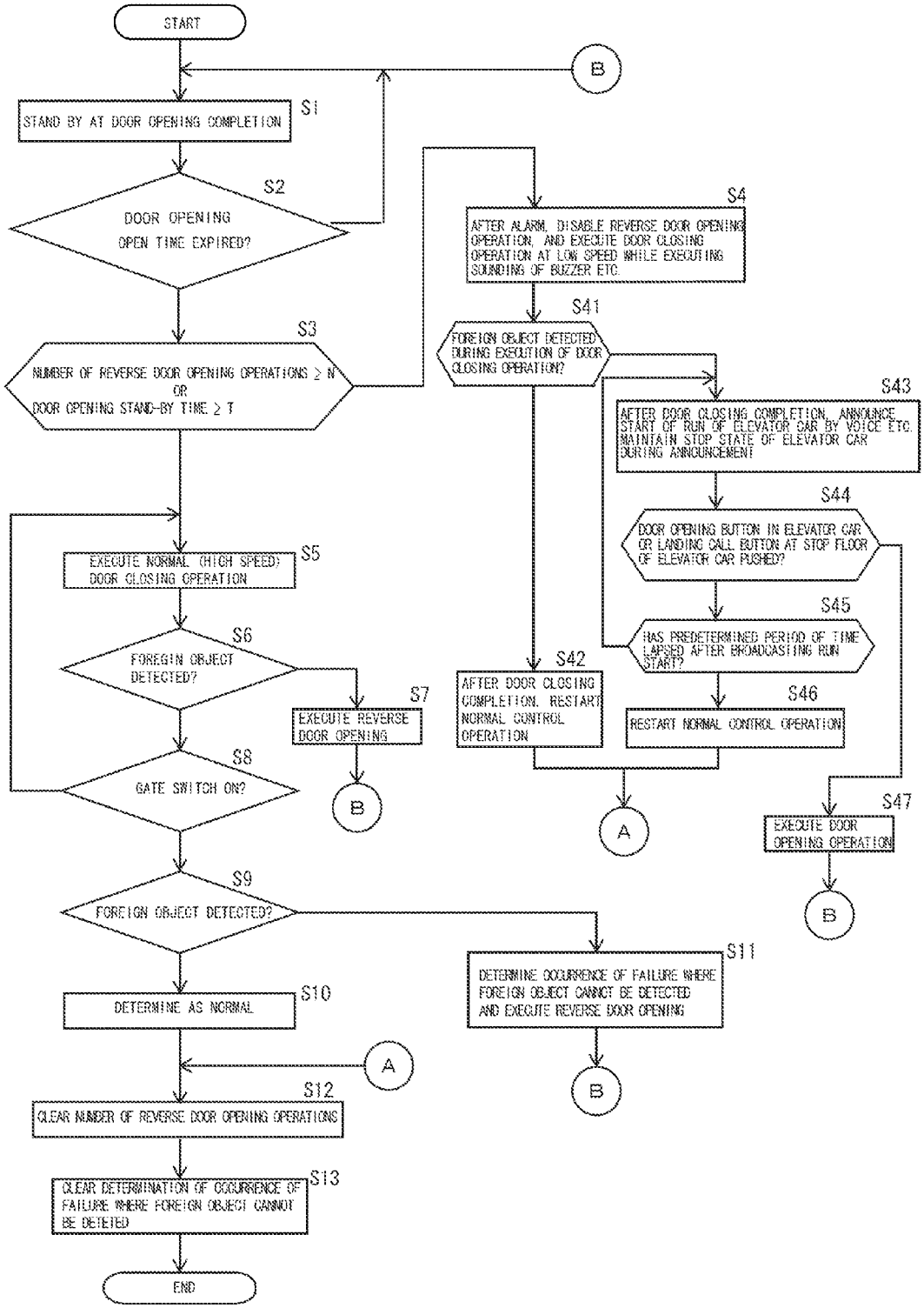
Figure 22A:
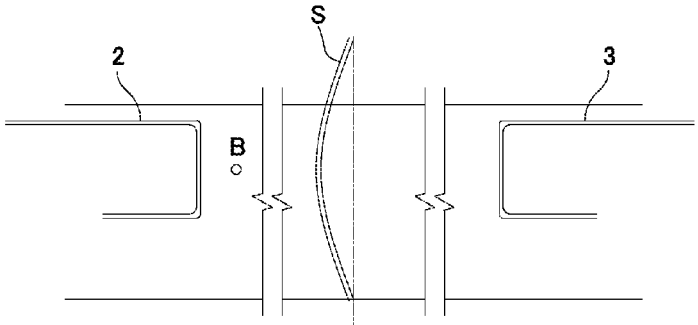
Figure 22B:
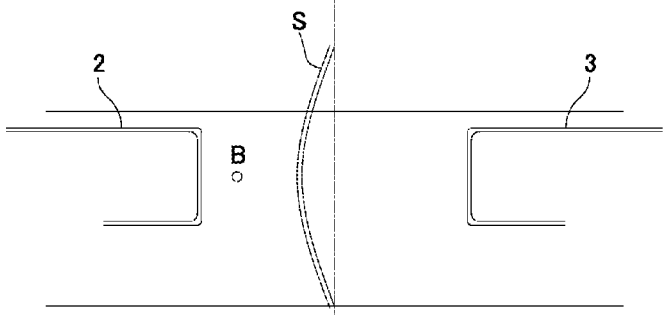
Figure 22C:
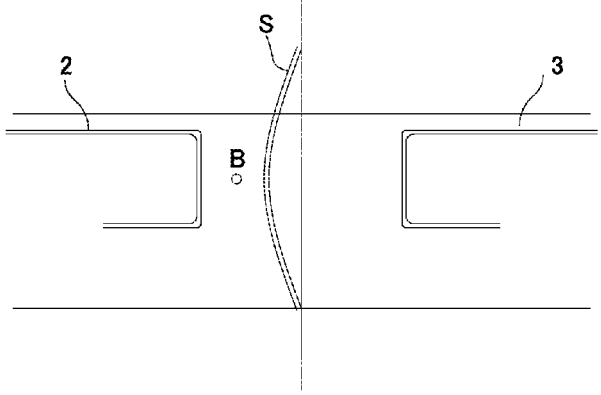
Figure 23A:
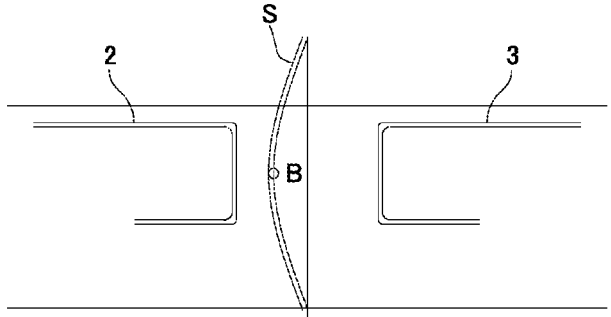
Figure 23B:
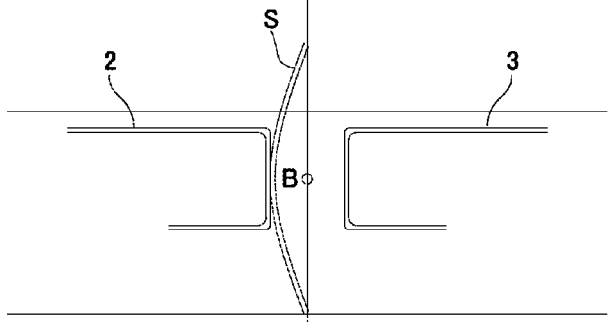
Figure 23C:
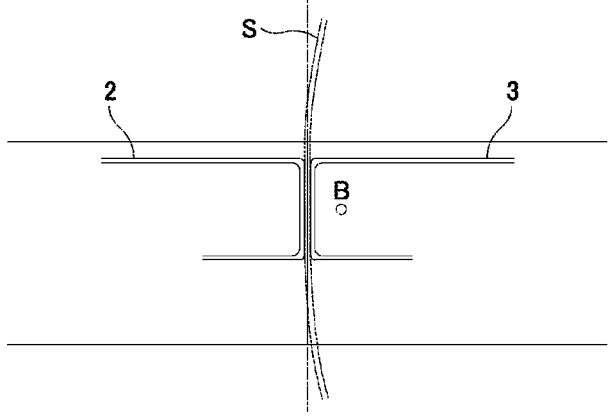
Figure 24A:
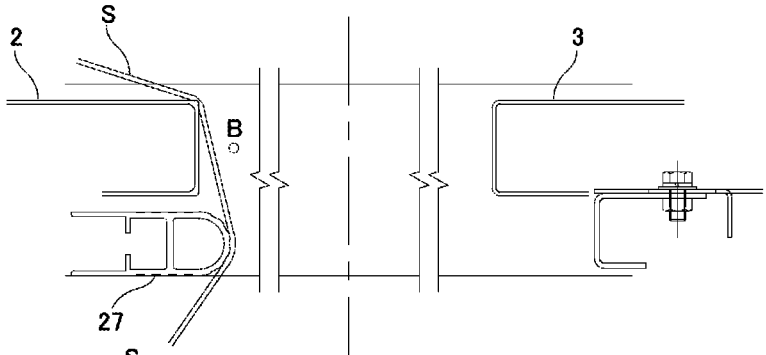
Figure 24B:
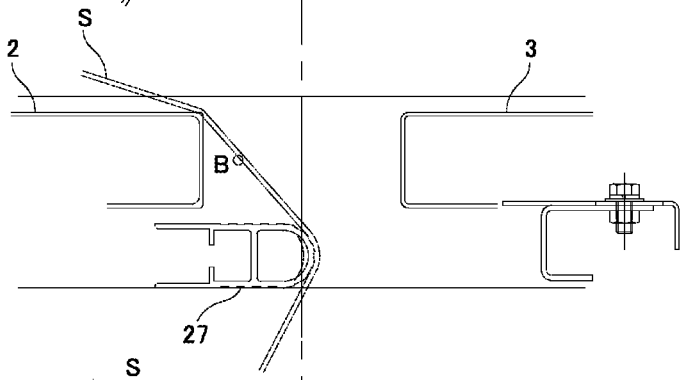
Figure 24C:
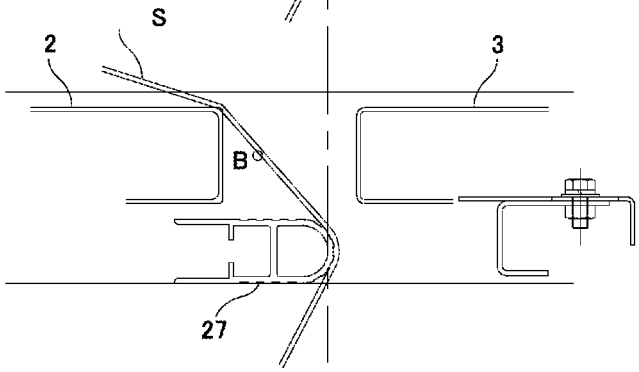
Figure 25A:
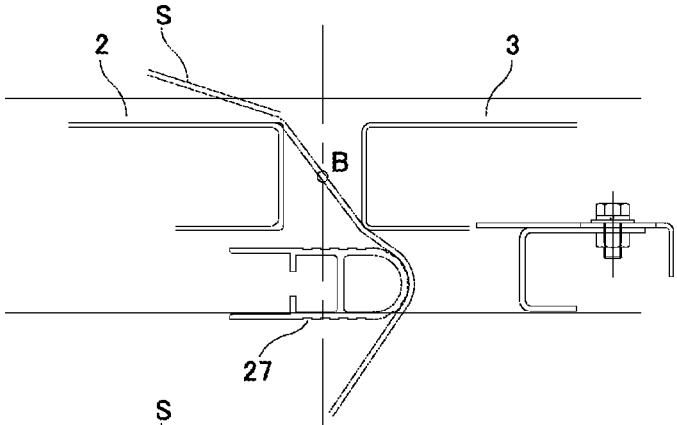
Figure 25B:
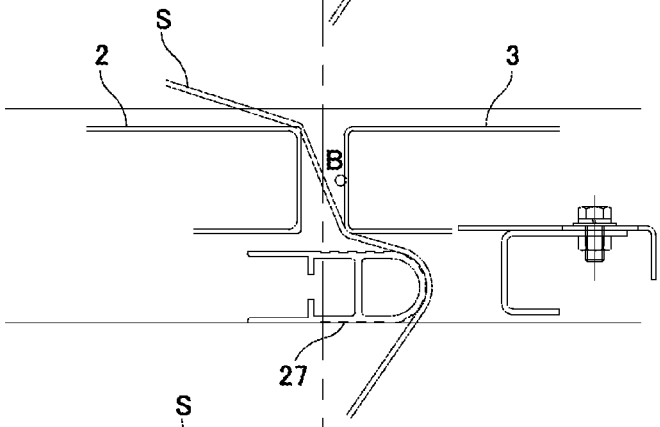
Figure 25C:
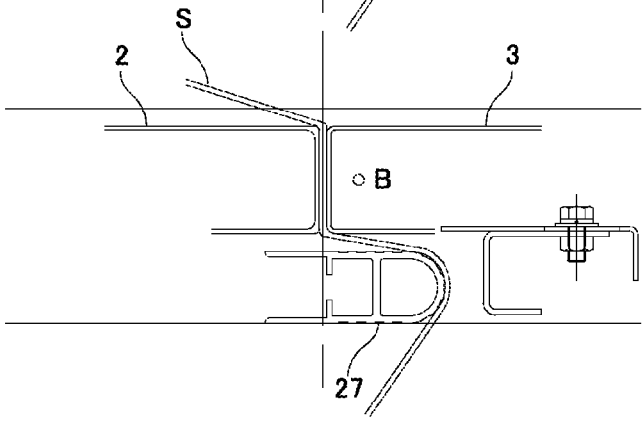
Figure 26A:
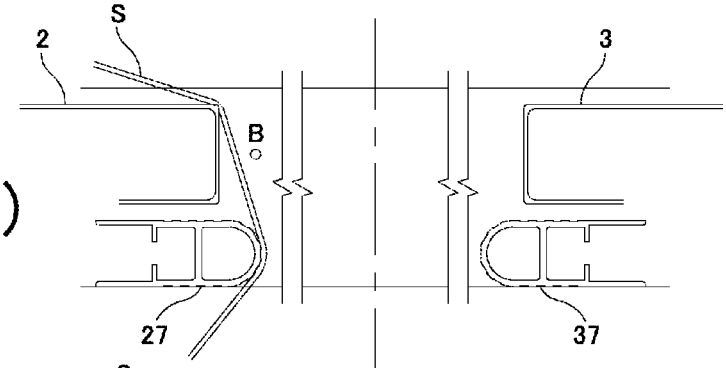
Figure 26B:
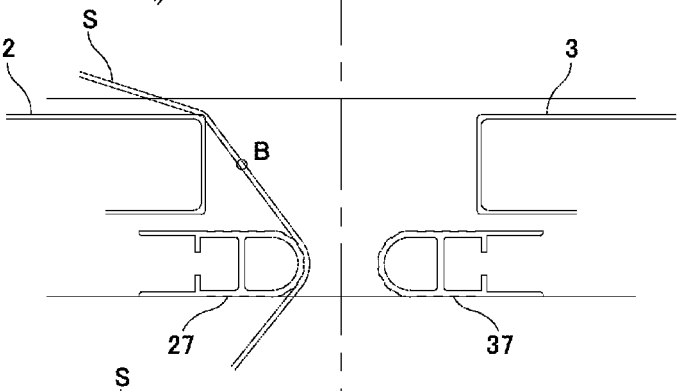
Figure 26C:
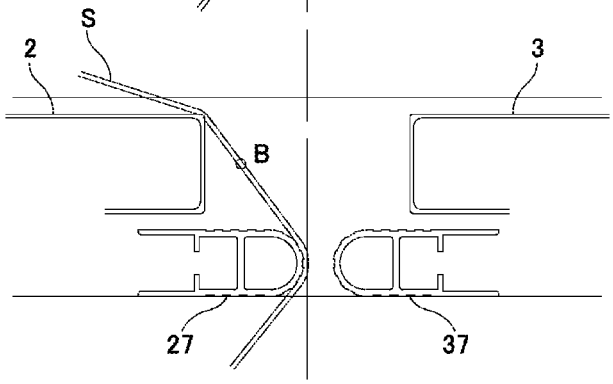
Figure 27A:
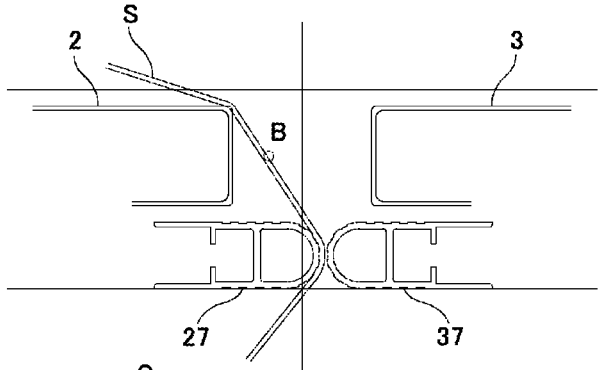
Figure 27B:
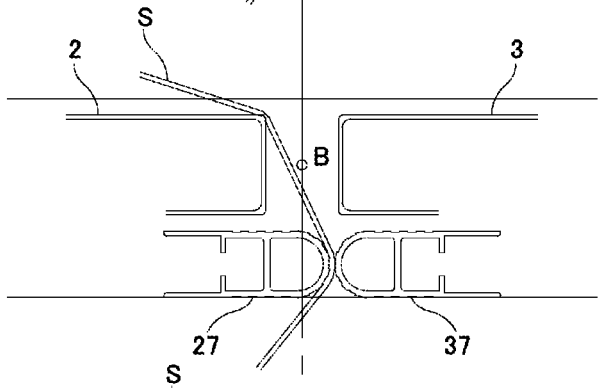
Figure 27C:
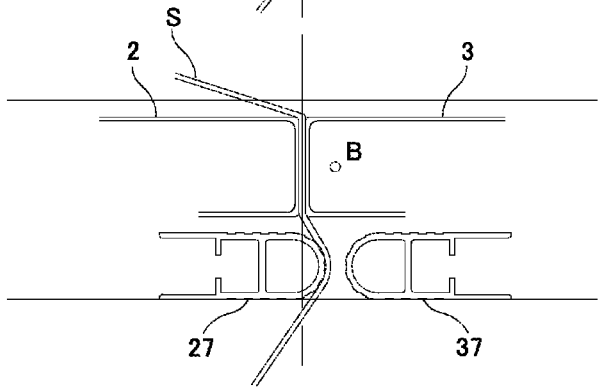
Figure 28A:
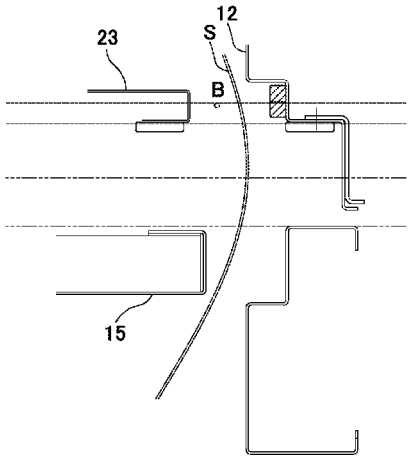
Figure 28B:
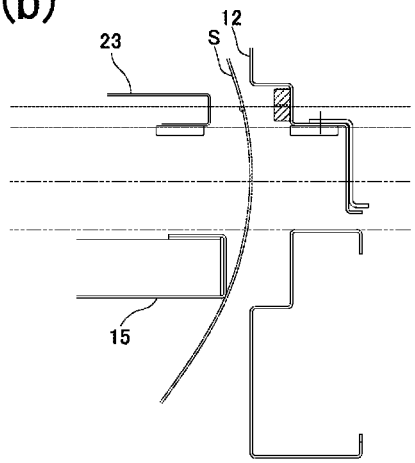
Figure 29A:
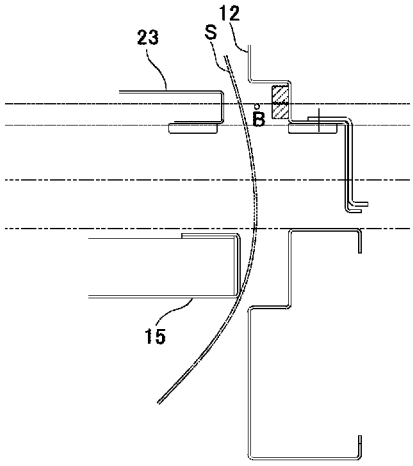
Figure 29B:
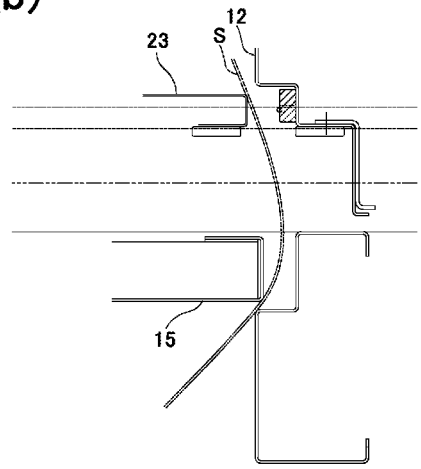
Figure 30A:
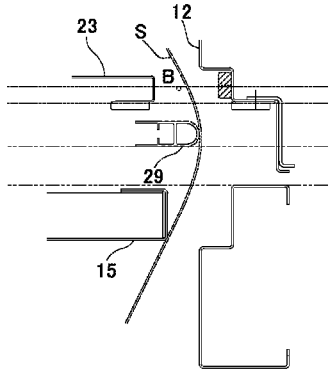
Figure 30B:
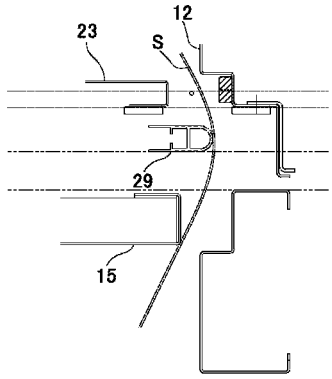
Figure 30C:
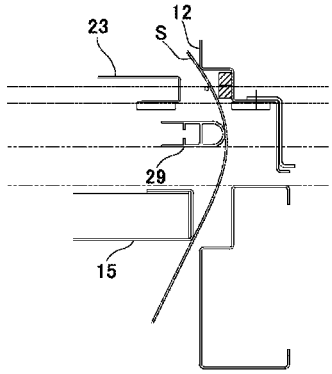
Figure 31A:
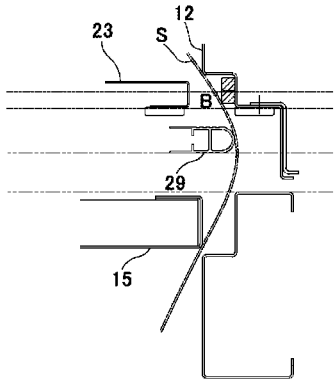
Figure 31B:
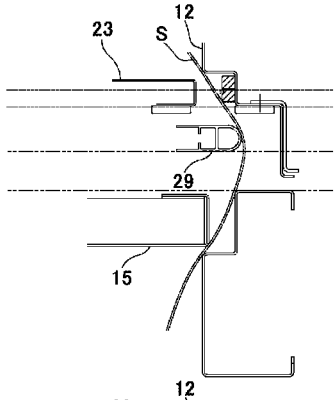
Figure 31C:
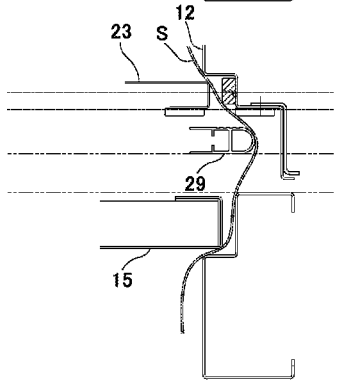
Figure 32:
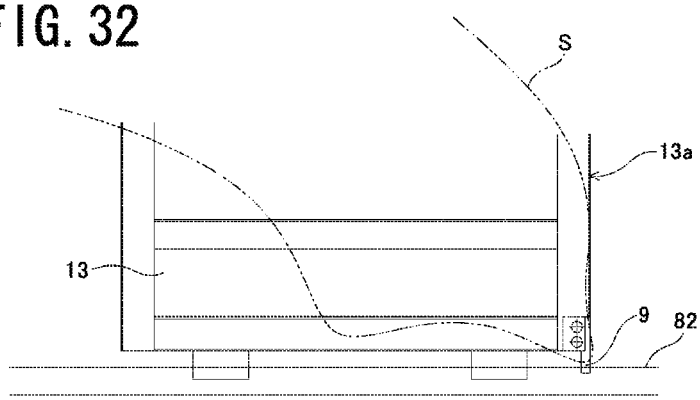
Figure 33:
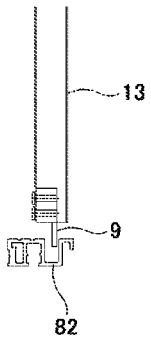
Figure 34:
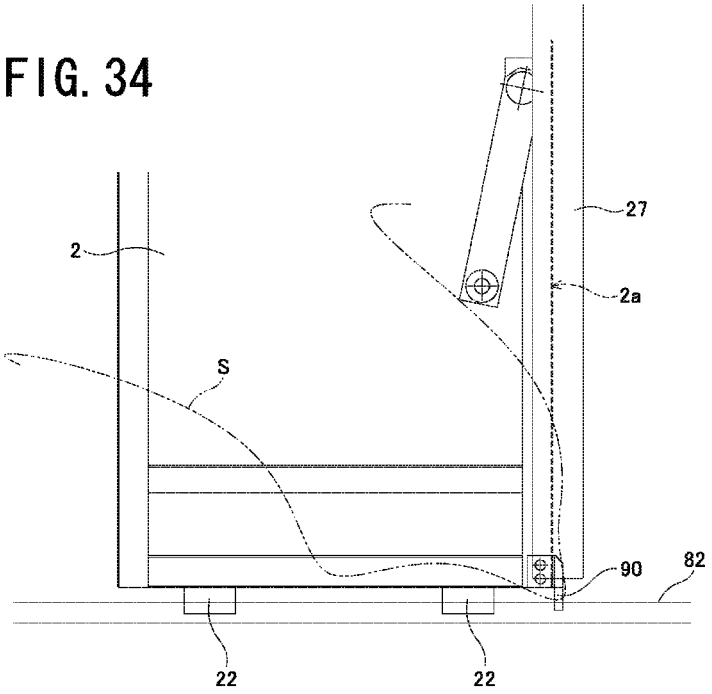
Figure 35:
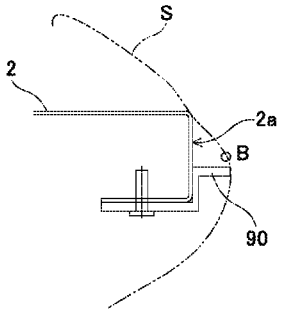
Figure 36:
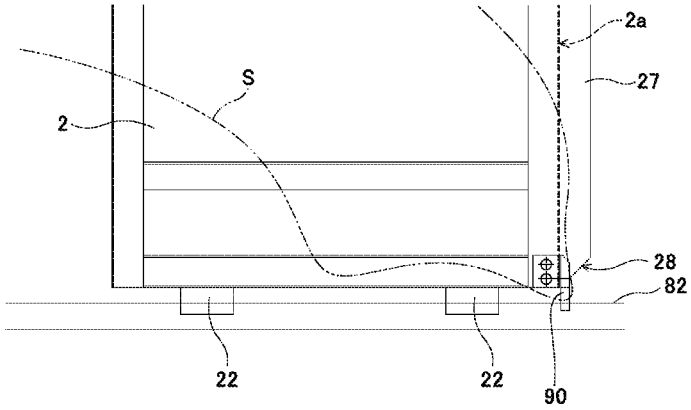
Figure 37:
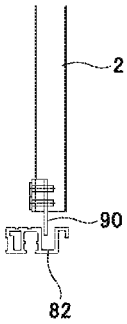
Figure 38:
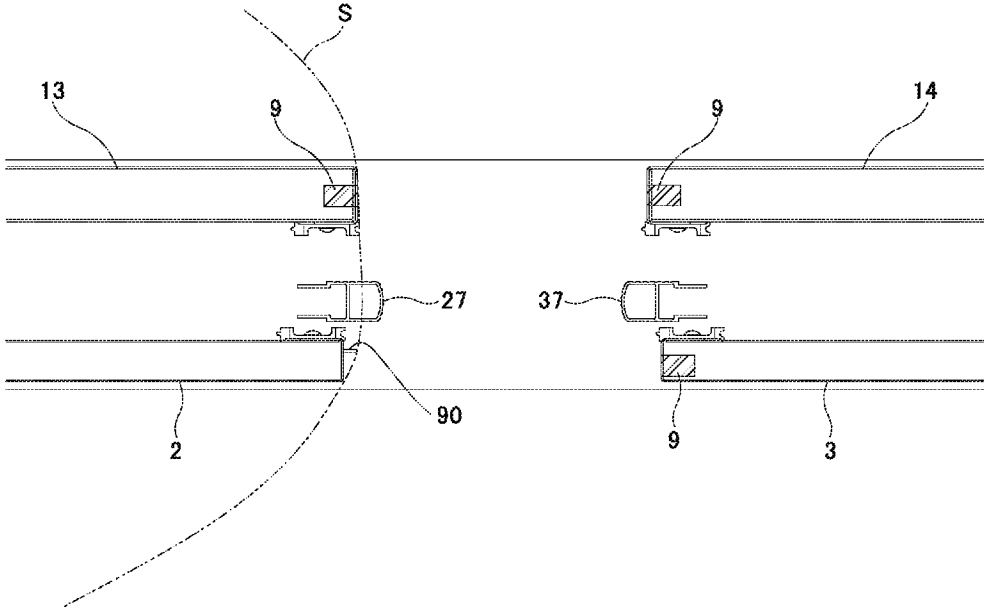
Figure 39:
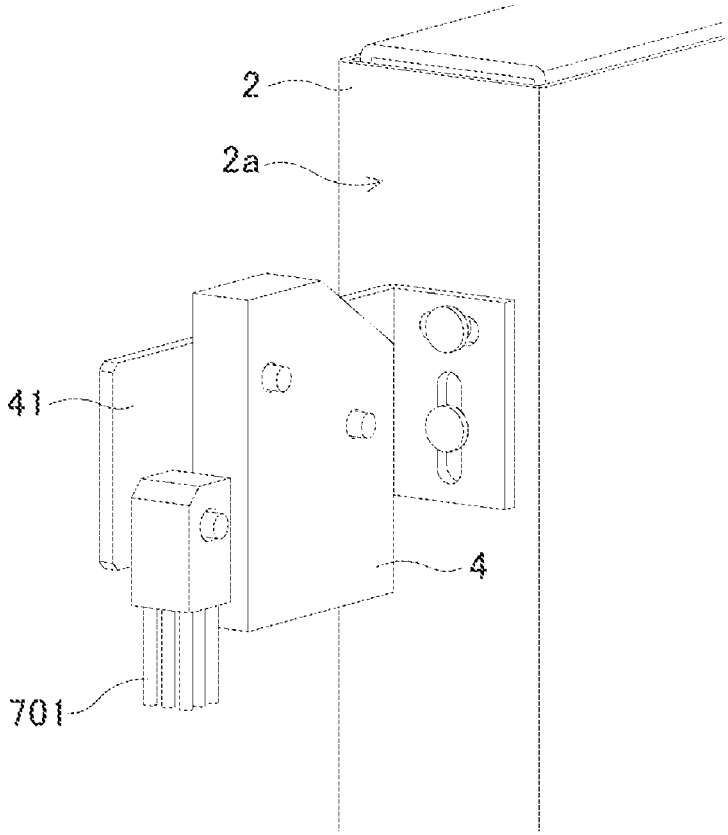
Figure 40:
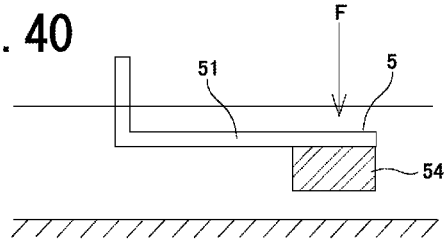
Figure 41:
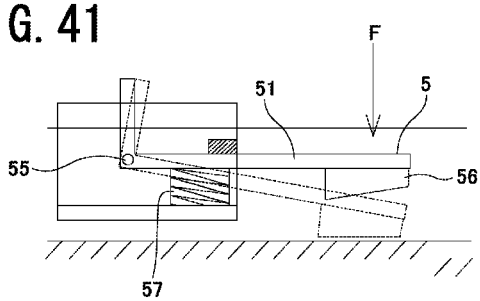
Figure 42:
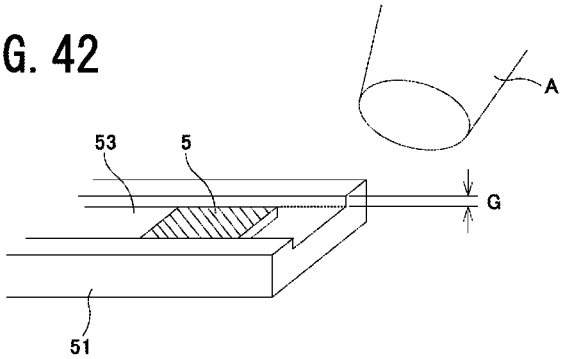
Figure 43:
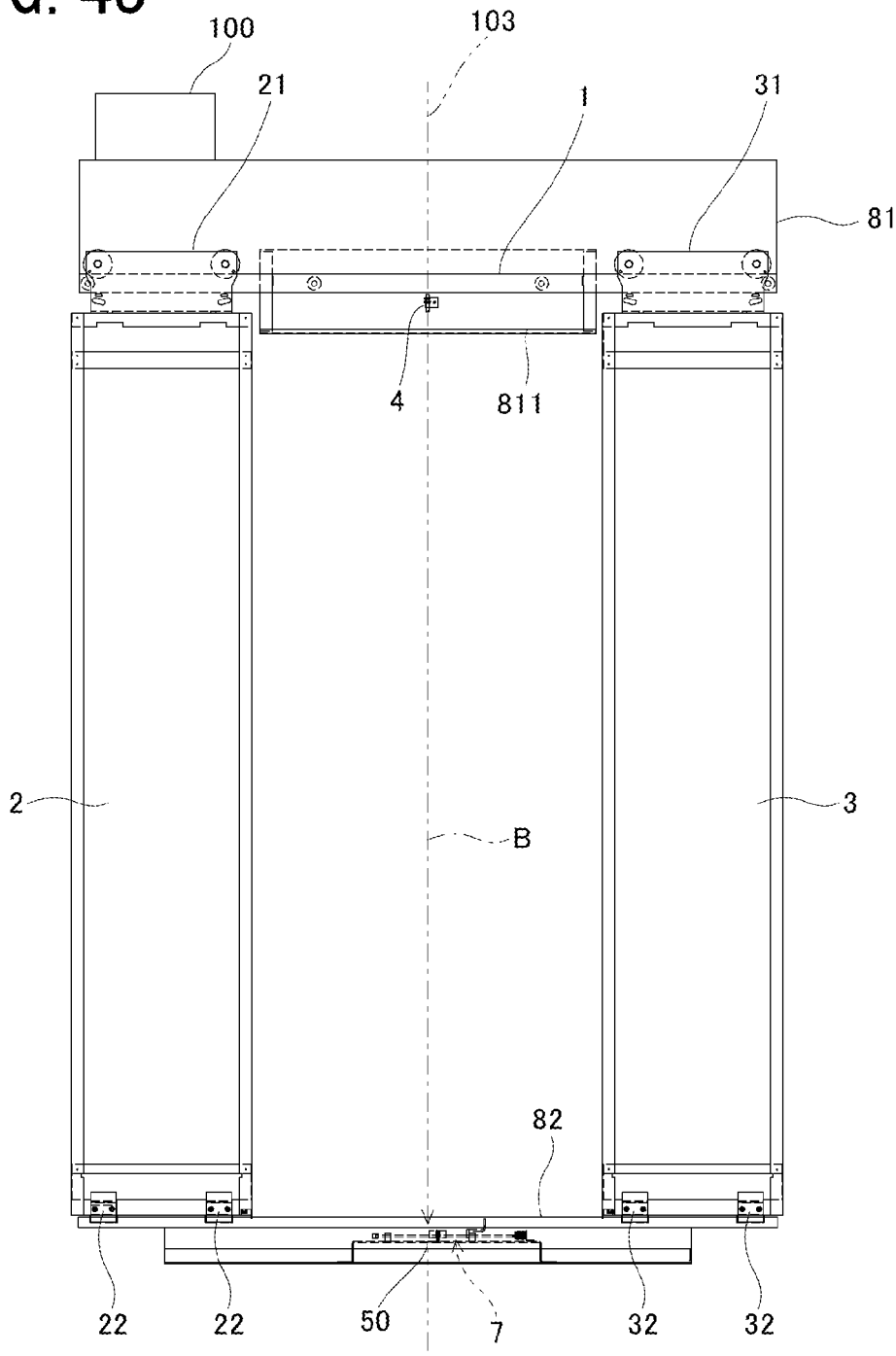
Figure 44:
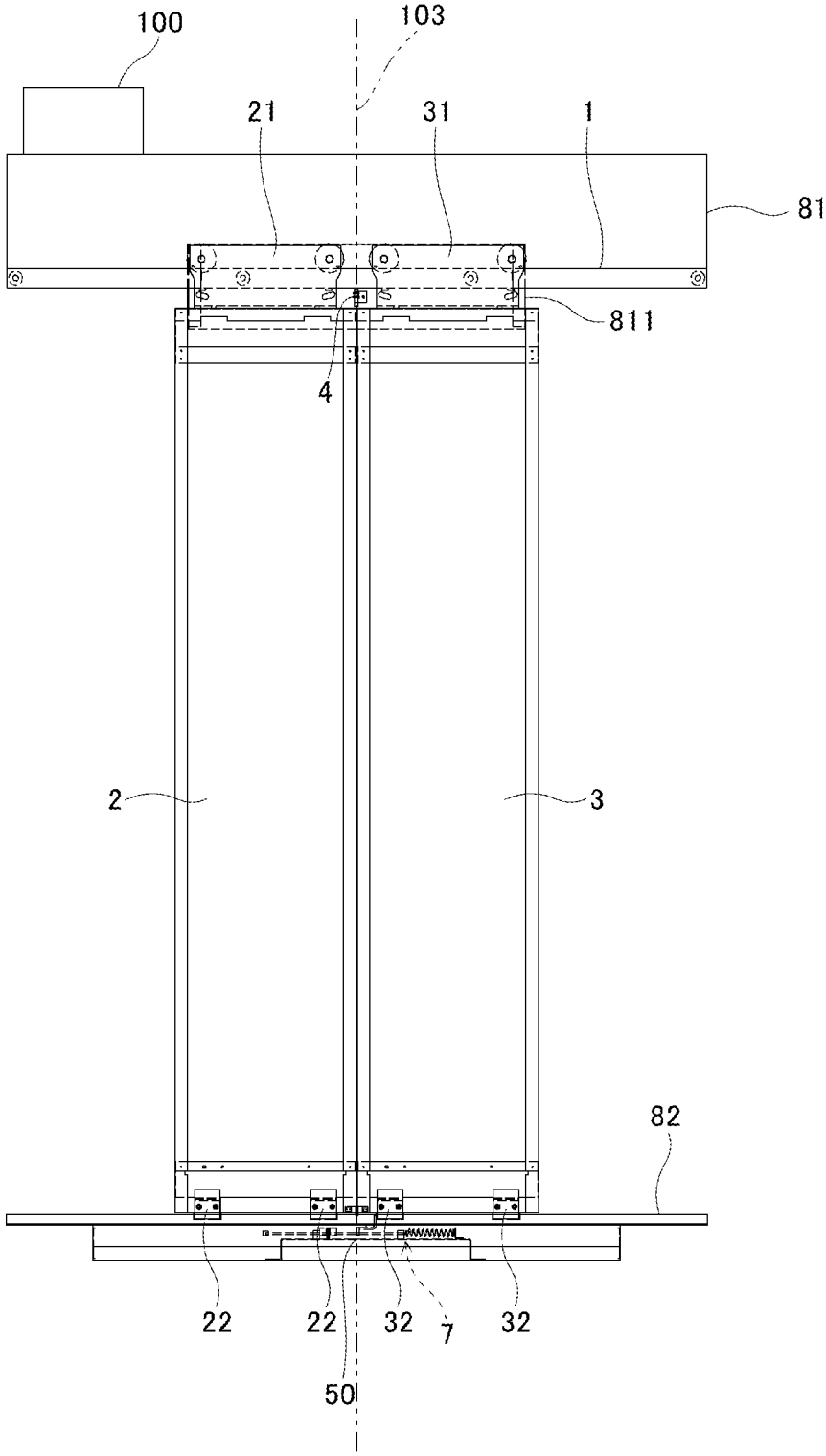
Figure 45:
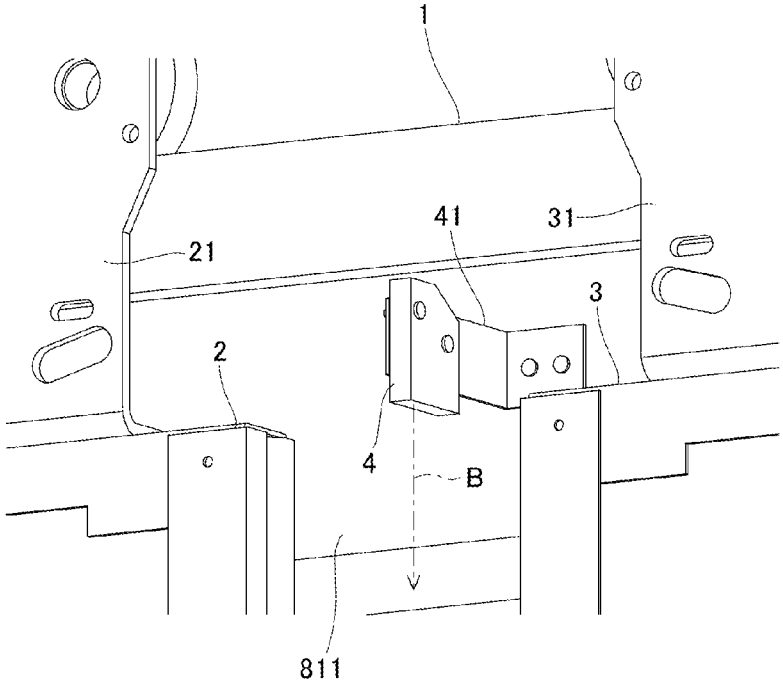
Figure 46:
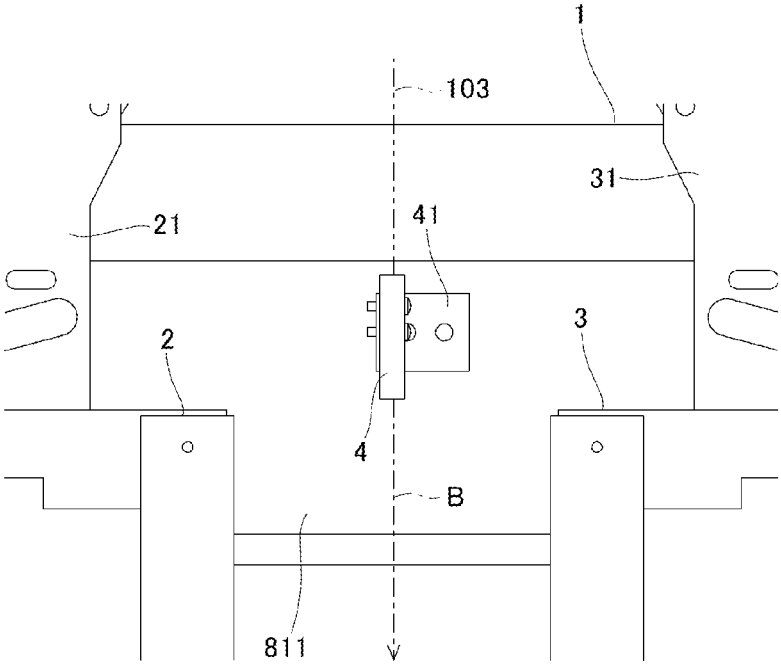
Figure 47:
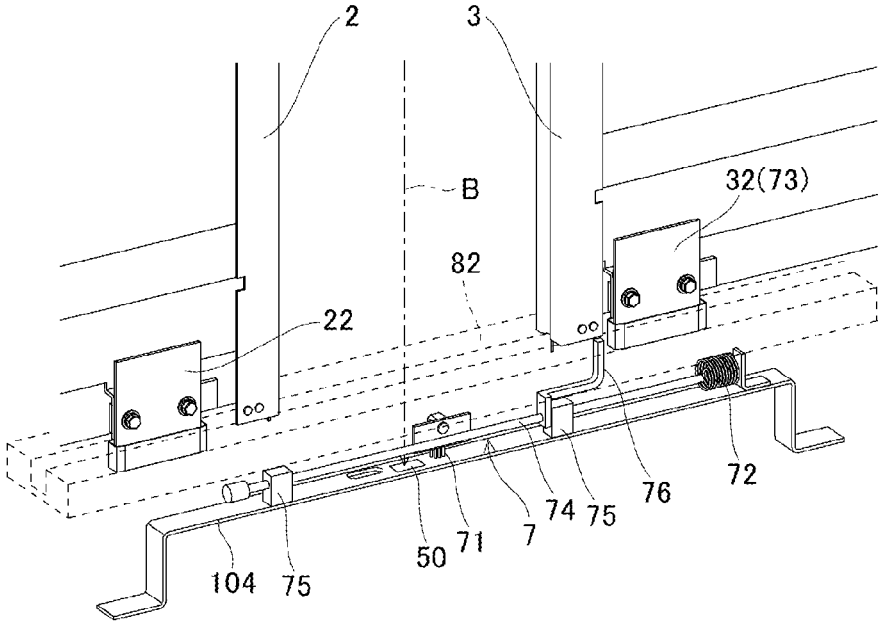
Figure 48:
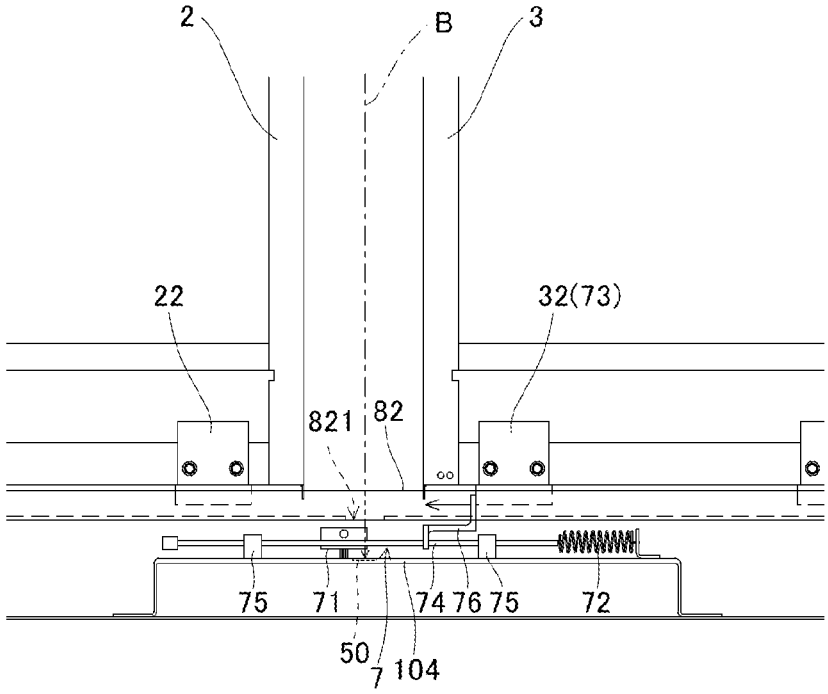
Figure 49:
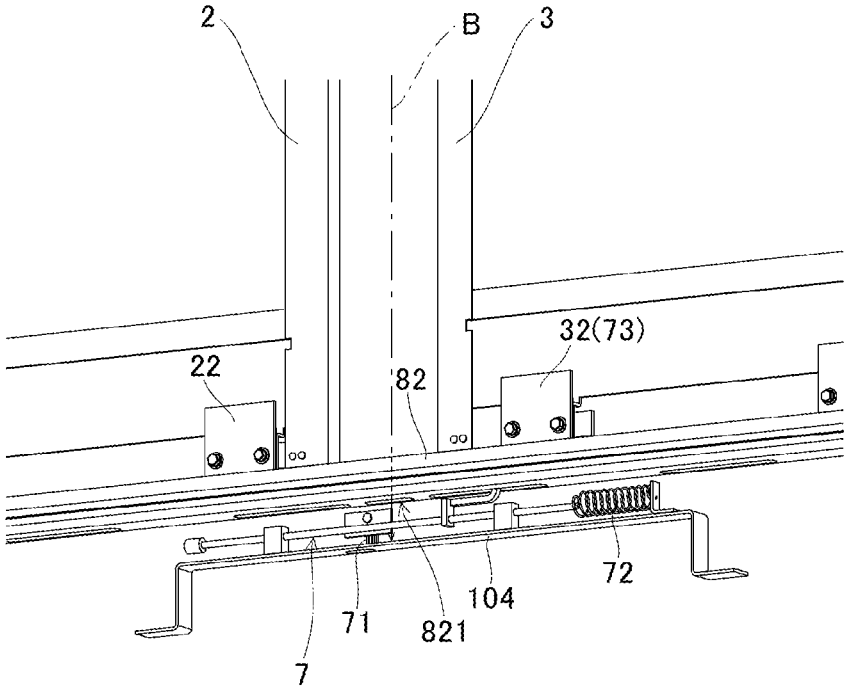
Figure 50:
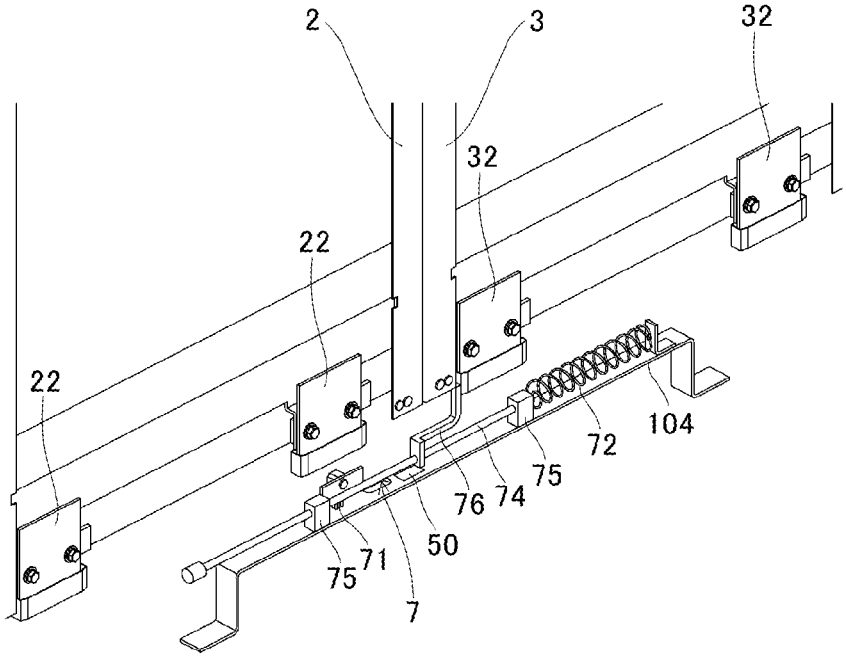
Figure 51:
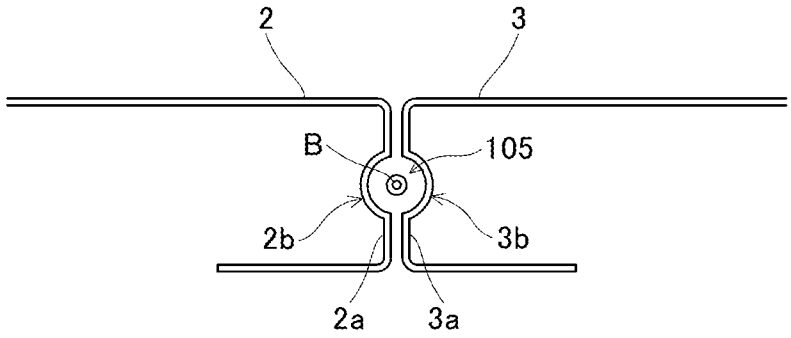
Figure 52:
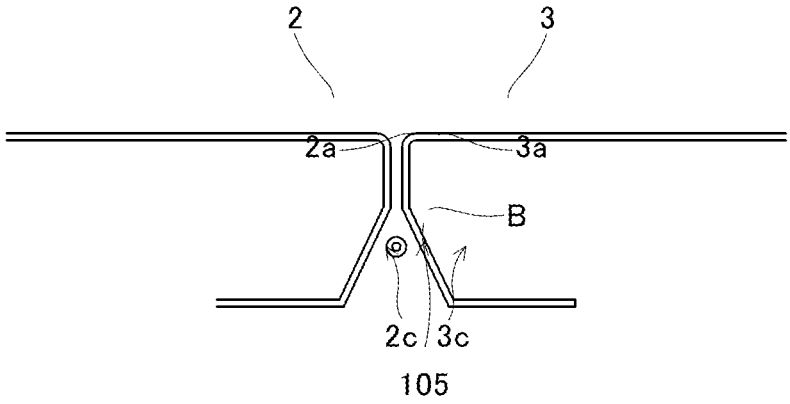
Figure 53:
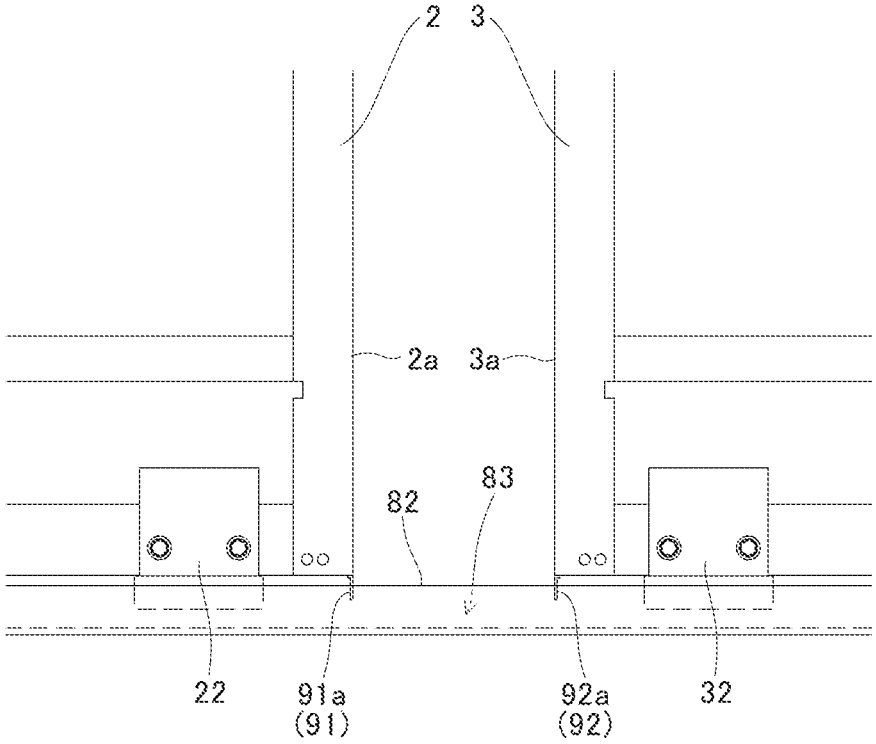
Figure 54A:
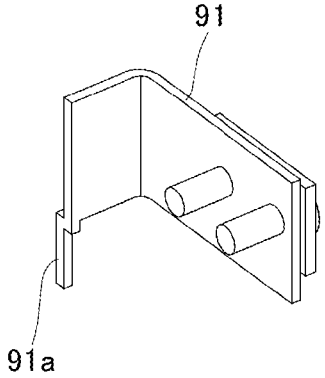
Figure 54B:
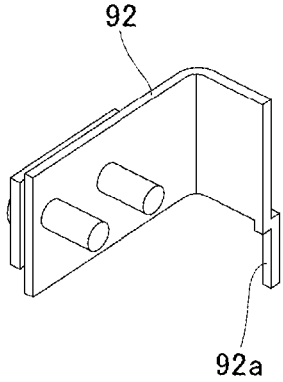
Figure 55:
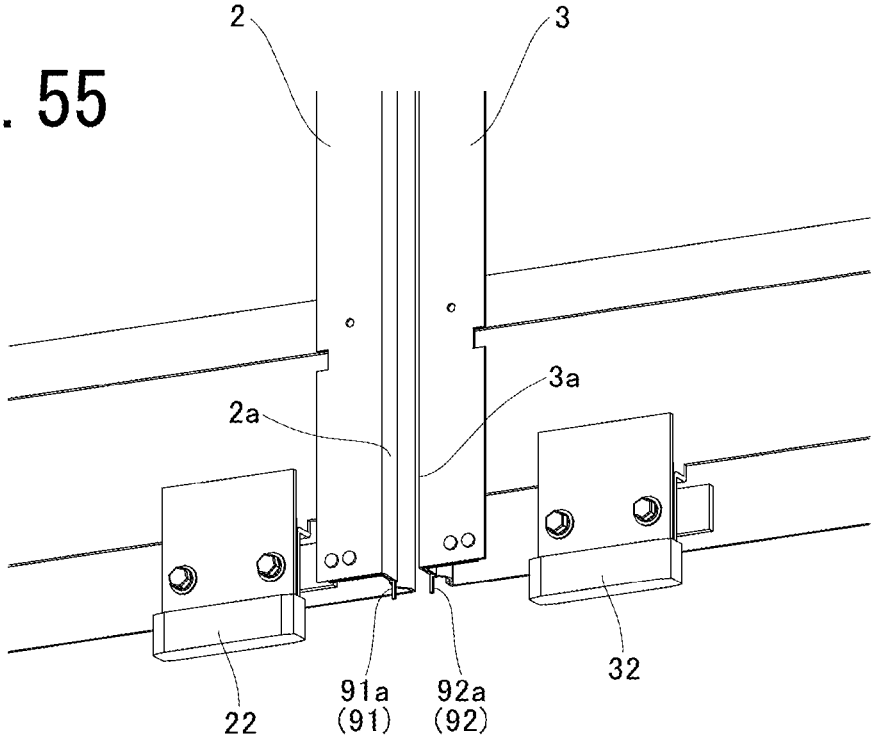
Figure 56:
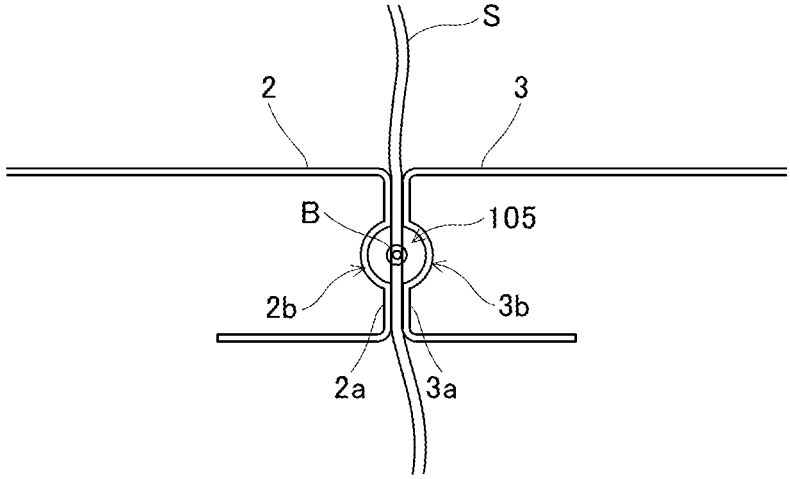
Figure 57:
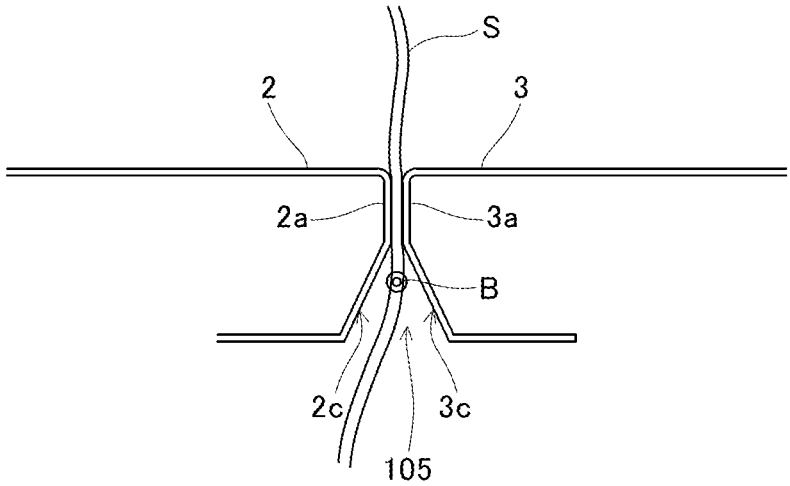
Figure 58:
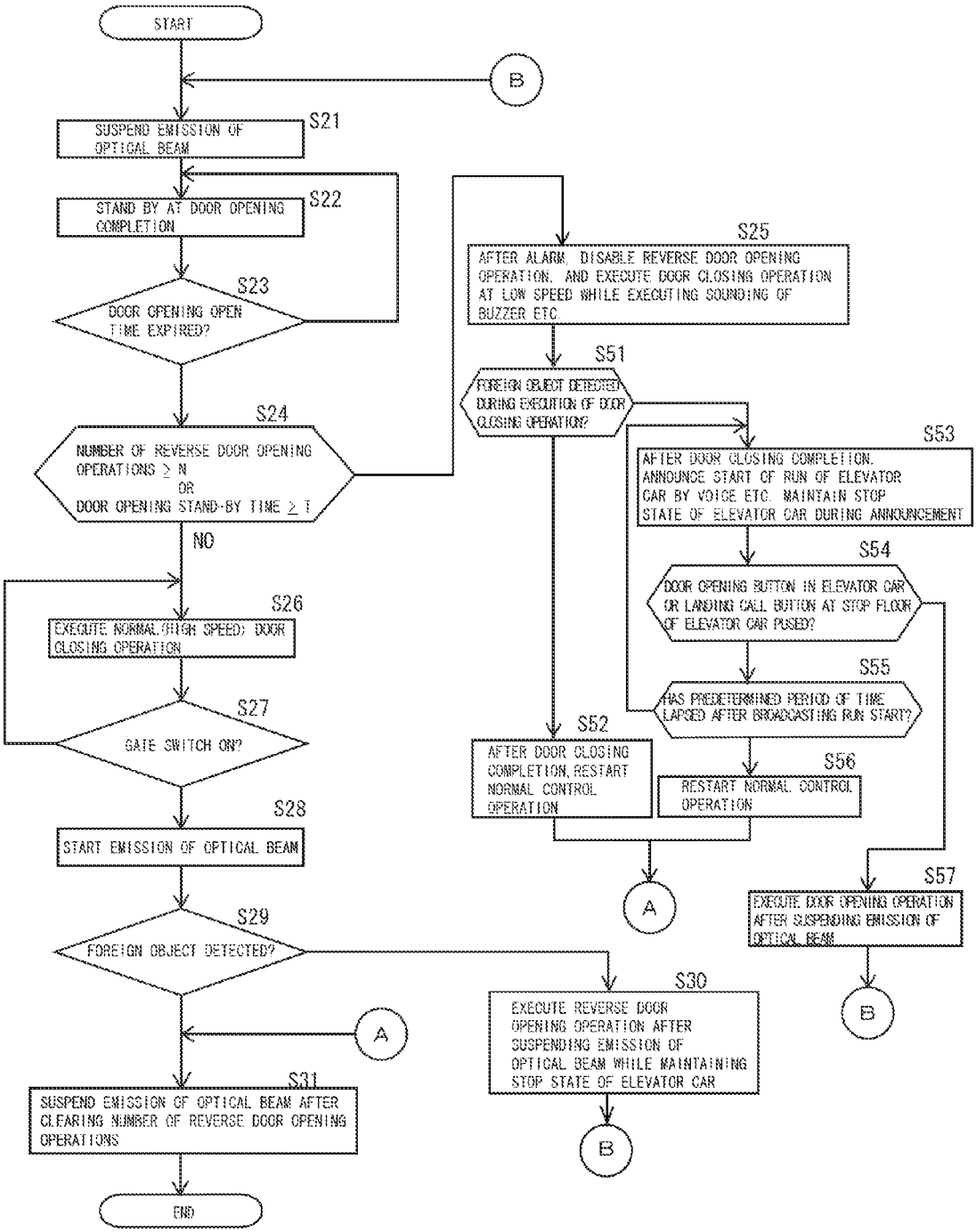
Figure 59:
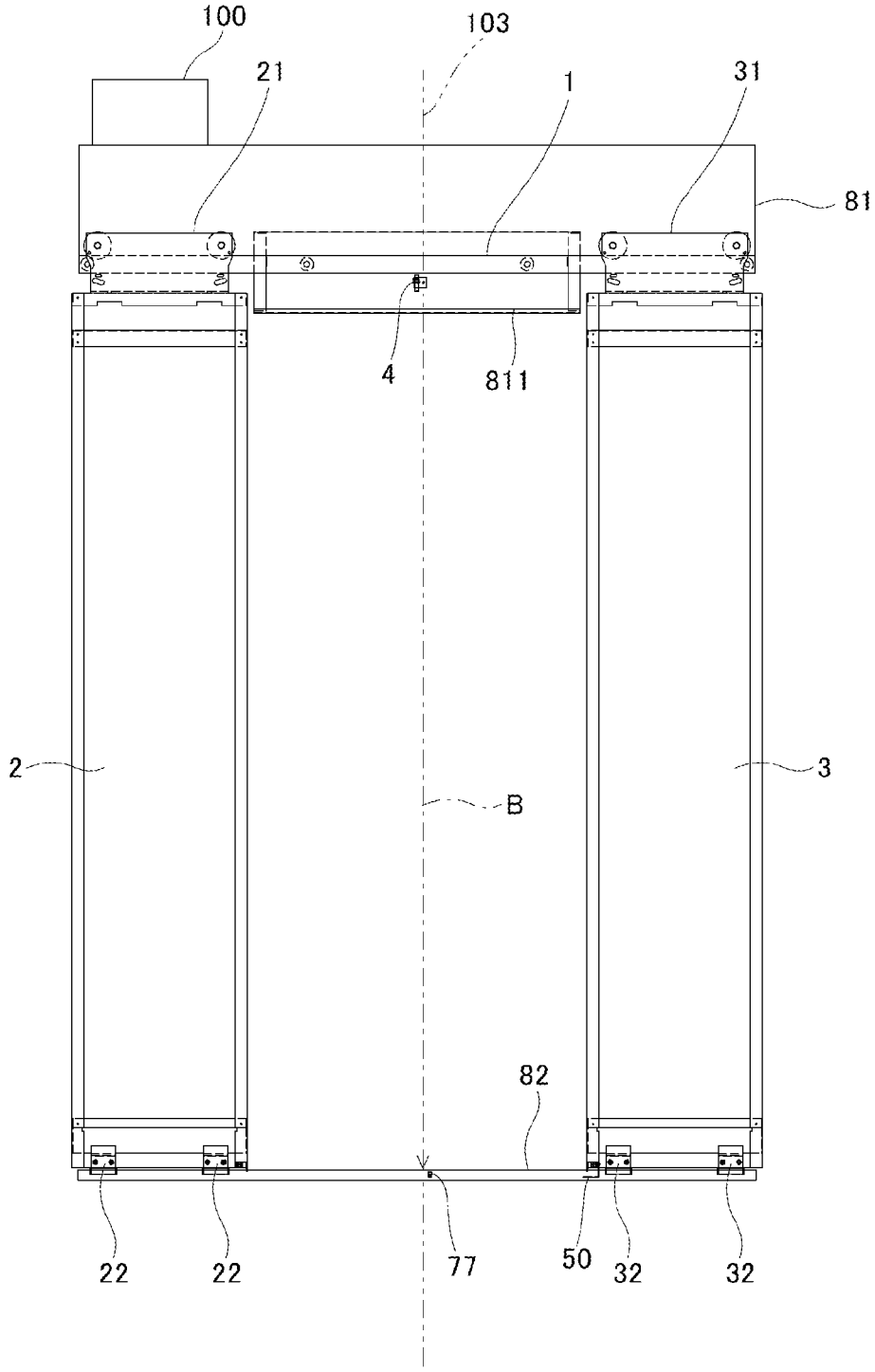
Figure 60:
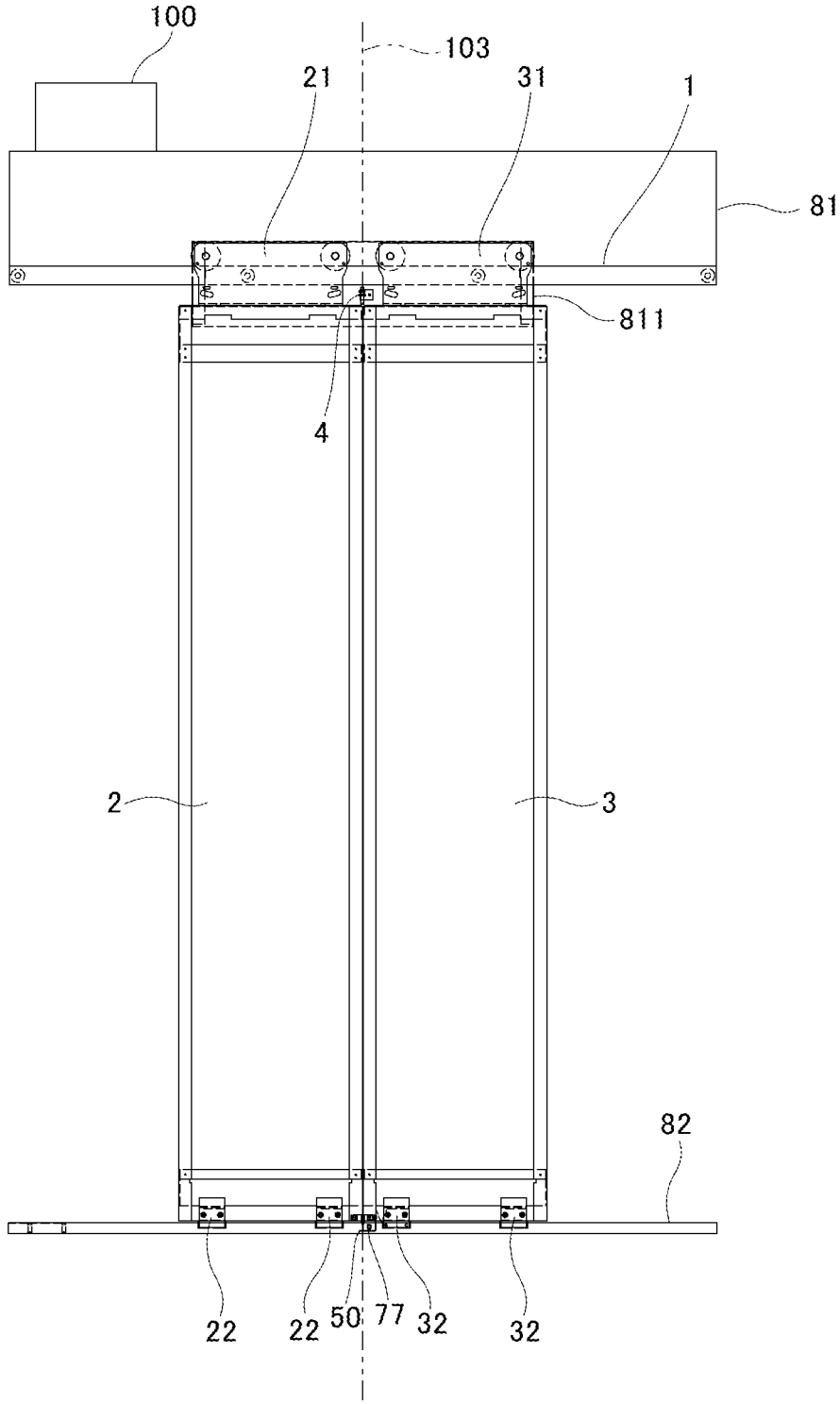
Figure 61:
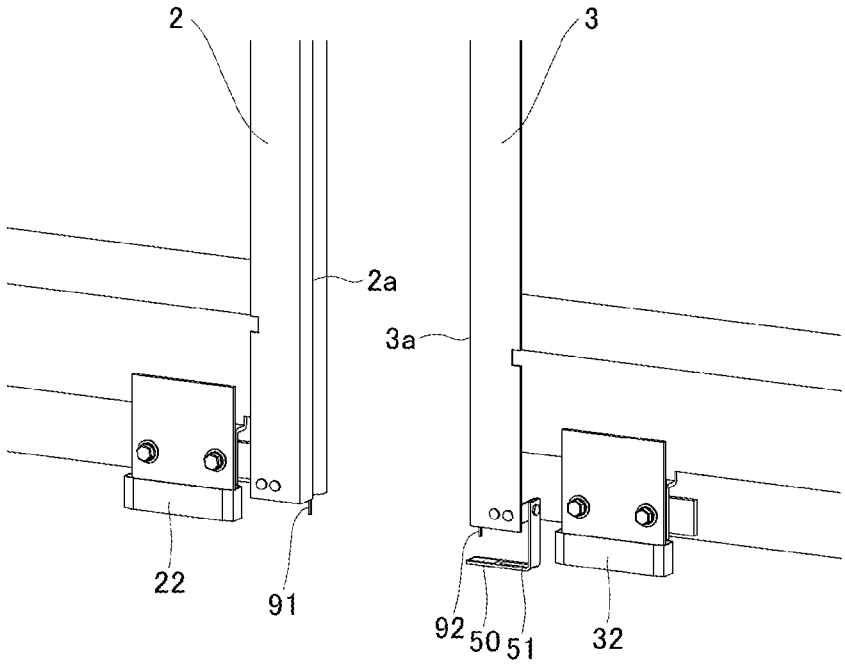
Figure 62:
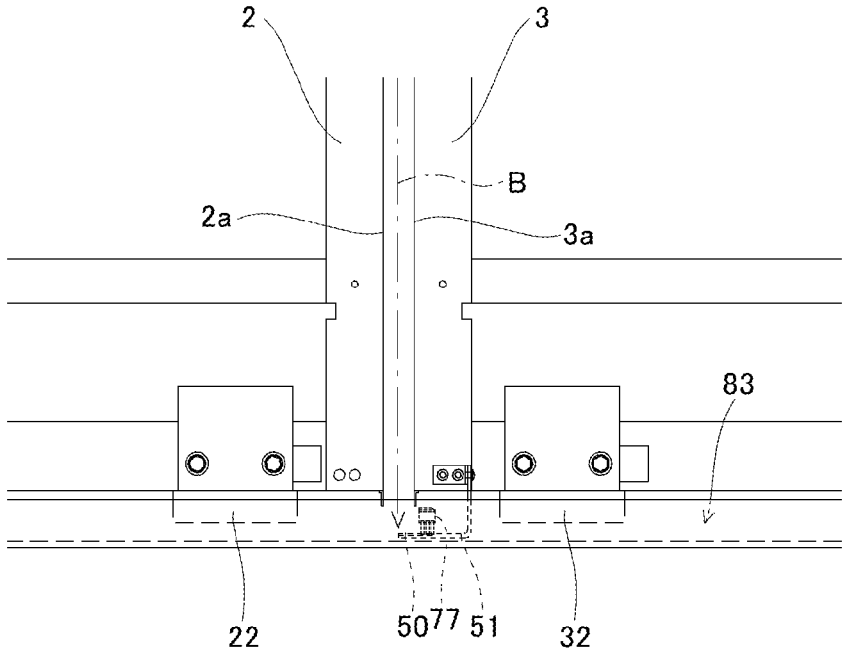
Figure 63:
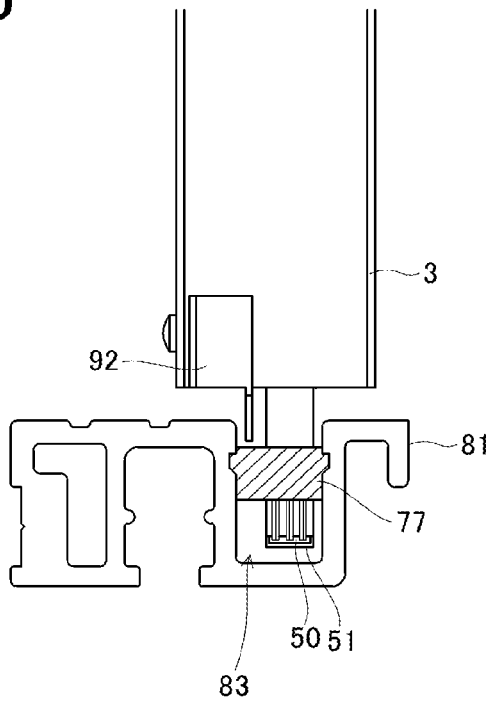
Figure 64:
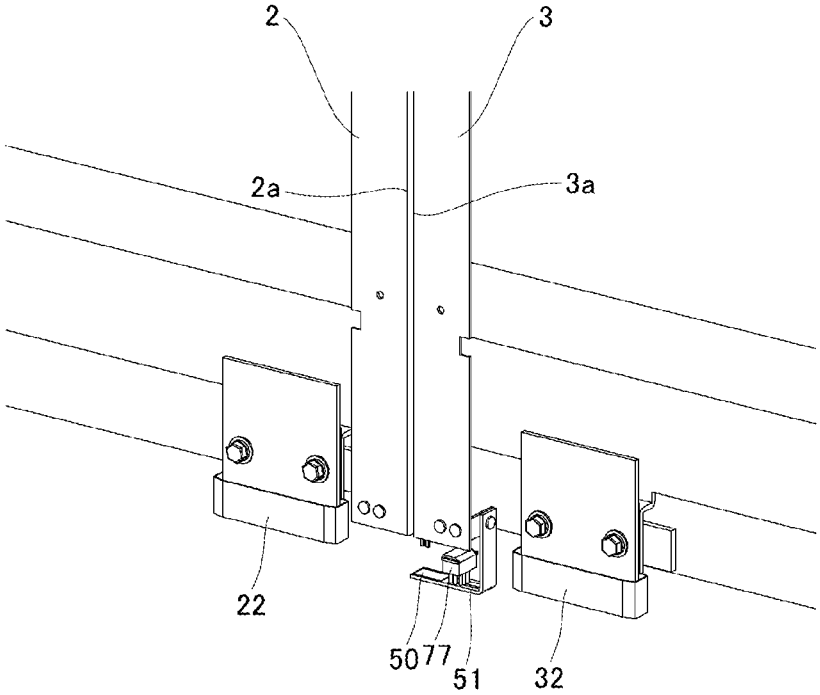
Figure 65:
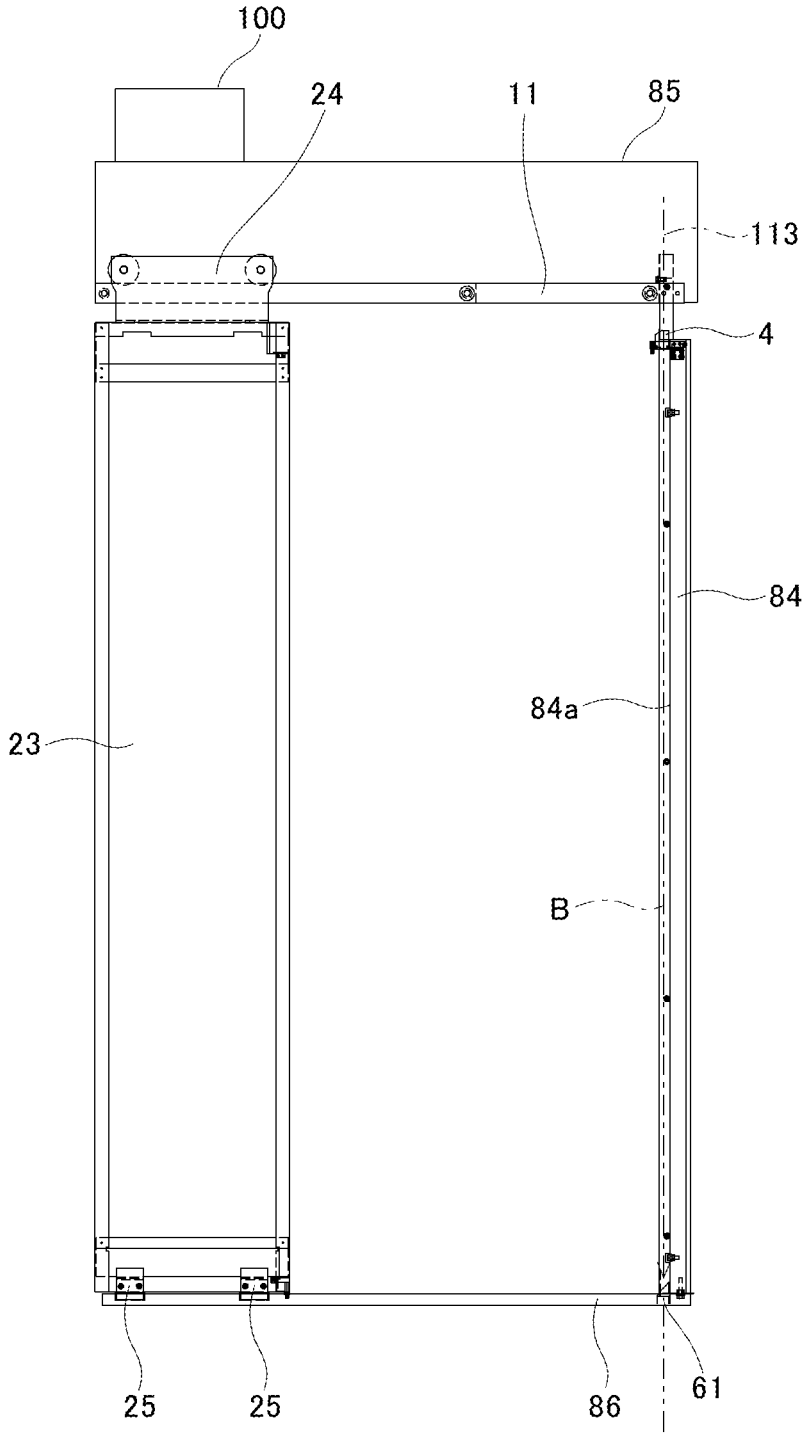
Figure 66:
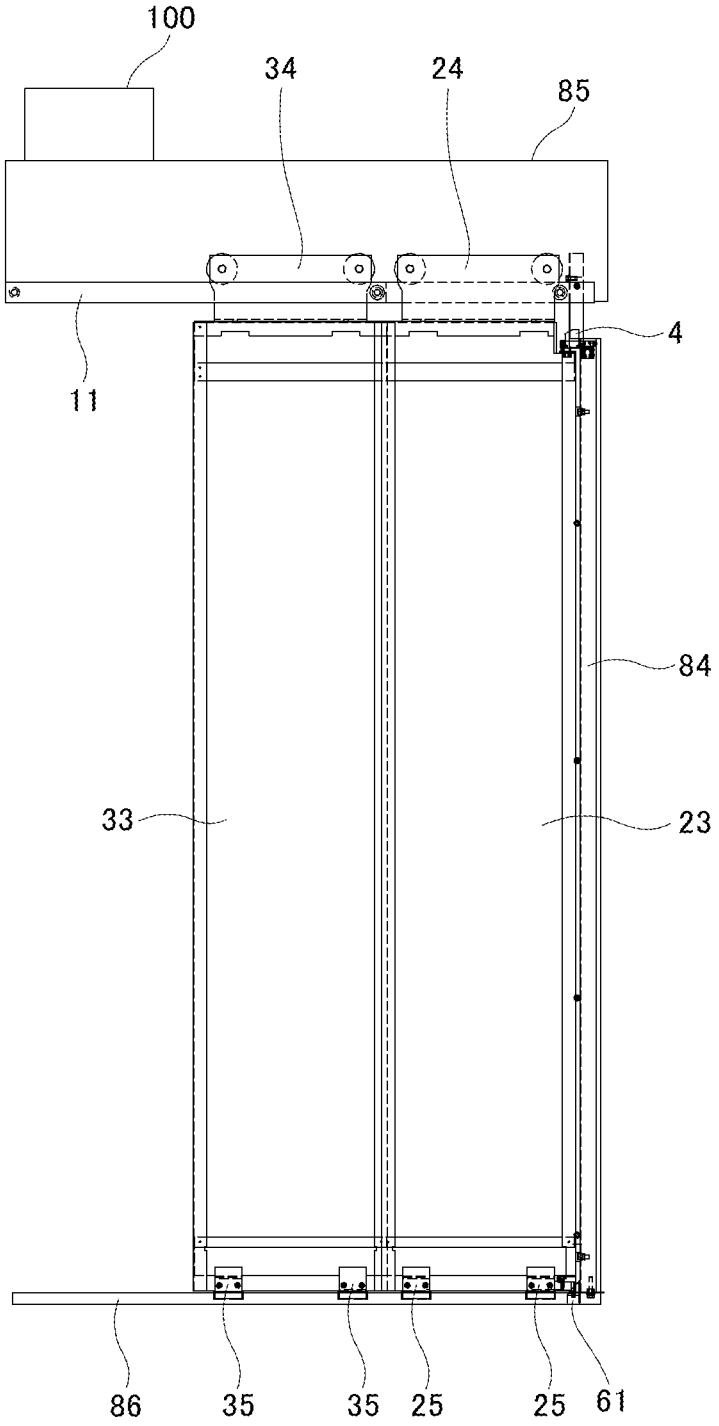
Figure 67:
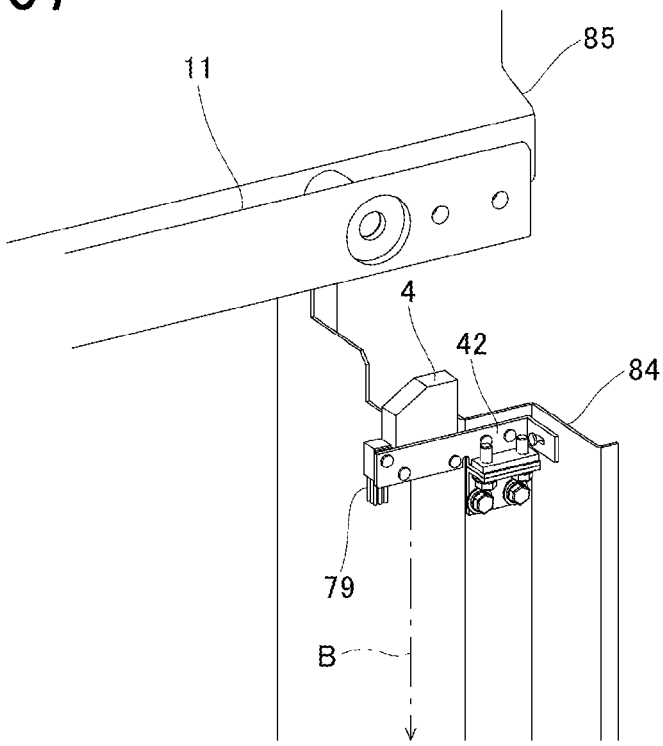
Figure 68:
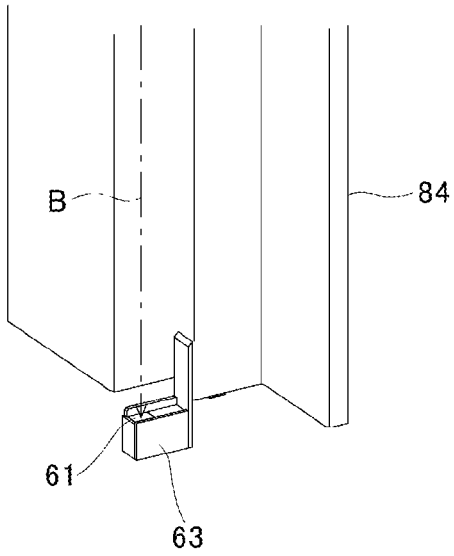
Figure 69:
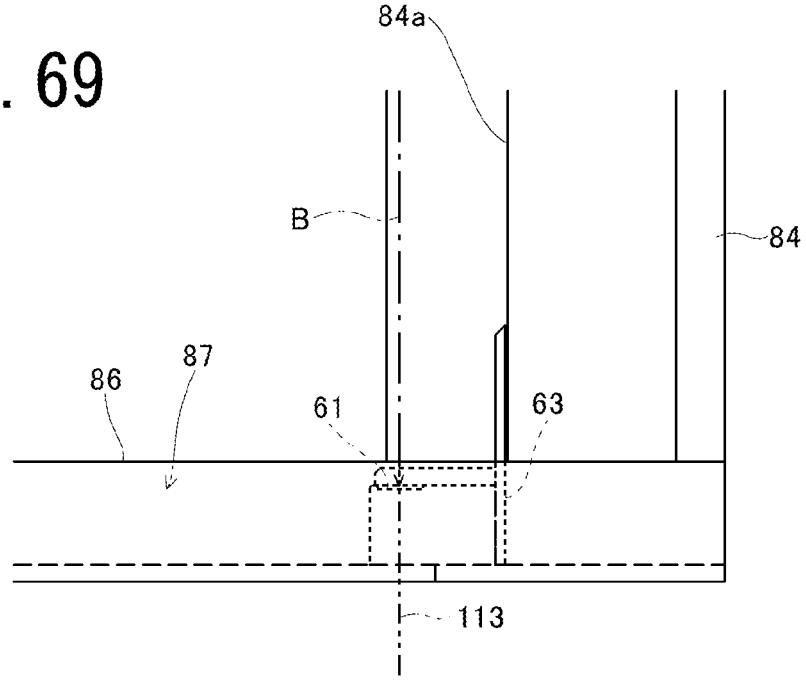
Figure 70:
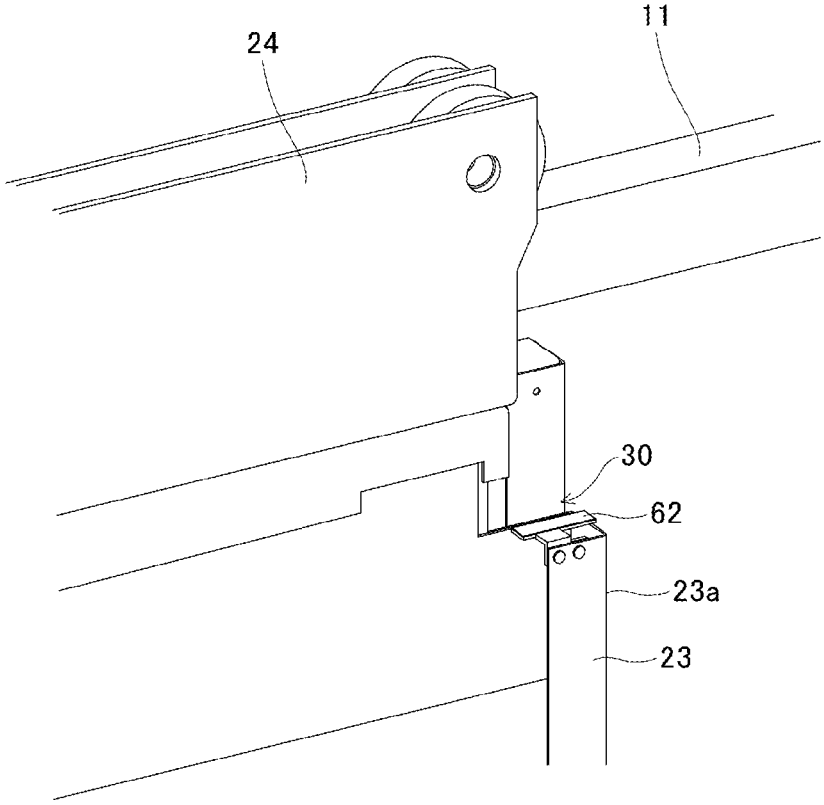
Figure 71:
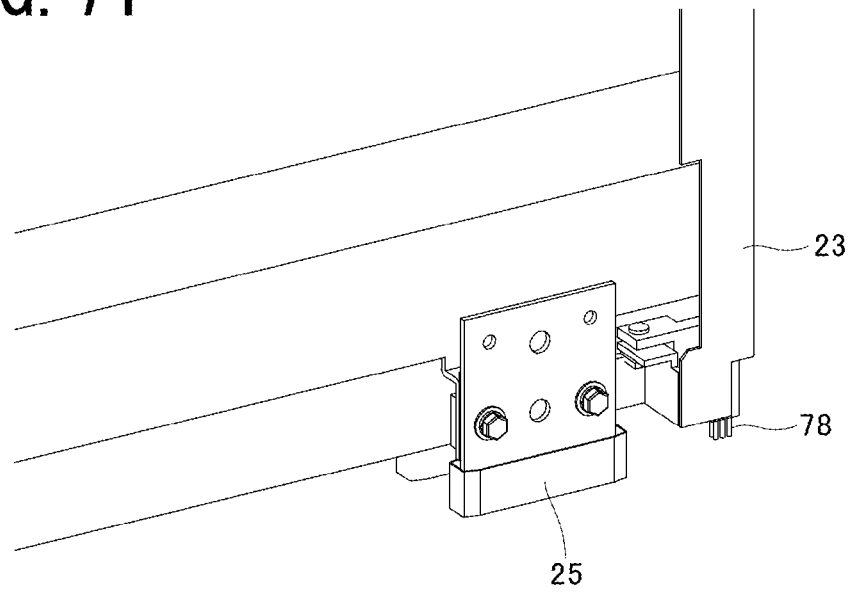
Figure 72:
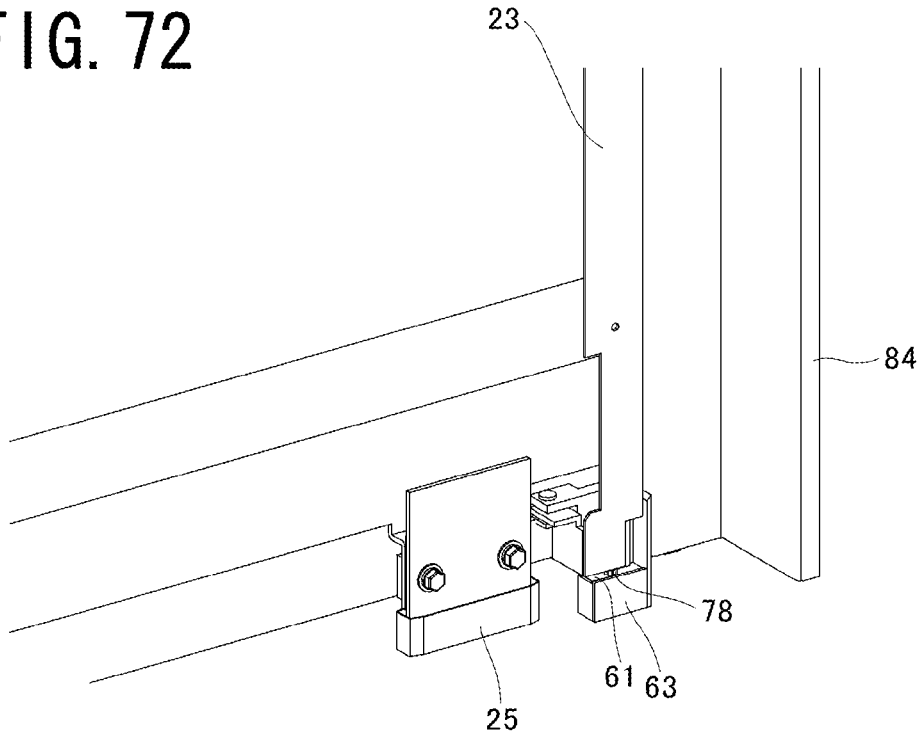
Figure 73A:
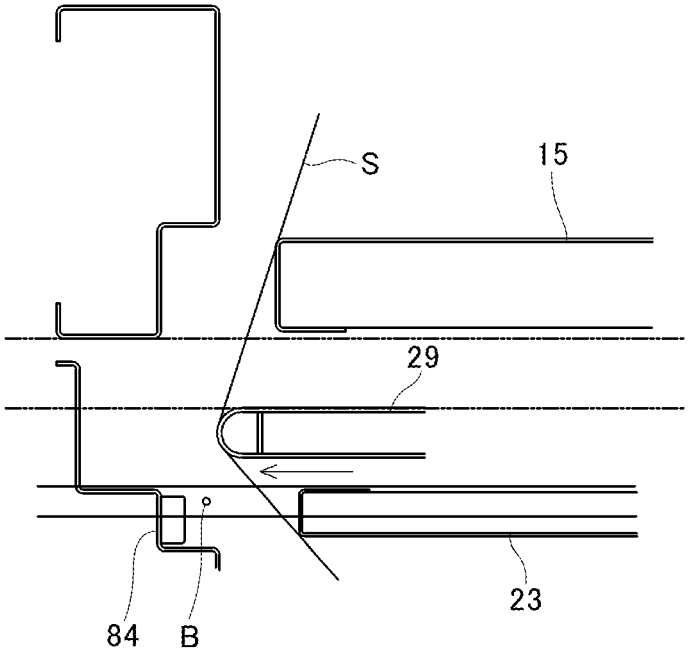
Figure 73B:
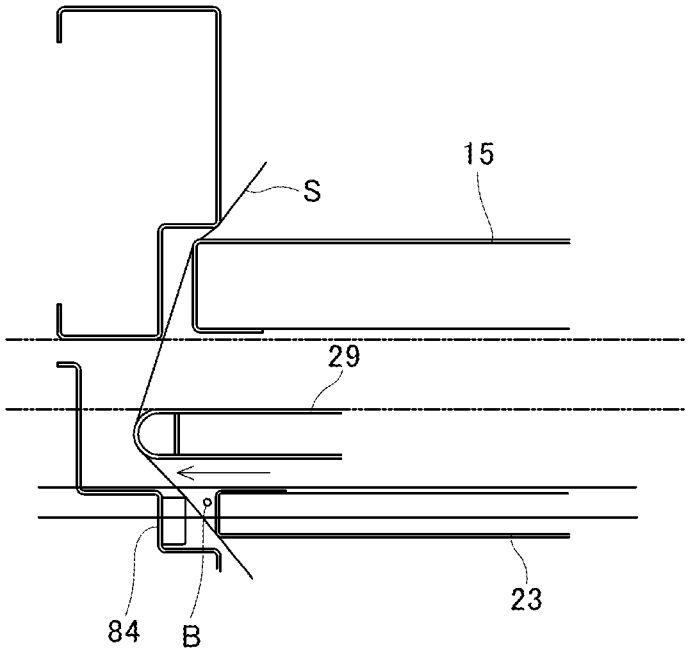
Figure 74A:
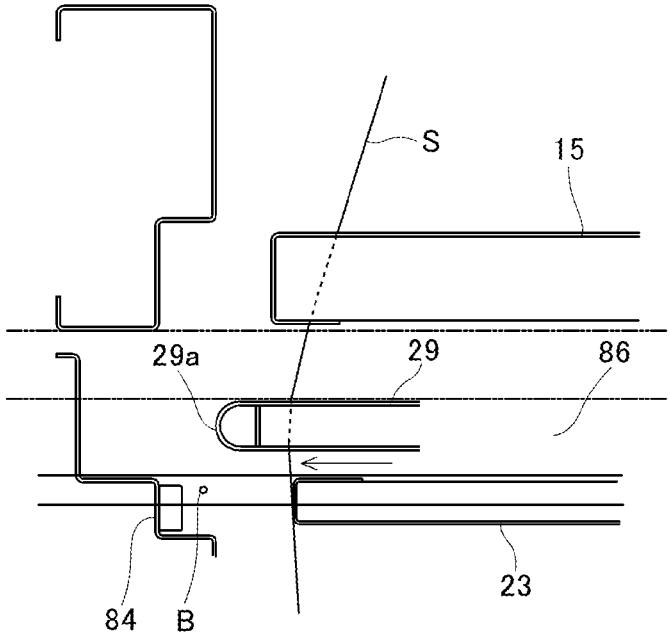
Figure 74B:
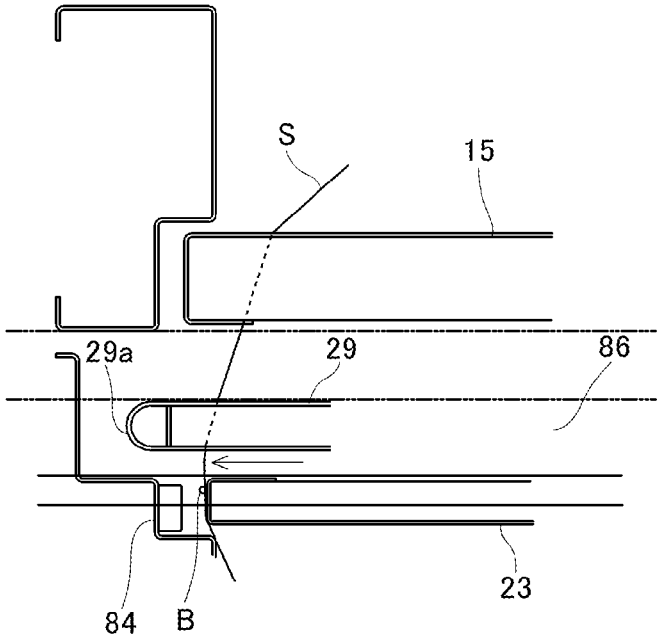
Figure 75:
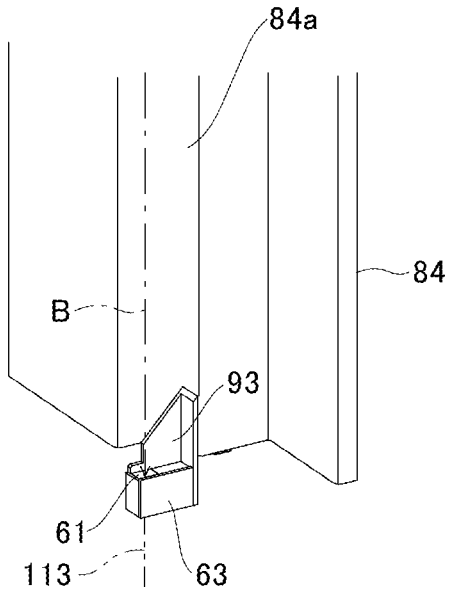
Figure 76:
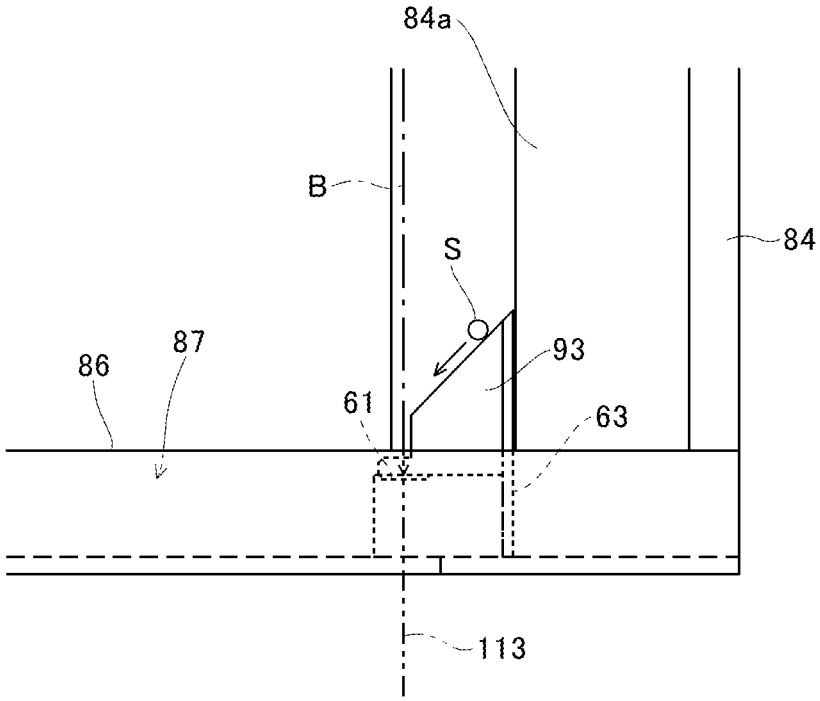
Figure 77A:
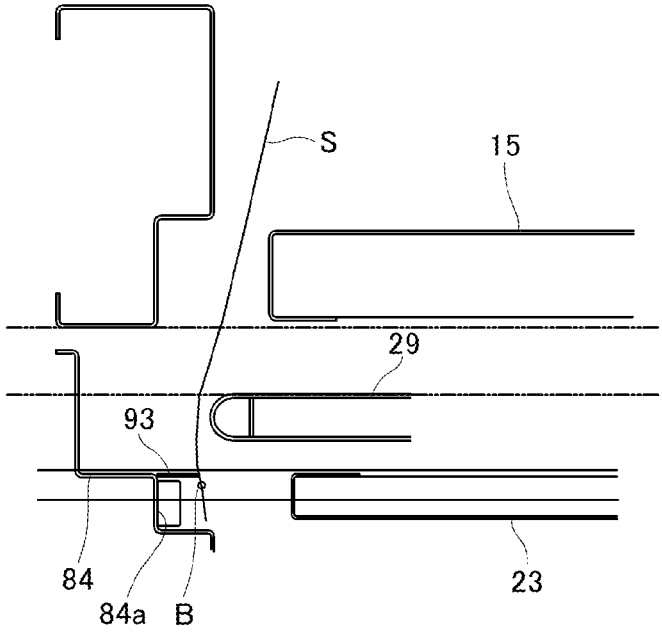
Figure 77B:
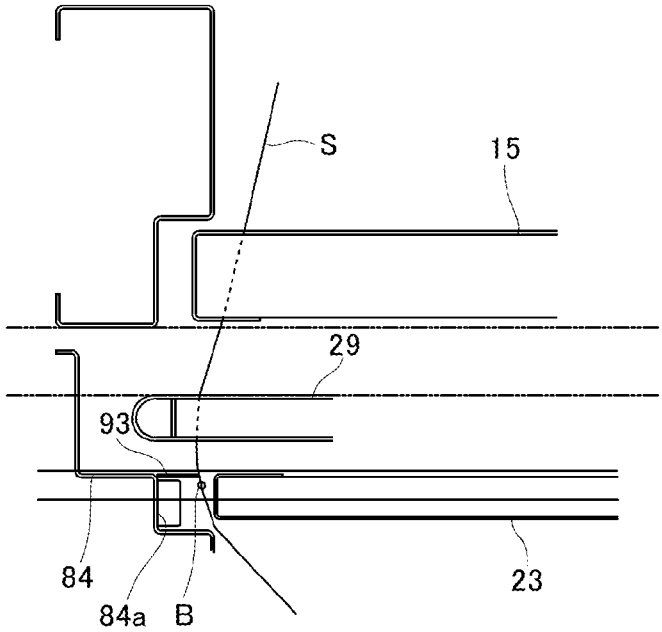
Figure 78A:
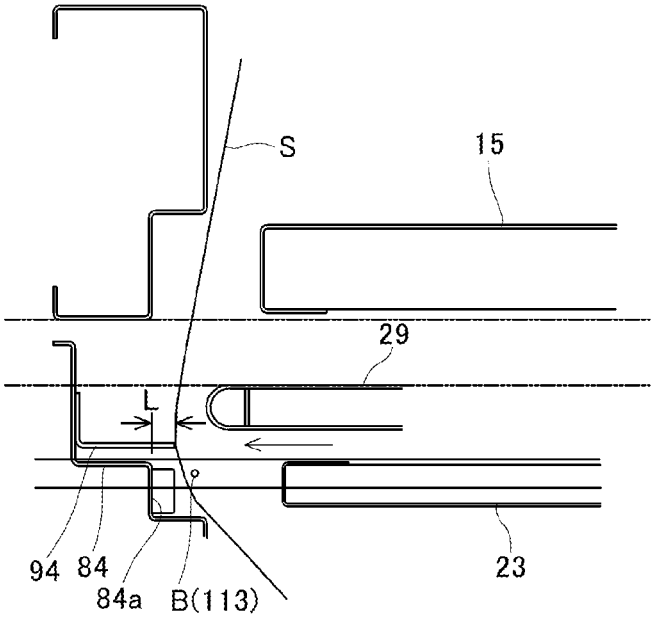
Figure 78B:
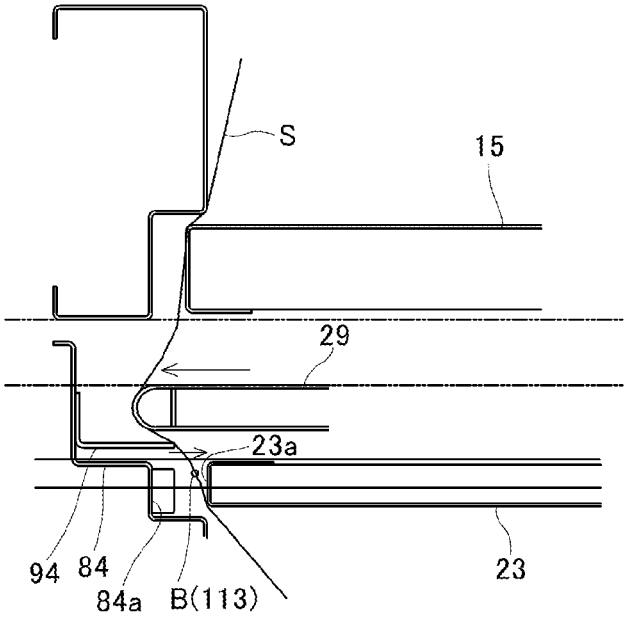
Figure 79A:
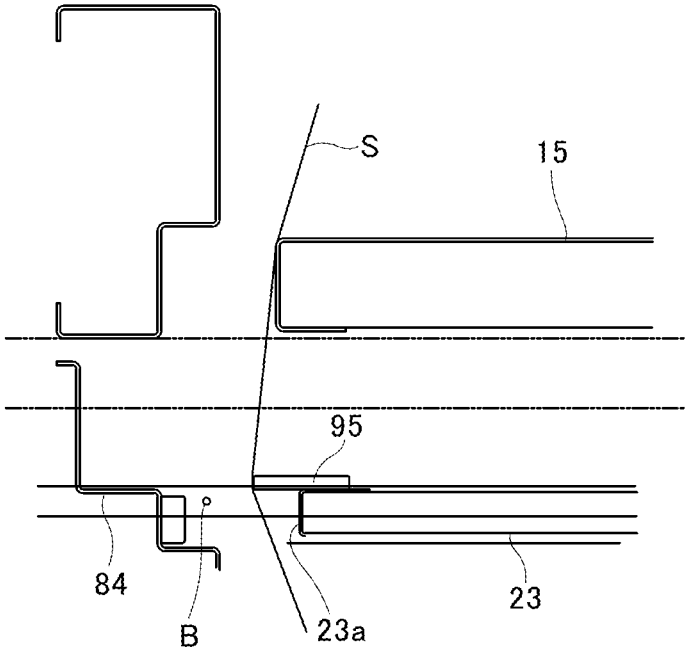
Figure 79B:
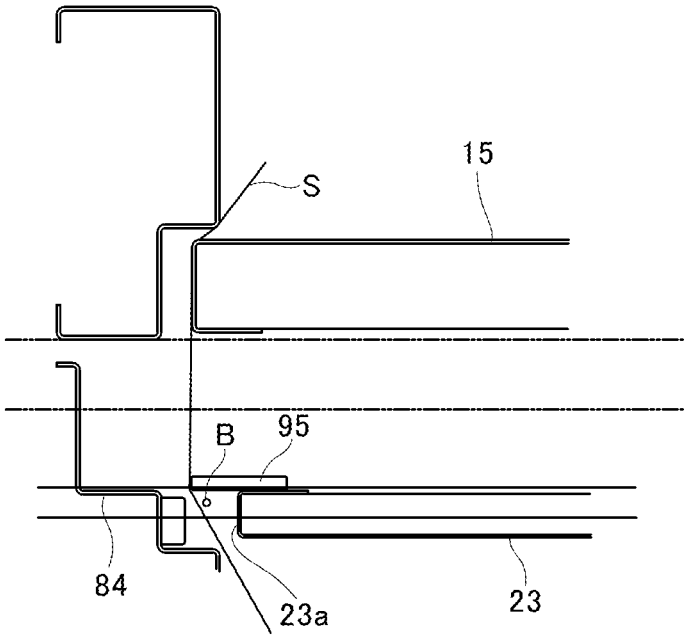
Figure 80:
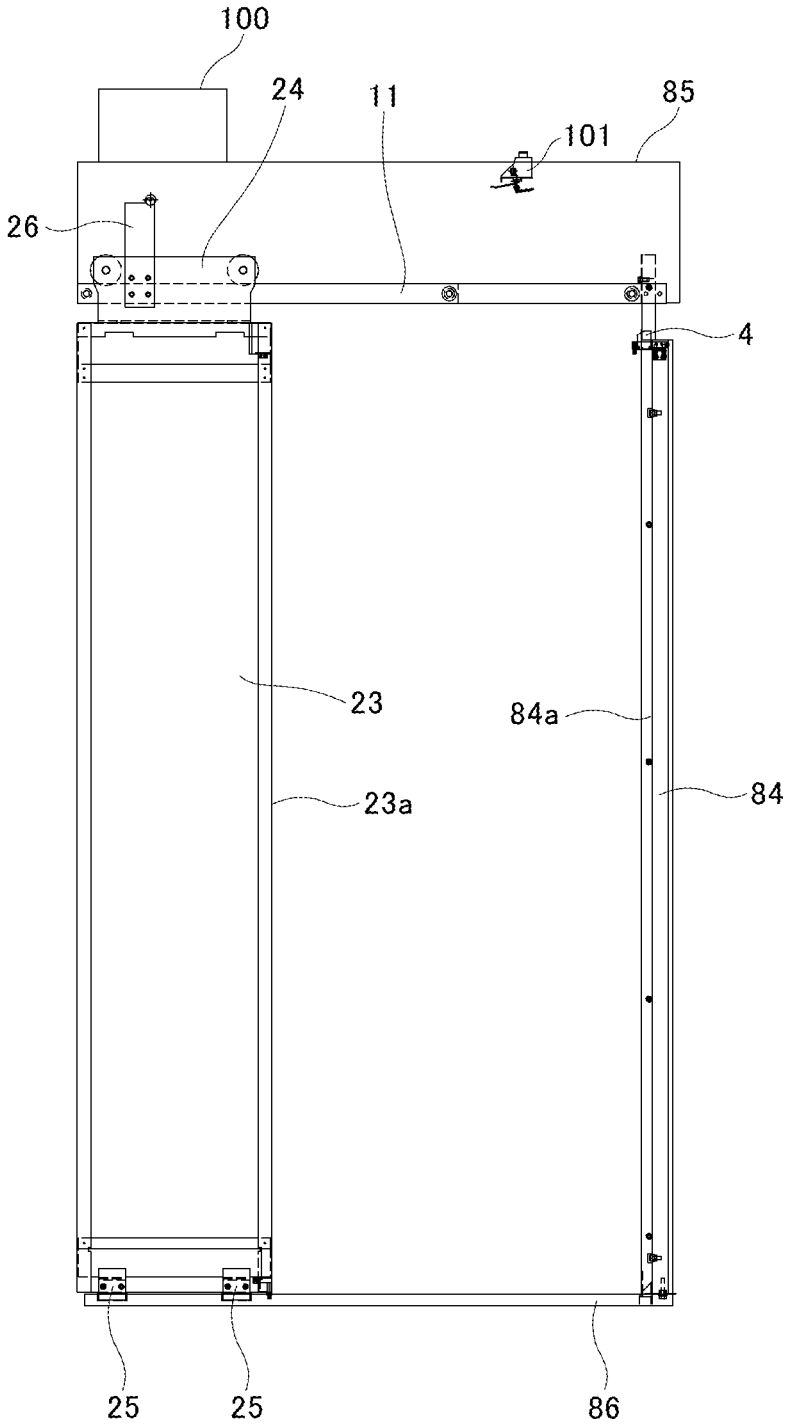
Figure 81:
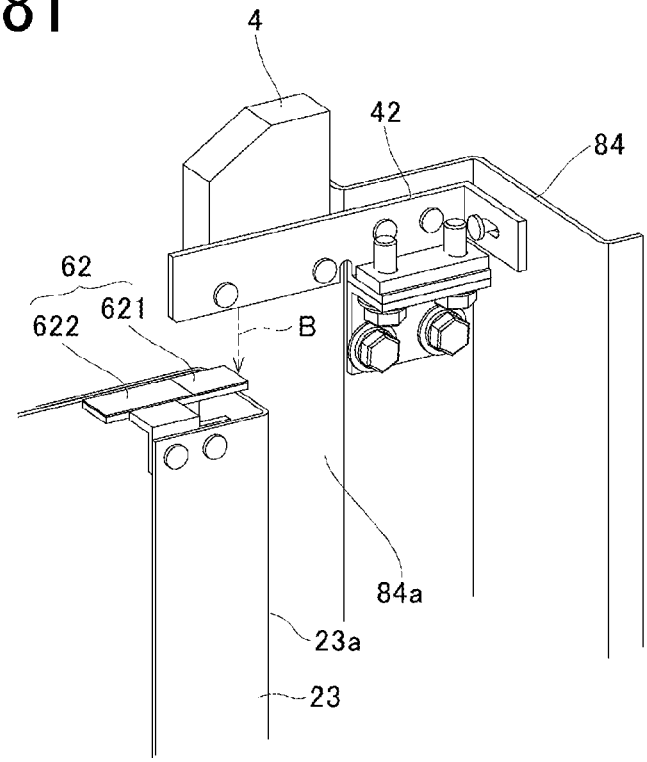
Figure 82:
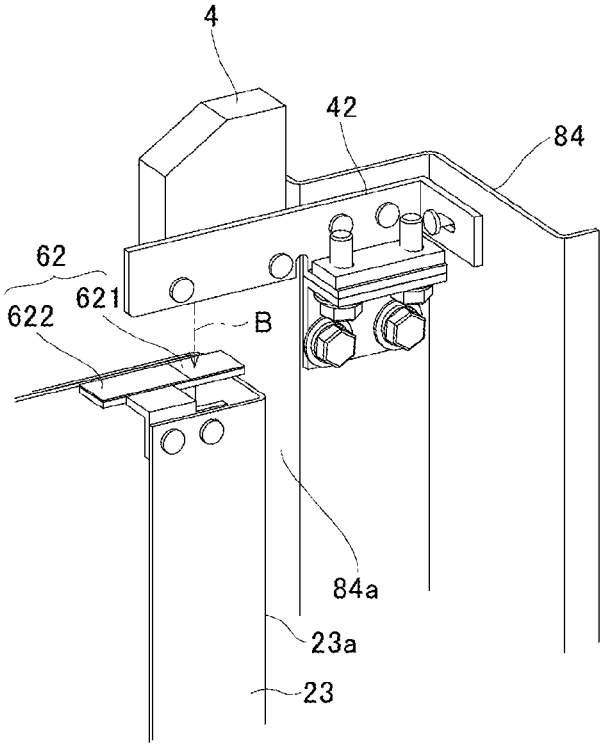
Figure 83:
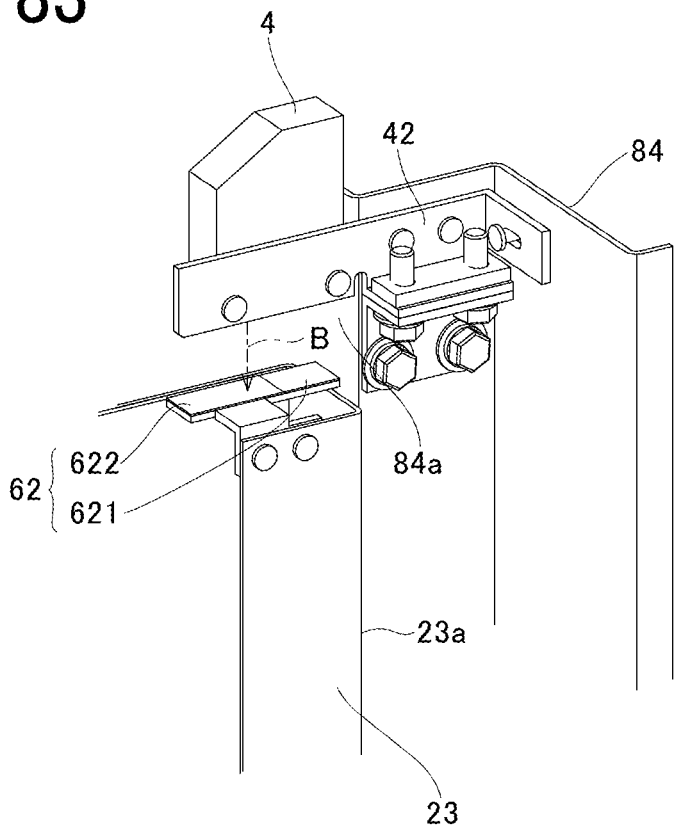
Figure 84:
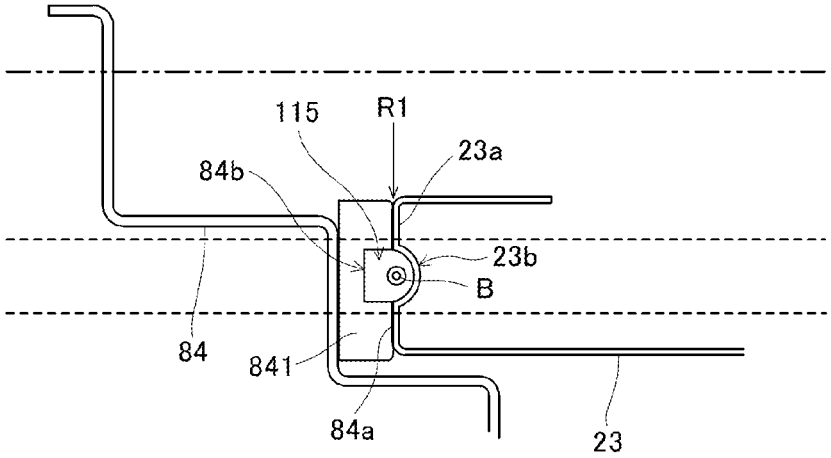
Figure 85:
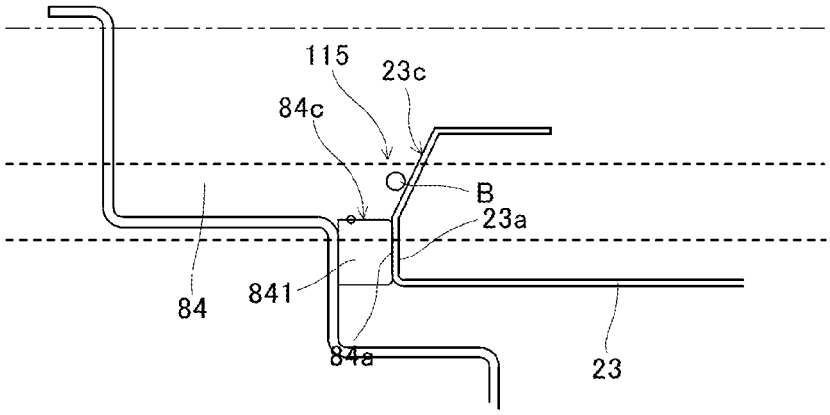
Figure 86:
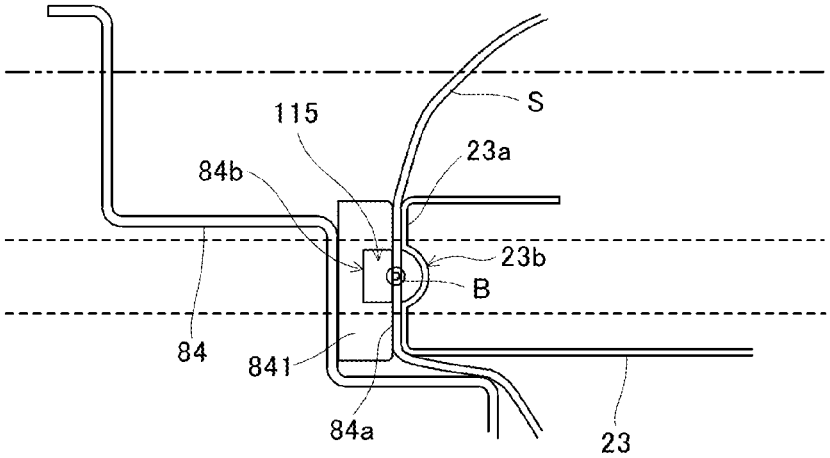
Figure 87:
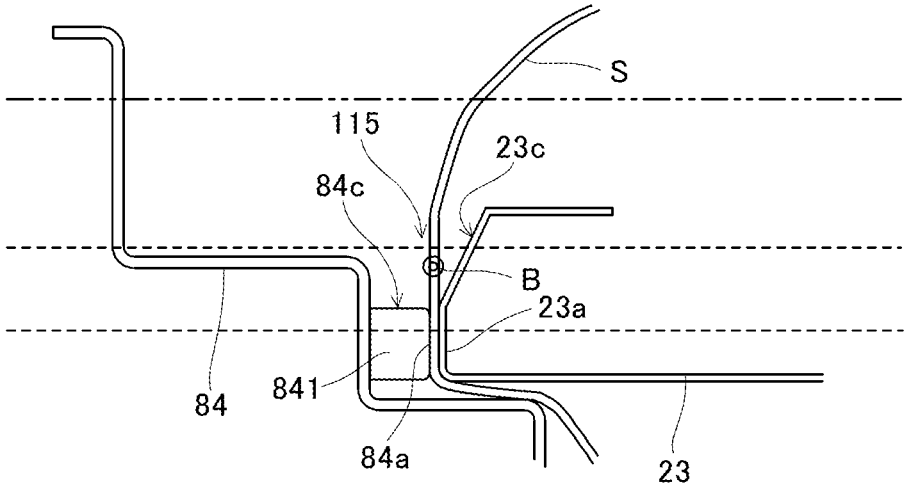

FIGS. 15 (*a*) through (*b*) are horizontal cross-sectional view illustrating an arrangement example of an optical beam when overtravel occurs;

FIGS. 16 (*a*) through (*b*) are horizontal cross-sectional view illustrating an arrangement example of an optical beam when overtravel does not occur;

FIGS. 17 (*a*) through (*b*) are front view illustrating a fully open state according to an embodiment that performs failure detection of a light-emitting/light-receiving unit and a diagram that is a partial enlargement of the front view;

FIGS. 18 (*a*) through (*b*) are front view illustrating a first almost-fully closed state according to the embodiment and a diagram that is a partial enlargement of the front view;

FIGS. 19 (*a*) through (*b*) are front view illustrating a state at a point in time where a gate switch is turned on according to the embodiment and a diagram that is a partial enlargement of the front view;

FIGS. 20 (*a*) through (*b*) are front view illustrating a second almost-fully closed state according to the embodiment and a diagram that is a partial enlargement of the front view;

FIG. 21 is a flow chart illustrating a control procedure of a control unit according to the embodiment;

FIGS. 22 (*a*) through (*c*) are series of horizontal cross-sectional views illustrating a first half of an example of a string detection operation;

FIGS. 23 (*a*) through (*c*) are series of horizontal cross-sectional views illustrating a second half of the example of a string detection operation;

FIGS. 24 (*a*) through (*c*) are series of horizontal cross-sectional views illustrating a first half of another example of a string detection operation;

FIGS. 25 (*a*) through (*c*) are series of horizontal cross-sectional views illustrating a second half of the example of a string detection operation;

FIGS. 26 (*a*) through (*c*) are series of horizontal cross-sectional views illustrating a first half of another example of a string detection operation;

FIGS. 27 (*a*) through (*c*) are series of horizontal cross-sectional views illustrating a second half of the example of a string detection operation;

FIGS. 28 (*a*) through (*b*) are series of horizontal cross-sectional views illustrating a first half of another example of a string detection operation;

FIGS. 29 (*a*) through (*b*) are is a series of horizontal cross-sectional views illustrating a second half of the example of a string detection operation;

FIGS. 30 (*a*) through (*c*) are series of horizontal cross-sectional views illustrating a first half of yet another example of a string detection operation;

FIGS. 31 (*a*) through (*c*) are series of horizontal cross-sectional views illustrating a second half of the example of a string detection operation;

FIG. 32 is a front view illustrating an example of an improved structure of an elevator according to the present invention;

FIG. 33 is a vertical cross-sectional view of the example;

FIG. 34 is a front view illustrating another example of an improved structure;

FIG. 35 is a horizontal cross-sectional view of the other example;

FIG. 36 is a front view illustrating another example of an improved structure;

FIG. 37 is a vertical cross-sectional view of the other example;

FIG. 38 is a horizontal cross-sectional view illustrating yet another example of an improved structure;

FIG. 39 is a perspective view illustrating a mounted state of a cleaning tool that is to clean a second reflecting member;

FIG. 40 is a diagram for describing a configuration example for preventing damage to a first reflecting member;

FIG. 41 is a diagram for describing another configuration example for preventing damage to the first reflecting member;

FIG. 42 is a perspective view for describing yet another configuration example for preventing damage to the first reflecting member;

FIG. 43 is a front view illustrating a fully open state of a third elevator according to an embodiment of the present invention;

FIG. 44 is a front view illustrating a fully closed state of the elevator;

FIG. 45 is a perspective view illustrating a mounted state of a light-emitting/light-receiving unit in the elevator;

FIG. 46 is a front view illustrating a mounted state of a light-emitting/light-receiving unit in the elevator;

FIG. 47 is a perspective view of a mounted state of a reflecting member and a cleaning mechanism in the elevator as seen from above;

FIG. 48 is a front view illustrating a mounted state of a reflecting member and a cleaning mechanism in the elevator;

FIG. 49 is a perspective view of a mounted state of a reflecting member and a cleaning mechanism in the elevator as seen from below;

FIG. 50 is a perspective view illustrating an operation state of the cleaning mechanism in a fully closed state;

FIG. 51 is a horizontal cross-sectional view illustrating shapes of end faces in a closing direction of both car doors in the elevator;

FIG. 52 is a horizontal cross-sectional view illustrating other shapes of end faces in a closing direction of both car doors in the elevator;

FIG. 53 is a front view illustrating a mounted state of a foreign object penetration preventing member in the elevator;

FIG. 54 is an enlarged view of the foreign object penetration preventing member;

FIG. 55 is a perspective view of a mounted state of the foreign object penetration preventing member in the elevator as seen from below;

FIG. 56 is a horizontal cross-sectional view illustrating an example of a string detection operation;

FIG. 57 is a horizontal cross-sectional view illustrating another example of a string detection operation;

FIG. 58 is a flow chart illustrating a control procedure of a control unit in the elevator;

FIG. 59 is a front view illustrating a fully open state of a fourth elevator according to an embodiment of the present invention;

FIG. 60 is a front view illustrating a fully closed state of the elevator;

FIG. 61 is a perspective view illustrating a mounted state of a reflecting member in the elevator;

FIG. 62 is a front view illustrating a mounted state of the reflecting member and a cleaning tool in the elevator;

FIG. 63 is a vertical cross-sectional view illustrating a mounted state of the cleaning tool in the elevator;

FIG. 64 is a perspective view illustrating a positional relationship between the reflecting member and the cleaning tool in a fully closed state;

FIG. 65 is a front view illustrating a fully open state of a fifth elevator according to an embodiment of the present invention;

FIG. 66 is a front view illustrating a fully closed state of the elevator;

FIG. 67 is a perspective view illustrating a mounted state of a light-emitting/light-receiving unit in the elevator;

FIG. 68 is a perspective view illustrating a mounted state of a first reflecting member in the elevator;

FIG. 69 is a front view illustrating a mounted state of the first reflecting member in the elevator;

FIG. 70 is a perspective view illustrating a mounted state of a second reflecting member in the elevator;

FIG. 71 is a perspective view illustrating a mounted state of a cleaning tool in the elevator;

FIG. 72 is a perspective view illustrating a positional relationship between the first reflecting member and the cleaning tool in a fully closed state;

FIGS. 73 (*a*) through (*b*) are series of horizontal cross-sectional views illustrating an example of a string detection operation;

FIGS. 74 (*a*) through (*b*) are series of horizontal cross-sectional views illustrating another example of a string detection operation;

FIG. 75 is a perspective view illustrating an example of an improved structure of the elevator;

FIG. 76 is a front view of the example;

FIGS. 77 (*a*) through (*b*) are series of horizontal cross-sectional views illustrating a string detection operation of the elevator of the example;

FIGS. 78 (*a*) through (*b*) are series of horizontal cross-sectional views illustrating another example of an improved structure of the elevator and a string detection operation of the elevator of the other example;

FIGS. 79 (*a*) through (*b*) are series of horizontal cross-sectional views illustrating yet another example of an improved structure of the elevator and a string detection operation of the elevator of the other example;

FIG. 80 is a front view illustrating a fully open state according to an embodiment that performs failure detection of a light-emitting/light-receiving unit;

FIG. 81 is a perspective view illustrating a first almost-fully closed state according to the embodiment;

FIG. 82 is a perspective view illustrating a state at a point in time where a gate switch is turned on according to the embodiment;

FIG. 83 is a perspective view illustrating a second almost-fully closed state according to the embodiment;

FIG. 84 is a horizontal cross-sectional view illustrating an example of a substantial part of a sixth elevator according to an embodiment of the present invention;

FIG. 85 is a horizontal cross-sectional view illustrating another example of a substantial part of the elevator;

FIG. 86 is a horizontal cross-sectional view illustrating an example of a string detection operation; and FIG. 87 is a horizontal cross-sectional view illustrating another example of a string detection operation.

BEST MODE FOR CARRYING OUT THE INVENTION

Hereinafter, embodiments of the present invention will be described in detail with reference to the drawings.

First Embodiment

Figure 1:
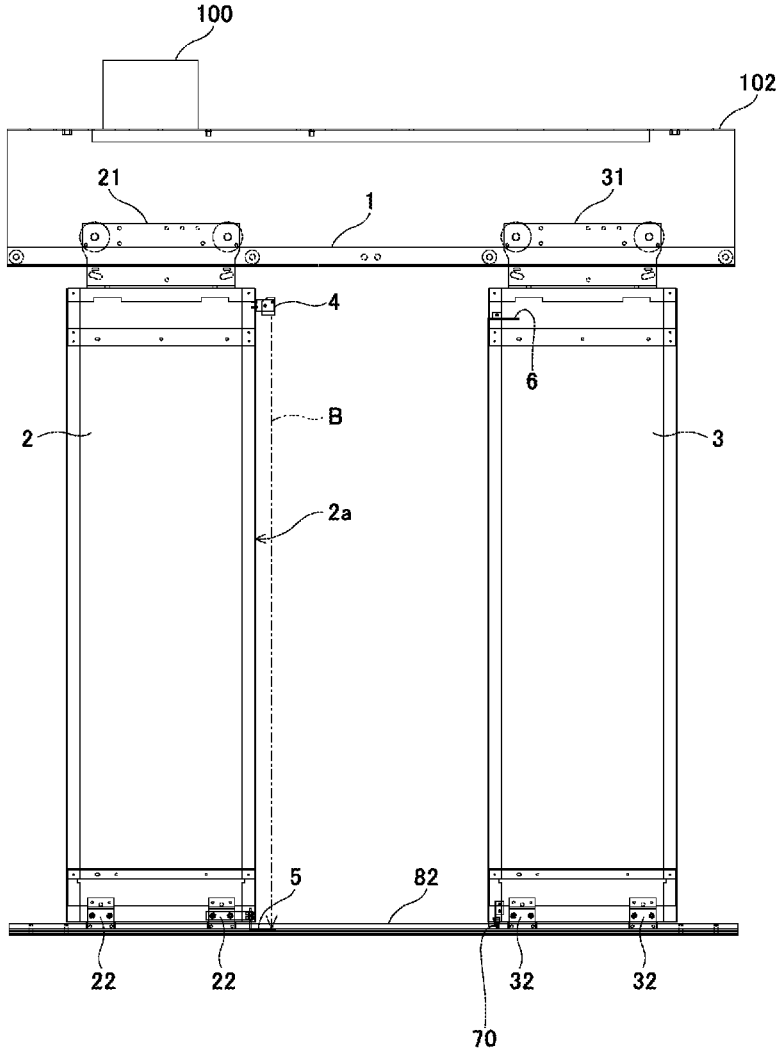
FIG. 1 is a front view illustrating a fully open state of a first elevator according to an embodiment of the present invention.
Figure 2:
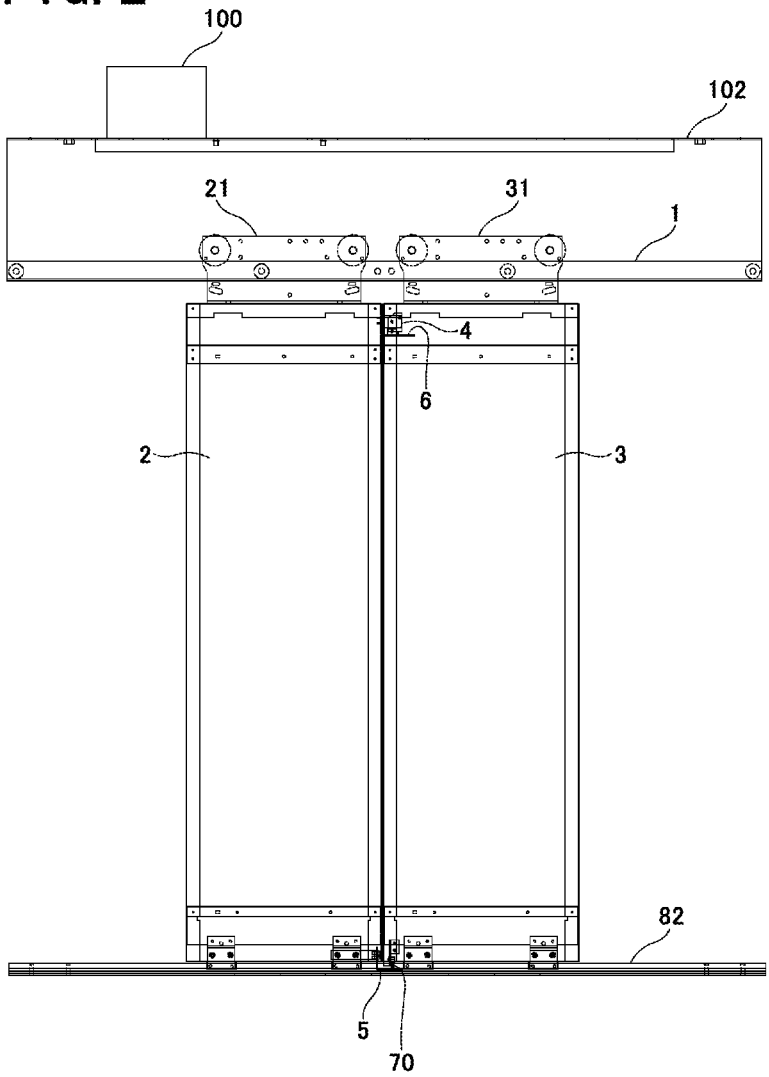
FIG. 2 is a front view illustrating a fully closed state of the elevator.

As illustrated in FIGS. 1 and 2, a first elevator according to an embodiment of the present invention is a center-open type elevator including a pair of left and right car doors (2) and (3) that open/close an entrance of an elevator car, wherein a rail (1) is fixed to a frame (102) above the entrance, and both car doors (2) and (3) are respectively suspended from the rail (1) by hangers (21) and (31) and guided so as to reciprocate in a horizontal direction by guide shoes (22) and (32) which are protrudingly provided at lower end portions of the doors and which are fit into a threshold (82) so as to be slidable.

In addition, a control unit (100) that controls opening/closing operations of both car doors (2) and (3) is installed on the frame (102).

As illustrated in FIG. 1, on the left-side car door (2), a light-emitting/light-receiving unit (4) is disposed facing vertically downward at an upper end position of a vertical line separated by a predetermined distance (for example, 12 mm) from an end face in a closing direction (2*a*), which is to abut the right-side car door (3), toward the side of the right-side car door (3), and a first reflecting member (5) is disposed facing vertically upward at a lower end position of the vertical line.

Figure 3:
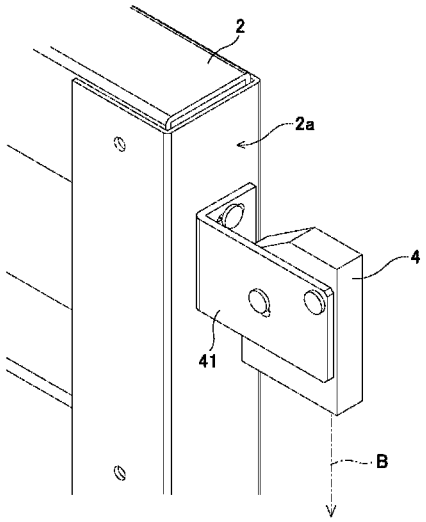
FIG. 3 is a perspective view illustrating a mounted state of a light-emitting/light-receiving unit in the elevator.

The light-emitting/light-receiving unit (4) integrally includes a light emitter that is to output a beam of laser light (hereinafter referred to as an optical beam) B and a light receiver that is to detect an incident optical beam B, and is supported by a stay (41) fixed to the end face in a closing direction (2*a*) of the car door (2) as illustrated in FIG. 3.

Moreover, for example, a red semiconductor laser is used as the light emitter of the light-emitting/light-receiving unit (4) so as to form a spot having a diameter of 1 to 2 mm. The light receiver of the light-emitting/light-receiving unit (4) outputs a light detection signal when an amount of light received from an incident optical beam exceeds a predetermined threshold. In contrast, when the amount of light received by an incident optical beam falls under the predetermined threshold, a foreign object detection signal is outputted.

Figure 4:
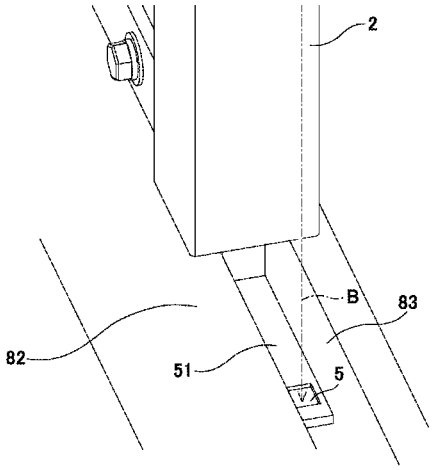
FIG. 4 is a perspective view illustrating a mounted state of a first reflecting member in the elevator.

As illustrated in FIG. 4, the first reflecting member (5) is provided on a horizontal arm portion of an L-shaped arm member (51) protrudingly provided on a lower end face of the left-side car door (2) and includes a reflecting surface that reflects the optical beam B vertically upward. The arm member (51) is housed so as to be reciprocatable inside a groove (83) of the threshold (82) into which the guide shoe of the car door (2) fits.

Figure 8:
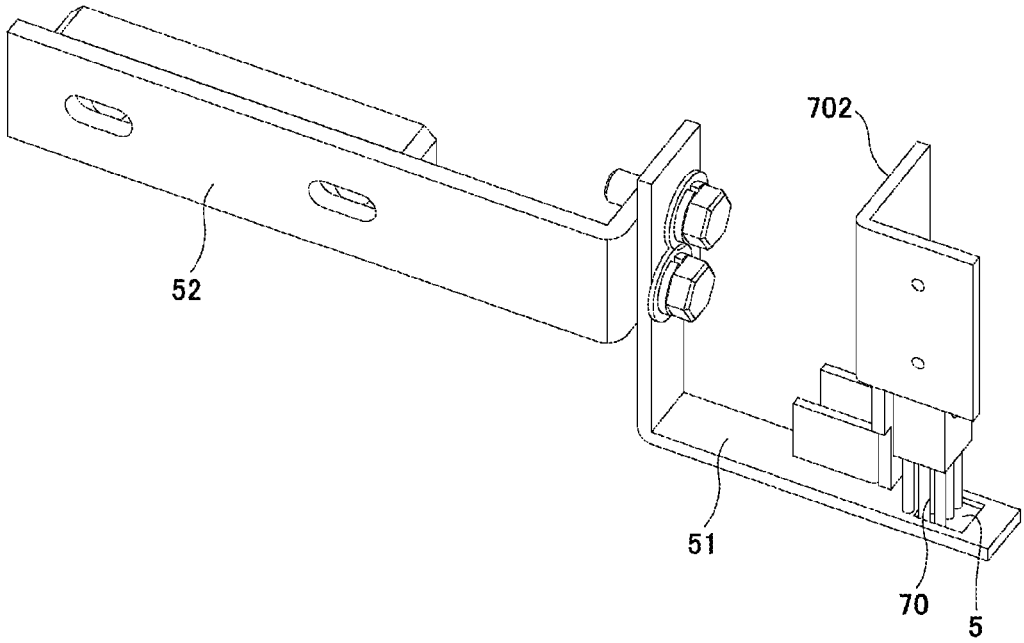
FIG. 8 is a perspective view illustrating a positional relationship between the first reflecting member and the cleaning tool in the elevator.

Moreover, the arm member (51) is supported by the left-side car door (2) via a stay (52) illustrated in FIG. 8. The stay (52) is mounted on the car door (2) such that a position in a door opening/closing direction is adjustable, and the arm member (51) is mounted on the stay (52) such that a position in a front-back direction that is perpendicular to the door opening/closing direction is adjustable.

Figure 5:
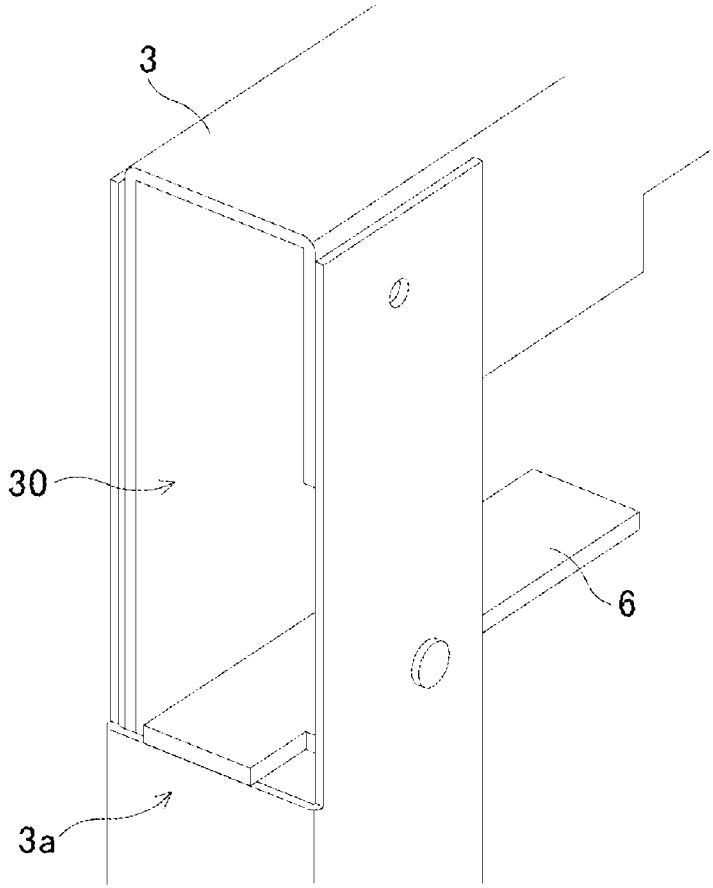
FIG. 5 is a perspective view illustrating a mounted state of a second reflecting member in the elevator.

As illustrated in FIG. 5, a housing space (30) that is to house the light-emitting/light-receiving unit in a state where both car doors are closed is formed on an upper end portion of the right-side car door (3), and a second reflecting member (6)

is disposed facing vertically upward on a bottom portion of the housing space (30). The second reflecting member (6) has a reflecting surface of a predetermined length (for example, 8 mm) that extends from the same position as an end face in a closing direction (3*a*) of the right-side car door (3) toward the back of the housing space (30), and reflects, vertically upward, an optical beam from the light-emitting/light-receiving unit that penetrates into the housing space (30).

Figure 6:
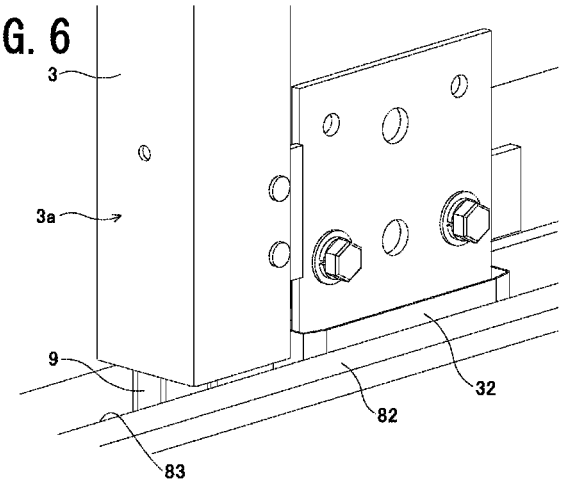
FIG. 6 is a perspective view illustrating a mounted state of a foreign object penetration preventing member in the elevator.

As illustrated in FIG. 6, a foreign object penetration preventing member (9) that fills up a gap formed between the end face in a closing direction (3*a*) of the right-side car door (3) and a surface of the threshold (82) is protrudingly provided facing downward at a lower end portion of the car door (3), and a lower end portion of the foreign object penetration preventing member (9) is housed in the groove (83) of the threshold (82) so as to be reciprocatable.

Figure 7:
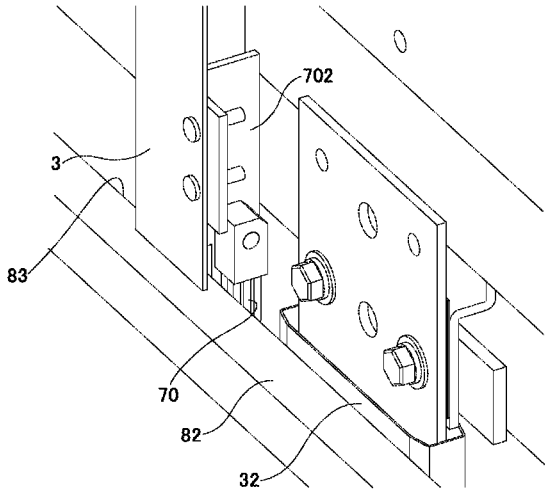
FIG. 7 is a perspective view illustrating a mounted state of a cleaning tool in the elevator.

Furthermore, a bracket (702) is fixed to the lower end portion of the right-side car door (3) at a position posterior to the foreign object penetration preventing member (9) as illustrated in FIG. 7, and a cleaning tool (70) constituted by a brush is supported facing downward by the bracket (702).

During closing of both car doors (2) and (3) to a fully closed position as illustrated in FIG. 2, the cleaning tool (70) cleans a surface of the first reflecting member (5) disposed on the left-side car door (2) (refer to FIG. 8). Accordingly, the surface of the first reflecting member (5) is constantly maintained as a favorable reflecting surface.

Moreover, the mounted states in which the light-emitting/light-receiving unit (4) faces vertically downward and the first reflecting member (5) and the second reflecting member (6) face vertically upward are assumed to include a mounted state having a slight incline with respect to a vertical line depending on a configuration of the light-emitting/light-receiving unit (4) (arrangement of the light emitter and the light receiver, and the like), a variance in installation postures of the car doors, and the like.

FIG. 15 illustrates an arrangement example of the optical beam B when there exists a setback distance of the end face in a closing direction at a fully open position of the car door (2) with respect to an end face of an entrance column (20) that forms the entrance of the elevator car or, in other words, an overtravel T. The optical beam B is arranged such that during stand-by in a door-open state illustrated in FIG. 15(*a*), the optical beam B is positioned outside of a width of the entrance, and when the doors are closed as illustrated in FIG. 15(*b*), the optical beam B is positioned inside a line connecting an end edge of the car door (2) and an end edge of the safety shoe frame (27).

In addition, FIG. 16 illustrates an arrangement example of the optical beam B when an overtravel does not exist. The optical beam B is arranged such that during stand-by in a door-open state illustrated in FIG. 16(*a*), the optical beam B is positioned outside of the line connecting the end edge of the car door (2) and the end edge of the safety shoe frame (27), and when the doors are closed as illustrated in FIG. 16(*b*), the optical beam B is positioned inside the line connecting the end edge of the car door (2) and the end edge of the safety shoe frame (27).

In the first elevator described above, during closing of both car doors (2) and (3) from a fully open state to an almost-fully closed state, the optical beam B outputted from the light-emitting/light-receiving unit (4) enters and is reflected by the first reflecting member (5) and a reflected optical beam B returns to the light-emitting/light-receiving unit (4) unless a foreign object exists in a path of the optical beam B.

Subsequently, during closing of both car doors (2) and (3) from the almost-fully closed state to a fully closed state, the light-emitting/light-receiving unit (4) penetrates into the housing space (30) formed on the right-side car door (3) and, as a result, the optical beam B outputted from the light-emitting/light-receiving unit (4) enters and is reflected by the second reflecting member (6) and the reflected optical beam B returns to the light-emitting/light-receiving unit (4).

In other words, during closing of both car doors (2) and (3) from the fully open state to the fully closed state, the optical beam B outputted from the light-emitting/light-receiving unit (4) is reflected by the first reflecting member (5) or the second reflecting member (5) and returns to the light-emitting/light-receiving unit (4) unless a foreign object exists in a path of the optical beam B.

The light-emitting/light-receiving unit (4) does not generate a foreign object detection signal if an optical beam is being detected. In addition, the control unit (100) continues a closing operation of both car doors (2) and (3) unless a foreign object detection signal is generated by the light-emitting/light-receiving unit (4) during closing of both car doors (2) and (3) from the fully open state to the fully closed state.

In contrast, when detection of an optical beam is interrupted, the light-emitting/light-receiving unit (4) generates a foreign object detection signal and outputs the same to the control unit (100). In response thereto, the control unit (100) reverses both car doors (2) and (3) from a closing operation to an opening operation.

FIGS. 22 and 23 illustrate a series of operations when both car doors (2) and (3) close in a state where a string S passes a central portion of the entrance of the elevator car and is stretched between the inside of the elevator car and the landing floor.

During closing of both car doors (2) and (3) from the fully open state to the almost-fully closed state as illustrated in FIGS. 22(*a*), 22(*b*), and 22(*c*), the optical beam B gradually approaches the string S, and during closing of both car doors (2) and (3) from the almost-fully closed state to the fully closed state as illustrated in FIGS. 23(*a*), 23(*b*), and 23(*c*), the Optical beam B transverses the string S. At this point, since detection of the optical beam by the light-emitting/light-receiving unit (4) is interrupted, a foreign object detection signal is generated.

FIGS. 24 and 25 illustrate a series of operations when both car doors (2) and (3) close in an elevator where the safety shoe frame (27) is disposed on the left-side car door (2) and in a state where the string S is stretched between the inside of the elevator car and the landing floor while in contact with the left-side car door (2) and the safety shoe frame (27).

During closing of both car doors (2) and (3) from the fully open state to the almost-fully closed state as illustrated in FIGS. 24(*a*), 24(*b*), and 24(*c*), although the string S is initially positioned between the optical beam B and the left-side car door (2), as the door closing operation progresses, the string S moves to a position where the string S intersects the optical beam B. Subsequently, during closing of both car doors (2) and (3) from the almost-fully closed state to the fully closed state as illustrated in FIGS. 25(*a*), 25(*b*), and 25(*c*), the optical beam B moves to the outside of the string S. During the process, since detection of the optical beam by the light-emitting/light-receiving unit (4) is interrupted when the optical beam B transverses the string S, a foreign object detection signal is generated.

FIGS. 26 and 27 illustrate a series of operations when both car doors (2) and (3) close in an elevator where safety shoe frames (27) and (37) are respectively disposed on both car doors (2) and (3) and in a state where the string S is stretched between the inside of the elevator car and the landing floor while in contact with the left-side car door (2) and the safety shoe frame (27).

During closing of both car doors (2) and (3) from the fully open state to the almost-fully closed state as illustrated in FIGS. 26(*a*), 26(*b*), and 26(*c*), although the string S is initially positioned between the optical beam B and the left-side car door (2), as the door closing operation progresses, the string S moves to a position where the string S intersects the optical beam B. Subsequently, during closing of both car doors (2) and (3) from the almost-fully closed state to the fully closed state as illustrated in FIGS. 27(*a*), 27(*b*), and 27(*c*), the optical beam B moves to the outside of the string S. During the process, since detection of the optical beam by the light-emitting/light-receiving unit (4) is interrupted when the optical beam B transverses the string S, a foreign object detection signal is generated.

Figure 9:
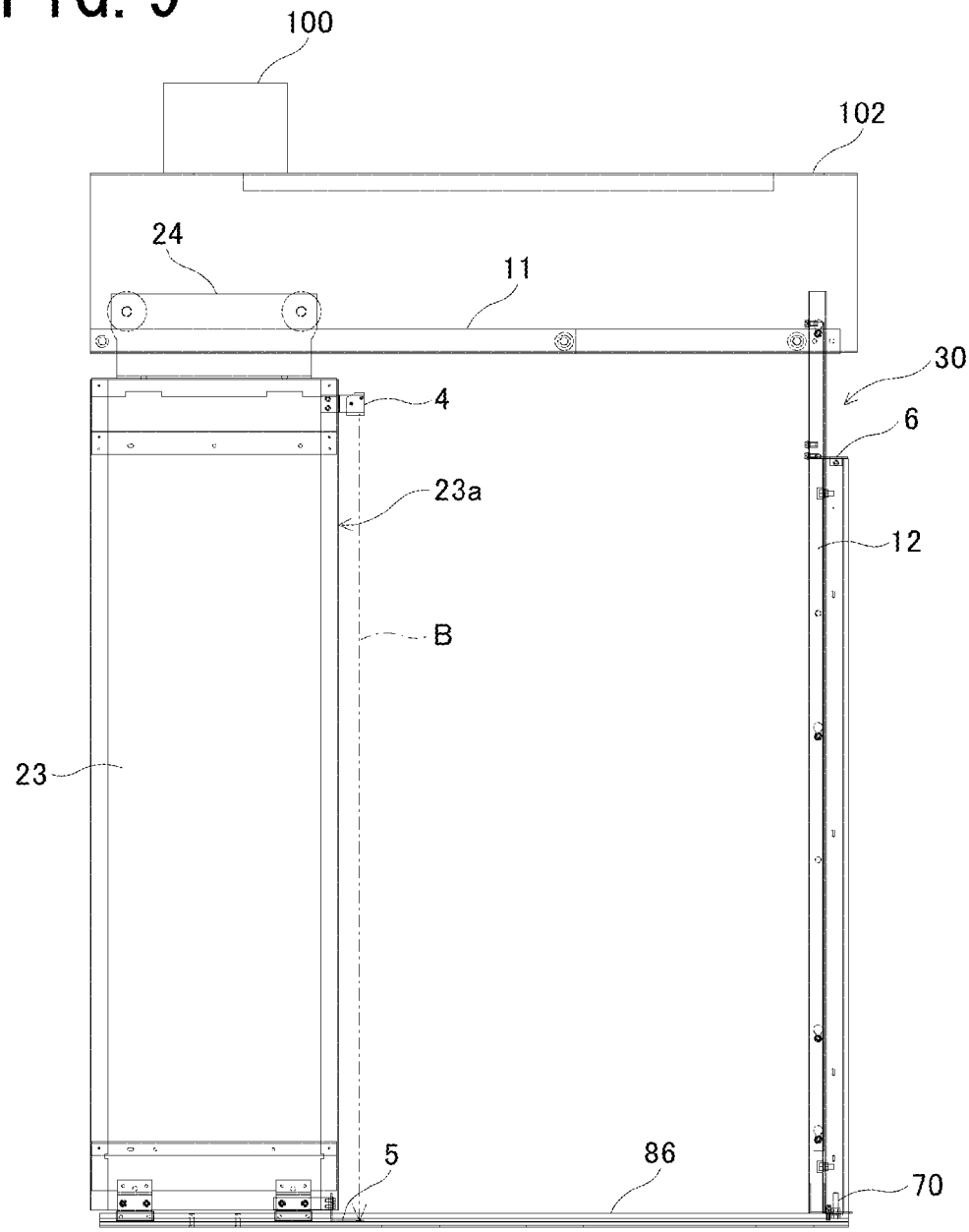
FIG. 9 is a front view illustrating a fully open state of a second elevator according to an embodiment of the present invention.
Figure 10:
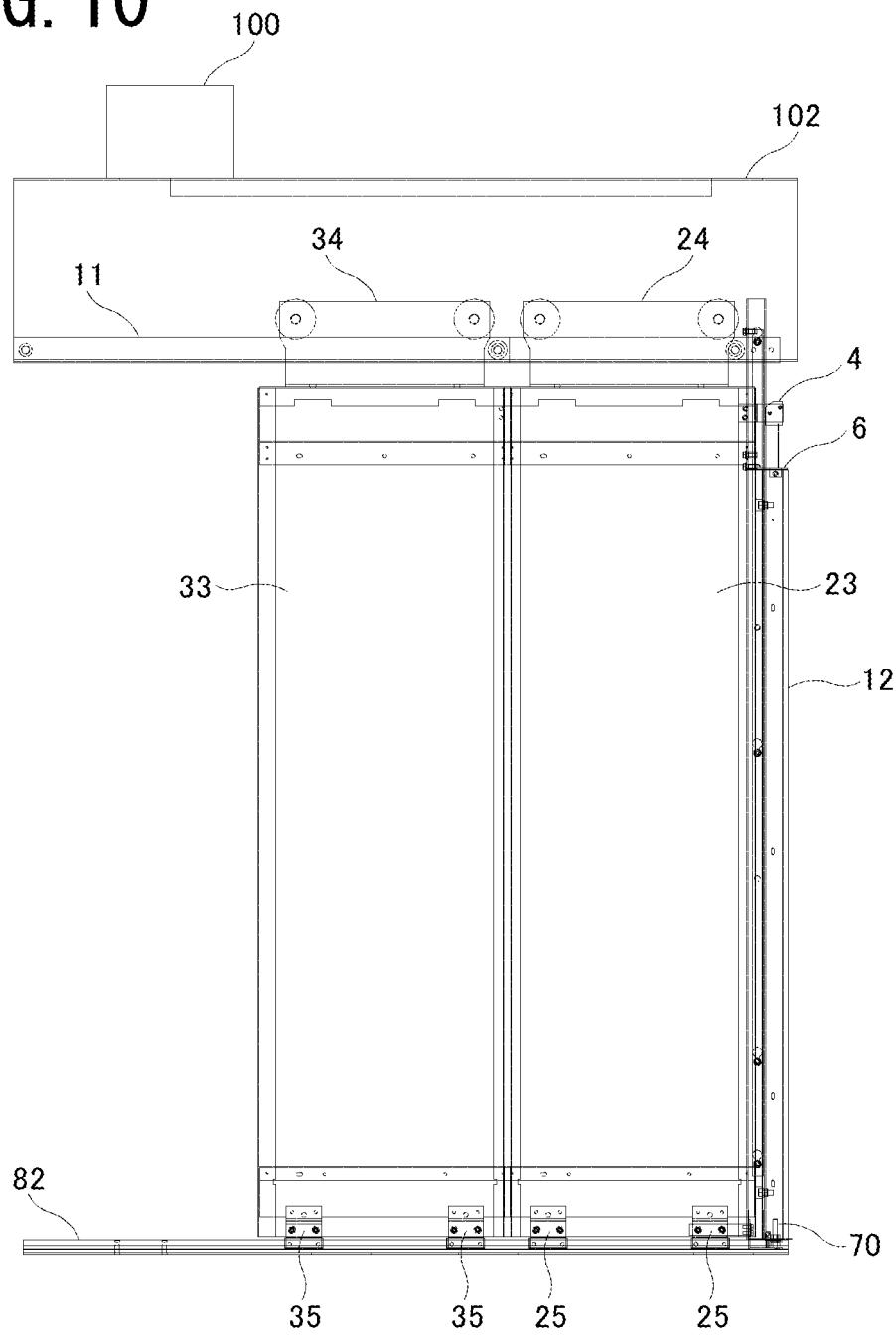
FIG. 10 is a front view illustrating a fully closed state of the elevator.

As illustrated in FIGS. 9 and 10, a second elevator according to an embodiment of the present invention is a side-open type elevator including a high-speed car door (23) and a low-speed car door (33) that move in a direction approaching/separating from a doorstop frame (12) fixed to an elevator car to open/close an entrance, wherein both car doors (23) and (33) are respectively suspended from a rail (11) by hangers (24) and (34) and guided so as to reciprocate in a horizontal direction by guide shoes (25) and (35) which are protrudingly provided at lower end portions of the doors and which are fit into a threshold (86) so as to be slidable.

In addition, a control unit (100) that controls opening/closing operations of both car doors (23) and (33) is installed on a frame (102).

As illustrated in FIG. 9, on the high-speed car door (23), a light-emitting/light-receiving unit (4) is disposed facing vertically downward at an upper end position of a vertical line separated by a predetermined distance (for example, 12 mm) from an end face in a closing direction (23*a*), which is to abut the doorstop frame, toward the side of the doorstop frame (12), and a first reflecting member (5) is disposed facing vertically upward at a lower end position of the vertical line.

Figure 11:
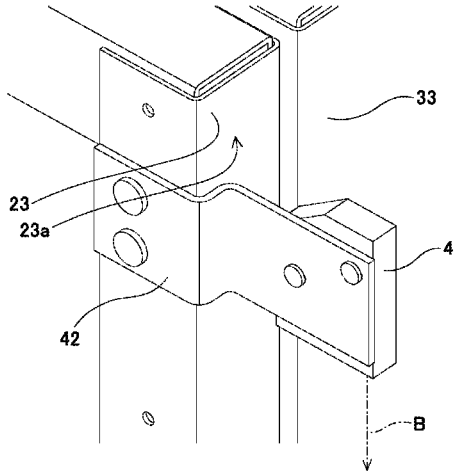
FIG. 11 is a perspective view illustrating a mounted state of a light-emitting/light-receiving unit in the elevator.

The light-emitting/light-receiving unit (4) integrally includes a laser light emitter that is to output an optical beam B and a laser light receiver that is to detect an incident optical beam B, and is supported by a stay (42) fixed to the end face in a closing direction (23*a*) of the car door (23) as illustrated in FIG. 11.

Figure 12:
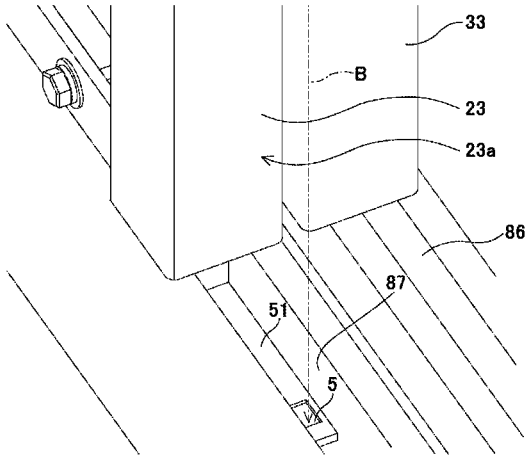
FIG. 12 is a perspective view illustrating a mounted state of a first reflecting member in the elevator.

As illustrated in FIG. 12, the first reflecting member (5) is provided on a horizontal arm portion of an L-shaped arm member (51) protrudingly provided on a lower end face of the high-speed car door (23) and includes a reflecting, surface that reflects the optical beam B vertically upward. The arm member (51) is housed so as to be reciprocatable inside a groove (87) of the threshold (86) into which the guide shoe of the car door (23) fits.

Figure 13:
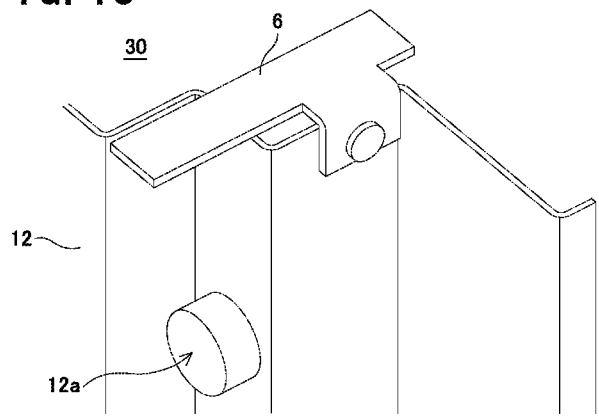
FIG. 13 is a perspective view illustrating a mounted state of a second reflecting member in the elevator.

As illustrated in FIG. 13, a housing space (30) that is to house the light-emitting/light-receiving unit in a closed state of the high-speed car door (23) is formed on an upper end portion of the doorstop frame (12), and a second reflecting member (6) is disposed facing vertically upward on a bottom portion of the housing space (30). The second reflecting member (6) has a reflecting surface of a predetermined length (for example, 8 mm) that extends from the same position as an end face (12*a*) of the doorstop frame (12) toward the back of the housing space (30), and reflects, vertically upward, an optical beam from the light-emitting/light-receiving unit that penetrates into the housing space (30).

Figure 14:
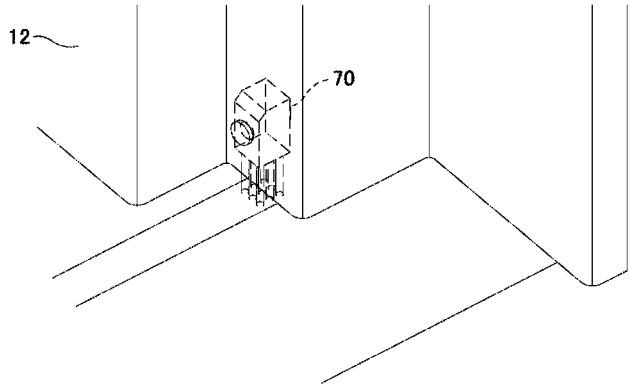
FIG. 14 is a perspective view illustrating a mounted state of a cleaning tool in the elevator.

Furthermore, a cleaning tool (70) constituted by a brush is mounted facing downward as illustrated in FIG. 14 on a lower end portion of the doorstop frame (12).

During closing of both car doors (23) and (33) to a fully closed position as illustrated in FIG. 10, the cleaning tool (70) cleans a surface of the first reflecting member (5) disposed on the high-speed car door (23). Accordingly, the surface of the first reflecting member (5) is constantly maintained as a favorable reflecting surface.

In the second elevator described above, during closing of the high-speed car door (23) from a fully open state to an almost-fully closed state, the optical beam B outputted from the light-emitting/light-receiving unit (4) enters and is reflected by the first reflecting member (5) and a reflected optical beam B returns to the light-emitting/light-receiving unit (4) unless a foreign object exists in a path of the optical beam B.

Subsequently, during closing of the car door (23) from the almost-fully closed state to a fully closed state, the light-emitting/light-receiving unit (4) penetrates into the housing space (30) formed on the doorstop frame (12) and, as a result, the optical beam B outputted from the light-emitting/light-receiving unit (4) enters and is reflected by the second reflecting member (6) and the reflected optical beam B returns to the light-emitting/light-receiving unit (4).

In other words, during closing of the high-speed car door (23) from the fully open state to the fully closed state, the optical beam B outputted from the light-emitting/light-receiving unit (4) is reflected by the first reflecting member (5) or the second reflecting member (6) and returns to the light-emitting/light-receiving unit (4) unless a foreign object exists in a path of the optical beam B.

The light-emitting/light-receiving unit (4) does not generate a foreign object detection signal if an optical beam is detected. In addition, the control unit (100) illustrated in FIGS. 9 and 10 continues a closing operation of both car doors (23) and (33) unless a foreign object detection signal is supplied from the light-emitting/light-receiving unit (4) during closing of the high-speed car door (23) from the fully open state to the fully closed state.

In contrast, the control unit (100) reverses both car doors (23) and (33) from a closing operation to an opening operation when a foreign object detection signal is supplied from the light-emitting/light-receiving unit (4) during closing of the high-speed car door (23).

FIGS. 28 and 29 illustrate a series of operations when the high-speed car door (23) and a landing door (15) close in a state where a string S passes a position slightly toward the doorstop frame (12) than the central portion of the entrance of the elevator car and is stretched between the inside of the elevator car and the landing floor.

During closing of the car door (23) from a fully open state to an almost-fully closed state as illustrated in FIGS. 28(*a*) and 28(*b*), the optical beam B approaches the string S and moves to a position where the optical beam B intersects the string S, and subsequently moves from the position where the optical beam B intersects the string S toward the side of the doorstop frame (12) as illustrated in FIGS. 29(*a*) and 29(*b*). In this manner, since detection of the optical beam by the light-emitting/light-receiving unit (4) is interrupted when the optical beam B transverses the string S, a foreign object detection signal is generated.

FIGS. 30 and 31 illustrate a series of operations when the high-speed car door (23) and the landing door (15) close in an elevator where the safety shoe frame (29) is disposed on the high-speed car door (23) and in a state where the string S is stretched between the inside of the elevator car and the landing floor while in contact with the safety shoe frame (29) and the landing door (15).

During closing of the car door (23) and the landing door (15) to an almost-fully closed state as illustrated in FIGS. 30(*a*), 30(*b*), and 30(*c*), the string S is pushed out toward the side of the doorstop frame (12) by the safety shoe frame (29). Subsequently, during closing of the car door (23) and the landing door (15) from the almost-fully closed state to a fully closed state as illustrated in FIGS. 31(*a*), 31(*b*), and 31(*c*), the optical beam B transverses the string S so as to accompany the movement of the car door (23). At this point, since detection of the optical beam by the light-emitting/light-receiving unit (4) is interrupted, a foreign object detection signal is generated.

FIGS. 17 to 20 illustrate an embodiment that uses a signal from a gate switch (101) in order to detect a failure of the light-emitting/light-receiving unit (4) in a side-open type elevator.

In this case, as illustrated in FIG. 18(*b*), the second reflecting member (6) includes a reflecting portion (601) that reflects, with an amount of light equal to or exceeding a certain level, an optical beam outputted from the light-emitting/light-receiving unit (4), and a non-reflecting portion (602) that does not reflect, with an amount of light equal to or exceeding a certain level, an optical beam outputted from the light-emitting/light-receiving unit (4).

For example, the reflecting portion (601) may be configured by applying reflective tape on a surface of a non-reflective member and the non-reflecting portion (602) can be constituted by a region where the reflective tape is not applied.

As illustrated in FIGS. 17(*a*) and 17(*b*), the gate switch (101) is disposed on the rail (11), and a protruding piece (26) for switching the gate switch (101) from OFF to ON is mounted on the hanger (24) of the high-speed car door (23).

In the fully open state illustrated in FIGS. 17(*a*) and 17(*b*), the optical beam B outputted from the light-emitting/light-receiving unit (4) enters and is reflected by the first reflecting member (5). The optical beam B is to proceed along a vertical line separated from the end face in a closing direction (23*a*) of the car door (23) by 12 mm.

As illustrated in FIGS. 18(*a*) and 18(*b*), when the end face in a closing direction (23*a*) of the car door (23) closes to a position 12 mm short of the end face (12*a*) of the doorstop frame (first almost-fully closed state), the optical beam B outputted from the light-emitting/light-receiving unit (4) makes a transition from a state incident to the first reflecting member (5) to a state incident to the reflecting portion (601) of the second reflecting member (6). Subsequently, the optical beam B reflected by the reflecting portion (601) is to be detected by the light-emitting/light receiving unit (4). Therefore, a foreign object detection signal is not generated.

At this point, the gate switch (101) remains turned off.

As illustrated in FIGS. 19(*a*) and 19(*b*), when the end face in a closing direction (23*a*) of the car door (23) closes to a position 8 mm short of the end face (12*a*) of the doorstop frame, the gate switch (101) is turned on. At this point, the optical beam B outputted from the light-emitting/light-receiving unit (4) is, still in a state incident to the reflecting portion (601) of the second reflecting member (6), and the optical beam B reflected by the reflecting portion (601) is detected by the light-emitting/light-receiving unit (4).

Furthermore, as illustrated in FIGS. 20(*a*) and 20(*b*), when the end face in a closing direction (23*a*) of the car door (23) closes to a position 4 mm short of the end face (12*a*) of the doorstop frame (second almost-fully closed state), the optical beam B outputted from the light-emitting/light receiving unit (4) makes a transition from a state incident to the reflecting portion (601) of the second reflecting member (6) to a state incident to the non-reflecting portion (602). Subsequently, the optical beam B does not enter the light-emitting/light-receiving unit (4) with an amount of light equal to or exceeding a certain level until the car door (23) reaches a fully closed state. As a result, a foreign object detection signal is to be generated.

At this point, the gate switch (101) remains turned on.

Therefore, as long as the light-emitting/light-receiving unit (4) is operating normally, the gate switch (101) is switched on in a second almost-fully closed state and, at the same time, a foreign object detection signal is generated. In this case, the control unit (100) continues a door closing operation regardless of a foreign object detection signal.

However, if some kind of abnormality has occurred at the light-emitting/light-receiving unit (4), the gate switch (101) is switched on but a foreign object detection signal is not generated. In this case, the control unit (100) determines that an abnormality has occurred at the light-emitting/light-receiving unit (4) when a foreign object detection signal is not supplied after the gate switch (101) is switched on.

FIG. 21 illustrates a control procedure of the control unit (100) based on outputs of the light-emitting/light-receiving unit (4) and the gate switch (101). In step S1, the control unit (100) stands by at door opening completion (fully open state). Next, in step S2 the control unit (100) determines whether a door opening open period has expired or not. If not, the control unit (100) returns to step S1 and stands by at door opening completion.

When the door opening open period has expired and a determination of YES has been made in step S2, the control unit (100) proceeds to step S3 to determine whether or not the current situation corresponds to a case where reverse door opening operations have been repeated a predetermined number of times N due to a generation of a foreign object detection signal or to a case where a door opening stand-by period has reached a predetermined period of time T. In other words, a determination is made as to whether or not a door closing operation of the car door has been completed.

When a determination of YES is made at this point, it is highly likely that the door closing operation of the car door cannot be completed due to a circumstance other than a string-like foreign object being present across the entrance. Therefore, the control unit (100) makes a transition to step S4 to issue a warning to persons to move away from the car doors (23) and (33) using a voice guidance system in the elevator car or a display guidance system in the elevator car or the landing. Subsequently, the reverse door opening operation is disabled and a door closing operation at low speed is forcibly executed while sounding a buzzer or the like regardless of whether or not a foreign object detection signal has been generated. The sounding of the buzzer or the like at this point is for announcing the execution of the forced door closing operation. It is obvious that this announcement may alternatively be made before executing the forced door closing operation.

Next, during the execution of the door closing operation, in step 41, detection of a foreign object is performed at the light-emitting/light-receiving unit. At this point, when a foreign object detection signal is not generated during the execution of the door closing operation and a determination of NO is made, the control unit (100) makes a transition to step S42 where, after door closing is complete, a reverse door opening operation is enabled and the sounding of the buzzer or the like is terminated to restart a normal control operation. Subsequently, the procedure is concluded.

In contrast, when a foreign object detection signal is generated during the execution of the door closing operation and a determination of YES is made in step S41, the control unit (100) makes a transition to step S43 where; after door closing is complete, an announcement to the effect that a run of the elevator car is to be started is made using a voice guidance system in the elevator car or a display guidance system in the elevator car or the landing. When the start of the run is to be announced by voice, the volume may be increased in comparison to the voice used for the warning made in step S4.

A stop state of the elevator car is maintained during the announcement of the start of run of the elevator car. Subsequently, in step S44, a determination is made as to whether or not a door open button in the elevator car or a landing call button on a stop floor where the elevator car is stopped has been pushed.

When the door open button in the elevator car or a landing call button has been pushed and a determination of YES is made in step S44, the control unit (100) makes a transition to step S47 to perform a door opening operation. Accordingly, a foreign object that had got caught due to a door closing operation forcibly performed in step S4 can now be removed. Subsequently, the control unit (100) returns to step S1 and stands by at door opening completion.

In contrast thereto, when the door open button in the elevator car or a landing call button has not been pushed and a determination of NO is made in step S44, the control unit (100) makes a transition to step S45 to broadcast that the elevator car is to be started using a voice guidance system in the elevator car while maintaining the stop states of the elevator car and the car doors. After the end of the broadcast, a determination is made as to whether or not a predetermined period of time has lapsed.

When a predetermined period of time has lapsed after the end of the broadcast and a determination of YES is made in step S45, the control unit (100) makes a transition to step S46 to restart a normal control operation. Subsequently, the procedure is concluded.

On the other hand, when a predetermined period of time has not lapsed after the end of the broadcast and a determination of NO is made in step S45, the control unit (100) returns to step S43 to maintain stop states of the elevator car and the car doors.

In this manner, even when a door closing operation of the car doors is forcibly executed in step S4, since the execution of the door closing operation is announced in step S4 and the start of a run of the elevator car is announced in step S43, an occurrence of an accident attributable to the forcible execution of the door closing operation can now be prevented.

When a determination of NO is made in step S3, a door closing operation is performed at normal speed (high speed) in step S5 and a detection of a foreign object by the light-emitting/light-receiving unit is, performed in step S6.

When it is determined at this point that a foreign object detection signal has been generated, since it is extrapolated that a foreign object of some kind (for example, a string that straddles the elevator car and a landing floor) exists in the entrance of the elevator car, the control unit (100) makes a transition to step S7 to perform reverse door opening and then returns to step S1 and stands by at door opening completion.

On the other hand, when it is determined in step S6 that a foreign object detection signal has not been generated, the control unit (100) makes a transition to step S8 to determine whether or not the gate switch has been turned on, and when a determination of YES is made, a detection of a foreign object is further performed by the light-emitting/light-receiving unit in step S9. When a determination of NO is made in step S8, the control unit (100) returns to step S5.

When a foreign object detection signal is not generated at this point, it can be determined that despite a transition of an optical beam from the light-emitting/light-receiving unit from a state incident to a reflecting portion of the second reflecting member to a state incident to the non-reflecting portion, the light-emitting/light-receiving unit has not been switched from an optical beam detecting state to a non-detecting state.

In this case, the control unit (100) makes a transition to step S11 to determine that a failure, has occurred at the light-emitting/light-receiving unit in that detection of a foreign object is disabled, performs reverse door opening, and returns to step S1 and stands by at a door opening completed state.

In contrast thereto, when it is determined in step S9 that a foreign object detection signal has been generated, a determination is made in step S10 to the effect that the light-emitting/light-receiving unit is normal and the door closing operation is continued. Furthermore, in step S12, the number of reverse door opening operations is cleared, and in step S13, the determination to the effect that a failure has occurred that disables detection of a foreign object is cancelled to conclude the series of procedures.

According to the procedures described above, a failure of the light-emitting/light-receiving unit (4) can be detected using an ON/OFF signal from the gate switch (101) that has conventionally been used to detect a conclusion of a door closing operation. Consequently, an abnormal circumstance can be avoided where a foreign object detection signal is not generated and a risk aversion operation is not performed despite the presence of a foreign object such as a string in the entrance of the elevator car.

Moreover, in place of an ON/OFF signal from the gate switch (101), a CTL signal that enables detection of an almost-fully closed state more closer to a fully closed state can be used. While the gate switch (101) is a switch that detects closing of a door, a CTL is a switch that detects a position of a door. An elevator is equipped with both switches.

For example, since a CTL signal switches from OFF to ON at a point in time where the end face in a closing direction (23*a*) of the car door (23) has closed to within 4 mm from the end face (12*a*) of the doorstop frame (12), the length of the reflecting portion (601) of the second reflecting member (6) is altered so that an optical beam from the light-emitting/light-receiving unit (4) makes a transition from the reflecting portion (601) to the non-reflecting portion (602) in a state where the end face in a closing direction (23*a*) of the car door (23) has closed to within 2 mm from the end face (12*a*) of the doorstop frame (12)

FIGS. 32 and 33 illustrate an example of an improved structure of the first and second elevators described above. As illustrated, a foreign object penetration preventing member (9) that fills up a gap formed between a lower end of an end face in a closing direction (13*a*) of a left-side landing door (13) and a surface of a threshold (82) is mounted at a lower end portion of the left-side landing door (13).

Accordingly, penetration of a string S into the gap can be prevented and, as a result, the string S can be reliably detected.

Moreover, it is effective to similarly mount a foreign object penetration preventing member (9) that fills up a gap formed between a lower end of an end face in a closing direction of a right-side landing door and a surface of a threshold at a lower end portion of the right-side landing door.

FIGS. 34 and 35 illustrate another example of an improved structure of the first and second elevators described above. As illustrated, a foreign object pushing member (90) which fills up a gap formed between a lower end of an end face in a closing direction (2*a*) of a left-side car door (2) and a surface of a threshold (82) and which protrudes further toward the side of a right-side car door than the gap is mounted at a lower end portion of the left-side car door (2).

Accordingly, a string S is pushed out by the foreign object pushing member (90) during closing of the car door (2) and, as a result, an optical beam B is to transverse the string S to enable the string S to be reliably detected.

FIGS. 36 and 37 illustrate an example of an improved structure of an elevator in which a safety shoe frame (27) is mounted to a left-side car door (2). As illustrated, a foreign object pushing member (90) similar to that of the example described above is mounted to a lower end portion of the left-side car door (2). In addition, a lower end face of the safety shoe frame (27) forms a slope (28) which has a predetermined inclination angle with respect to a horizontal plane and which faces toward the side of a right-side car door.

In this manner, since the lower end face of the safety shoe frame (27) has a slope (28), even if a string S slips under the safety shoe frame (27) during closing of both car doors, by pulling the string S upward, the string S is guided by the slope (28) of the safety shoe frame (27) and can readily extricate itself from underneath the safety shoe frame (27).

FIG. 38 illustrates an example of a center-open type elevator in which the foreign object penetration preventing member (9) described above is mounted to left, and right landing doors (13) and (14), the foreign object pushing member (90) described above is mounted to a left-side car door (2), and the foreign object penetration preventing member (9) described above is mounted to a right-side car door (3). In addition, the slope described above is respectively formed on the safety shoe frames (27) and (37) mounted on both car doors (2) and (3).

Accordingly, a string S can be prevented from slipping under the landing doors (13) and (14) or the car doors (2) and (3) and an escape operation of the string S when the string slips under the safety shoe frames (27) and (37) can be performed more easily.

In yet another configuration example, as illustrated in FIG. 39), a cleaning tool (701) constituted by a brush is mounted facing downward at a position more forward than a light-emitting/light-receiving unit (4) on a stay (41) mounted on a left-side car door (2). During closing of both car doors (2) and (3) to a fully closed position as illustrated in FIG. 2, the cleaning tool (701) cleans a surface of a second reflecting member (6) disposed on a right-side car door (3). Accordingly, the surface of the second reflecting member (6) is constantly maintained as a favorable reflecting surface.

FIGS. 40 to 42 respectively illustrate a modification example for preventing a first reflecting member (5) from being damaged.

In the example illustrated in FIG. 40, due to a configuration in which a pad (54) constituted by an elastic material is mounted to a rear face of an arm member (51), an impact when the first reflecting member (5) is subjected to an external force F is absorbed by an elastic deformation of the arm member (51) and impact absorption by the pad (54).

In addition, in the example illustrated in FIG. 41, due to a configuration in which an arm member (51) is pivotally supported by a pivot (55) so as to be rotationally movable within a vertical plane, and a pad (56) is mounted on a distal end-side and a spring (57) is mounted on the side of the pivot (55) of a rear face of the arm member (51), an impact when the first reflecting member (5) is subjected to external force F is absorbed by an elastic deformation of the spring (57).

Furthermore, in the example illustrated in FIG. 42, due to a configuration in which a depressed and elongated groove (53) having a certain depth G is provided on a surface of an arm member (51) and a first reflecting member (5) is embedded in a bottom face of the groove (53) with a surface of the first reflecting member (5) exposed, the first reflecting member (5) can be prevented from being directly struck by a rod-like object A such as a tip of an umbrella.

Second Embodiment

As illustrated in FIGS. 43 and 44, a third elevator according to an embodiment of the present invention is a center-open type elevator including a pair of left and right car doors (2) and (3) that open/close an entrance, wherein a rail (1) is fixed to a frame (81) above the entrance, and both car doors (2) and (3) are respectively suspended from the rail (1) by hangers (21) and (31) and guided so as to reciprocate in a horizontal direction by guide shoes (22) and (32) which are protrudingly provided at lower end portions of the doors and which are fit into a threshold (82) so as to be slidable.

In addition, a control unit (100) that controls opening/closing operations of both car doors (2) and (3) is installed on the frame (81).

As illustrated in FIG. 43, at a position on a vertical line (103) vertically extending from an abutting position where the pair of left and right car doors (2) and (3) abut each other in a fully closed state, a light-emitting/light-receiving unit (4) is disposed facing vertically downward on the frame (81) and a reflecting member (50) is disposed facing vertically upward on the threshold (82). In the present embodiment, the light-emitting/light-receiving unit (4) is fixed to the frame (81) via a transom (811).

Moreover, the mounted states in which the light-emitting/light-receiving unit (4) faces vertically downward and the reflecting member (50) faces vertically upward are assumed to include a mounted state having a slight incline with respect to the vertical line (103) depending on a configuration of the light-emitting/light-receiving unit (4) (arrangement of the light emitter and the light receiver, and the like), a variance in installation postures of the frame (81) and the car doors (2) and (3), and the like.

The light-emitting/light-receiving unit (4) integrally includes a light emitter that is to output abeam of laser light (hereinafter referred to as an optical beam) B and a light receiver that is to detect an incident optical beam B, and is supported by a stay (41) fixed to the transom (811) as illustrated in FIGS. 45 and 46.

Moreover, for example, a red semiconductor laser is used as the light emitter of the light-emitting/light-receiving unit (4) so as to form a spot having a diameter of 1 to 2 mm. The light receiver of the light-emitting/light-receiving unit (4) outputs a light detection signal when an amount of light received from an incident optical beam exceeds a predetermined threshold. In contrast, when the amount of light received from an incident optical beam falls under the predetermined threshold, a foreign object detection signal is outputted.

As illustrated in FIGS. 47 and 48, the reflecting member (50) is provided on an installation table (104) which is disposed below the threshold (82) and which extends horizontally along the threshold (82), and has a reflecting surface that reflects the optical beam B vertically upward. Moreover, as illustrated in FIGS. 48 and 49, a through-hole (821) through which the optical beam B passes in a vertical direction is formed on the threshold (82). In addition, the installation table (104) is fixed to the threshold (82) (not illustrated).

By disposing the reflecting member (50) below the threshold, since the presence of the reflecting member (50) is less likely to be noticed by a user, vandalism can be prevented. In addition, a reflecting surface of the reflecting member (50) is less likely to become stained.

As illustrated in FIG. 51, on both car doors (2) and (3), a pair of depressed portions (2*b*) and (3*b*) extending along the vertical line (103) are formed on end faces in a closing direction (2*a*) and (3*a*) that are to abut each other in a fully closed state. Accordingly, when both car doors (2) and (3) are in a fully closed state, a pathway (105) through which the optical beam B passes is to be formed.

Alternatively, as illustrated in FIG. 52, a pair of notched portions (2*c*) and (3*c*) extending along the vertical line (103) may be formed on the end faces in a closing direction (2*a*) and (3*a*) of both car doors (2) and (3) and the pathway (105) through which the optical beam B passes may be formed by the pair of notched portions (2*c*) and (3*c*).

As illustrated in FIG. 47, a cleaning mechanism (7) for cleaning a surface of the reflecting member (50) is disposed on the threshold (82) and the right-side car door (3). The cleaning mechanism (7) includes a cleaning tool (71) constituted by a brush, a spring member (72), and a pressing unit (73). Specifically, a pair of supporting members (75) and (75) are mounted on the installation table (104) fixed to the threshold (82), and a rod-like member (74) extending along an opening/closing direction of the right-side car door (3) is slidably supported by the pair of supporting members (75) and (75).

In addition, the cleaning tool (71) is mounted facing downward on the rod-like member (74). Accordingly, the cleaning tool (71) is arranged so as to be capable of sliding along the surface of the reflecting member (50) to clean the surface of the reflecting member (50).

Furthermore, an L-shaped arm portion (76) is protrudingly provided facing upward on the rod-like member (74).

One end of the spring member (72) is fixed to the installation table (104) and another end of the spring member (72) is connected to a right-side end of the rod-like member (74) so as to spring-bias the cleaning tool (71) in an opening direction of the right-side car door (3). Therefore, in a state where the right-side car door (3) is open, the cleaning tool (71) is to be arranged at a position to the right of the reflecting member (50).

In the present embodiment, the guide shoe (32) of the right-side car door (3) is used as the pressing unit (73). The guide shoe (32) presses the arm portion (76) against the spring bias during closing of the right-side car door (3) from an almost-fully closed state (FIG. 47) to a fully closed state (FIG. 50). Accordingly, as illustrated in FIG. 48, the cleaning tool (71) moves from the right to the left of the reflecting member (50) and cleans the surface of the reflecting member (50).

Subsequently, as the right-side car door (3) opens, the cleaning tool (71) is moved from the left to the right of the reflecting member (50) by the spring bias of the spring member (72) and once again cleans the surface of the reflecting member (50). In other words, the surface of the reflecting member (50) is cleaned by the cleaning tool (71) every time the right-side car door (3) opens or closes. Accordingly, the surface of the reflecting member (50) is constantly maintained as a favorable reflecting surface.

Moreover, in the cleaning mechanism (7) described above, the cleaning tool (71) may be spring-biased in a closing direction of the right-side car door (3) by the spring member (72). In this case, the cleaning tool (71) is to be arranged on the left side of the reflecting member (50). By having the guide shoe (32) press the arm portion (76) against the spring bias during opening of the right-side car door (3), the cleaning tool (71) moves from the left to the right of the reflecting member (50) and cleans the surface of the reflecting member (50). Subsequently, as the right-side car door (3) closes, the cleaning tool (71) is moved from the right to the left of the reflecting member (50) by the spring bias of the spring member (72) and once again cleans the surface of the reflecting member (50).

Furthermore, as illustrated in FIG. 53, foreign object penetration preventing members (91) and (92) that fill up gaps formed between the end faces in a closing direction (2*a*) and (3*a*) of both car doors (2) and (3) and the threshold (82) are mounted at lower end portions of both car doors (2) and (3). As illustrated in FIGS. 54(*a*) and 54(*b*), protruding portions (91*a*) and (92*a*) are formed on the foreign object penetration preventing members (91) and (92). In a mounted state on the foreign object penetration preventing members (91) and (92), the protruding portions (91*a*) and (92*a*) protrude downward from the lower end portions of both car doors (2) and (3) as illustrated in FIG. 55, and lower end portions of the protruding portions (91*a*) and (92*a*) are housed in a groove (83) of the threshold (82) so as to be reciprocatable as illustrated in FIG. 53.

In the third elevator described above, during closing of both car doors (2) and (3), the optical beam B outputted from the light-emitting/light-receiving unit (4) enters and is reflected by the reflecting member (50) and a reflected optical beam B returns to the light-emitting/light-receiving unit (4) unless a foreign object exists in a path of the optical beam B.

The light-emitting/light-receiving unit (4) does not generate a foreign object detection signal if an optical beam is being detected. In addition, the control unit (100) continues a closing operation of both car doors (2) and (3) unless a foreign object detection signal is generated by the light-emitting/light-receiving unit (4) during closing of both car doors (2) and (3).

In contrast, when detection of an optical beam is interrupted, the light-emitting/light-receiving unit (4) generates a foreign object detection signal. Specifically, if a string S is present across the entrance, when both car doors (2) and (3) reach a fully closed state as illustrated in FIG. 56 or 57, an optical beam outputted from the light-emitting/light-receiving unit (4) is blocked by the string S and detection of the optical beam by the light-emitting/light-receiving unit (4) is interrupted. As a result, a foreign object detection signal is to be generated.

The foreign object detection signal generated by the light-emitting/light-receiving unit (4) is outputted to the control unit (100). In response thereto, the control unit (100) reverses both car doors (2) and (3) from a closing operation to an opening operation.

In addition, in the third elevator described above, since the light-emitting/light-receiving unit (4) is supported by the frame (81), the influence of a vibration, an impact made on the elevator car, or the like caused during opening or Closing of both car doors (2) and (3) or, more specifically, a variance in an amount of light received of the incident optical beam B, a displacement of an irradiation position of the optical beam B, or the like can be avoided. As a result, foreign object detection accuracy can be enhanced. In a similar manner, since the reflecting member (50) is supported by the threshold (82), the influence of a vibration, an impact made on the elevator car, or the like caused during opening or closing of both car doors (2) and (3) can be avoided.

Furthermore, in the third elevator described above, since foreign object penetration preventing members (91) and (92) are mounted to the lower end portions of both car doors (2)

and (3), penetration of the string S into gaps formed between the end faces in a closing direction (2*a*) and (3*a*) of both car doors (2) and (3) and the threshold (82) can be prevented by the foreign object penetration preventing members (91) and (92). Therefore, the string S that is a foreign object can be reliably detected during closing of both car doors (2) and (3).

In the third elevator described above, the optical beam B is favorably outputted from the light-emitting/light-receiving unit (4) only during closing of both car doors (2) and (3) from an almost-fully closed state to a fully closed state. This is because a person can be prevented from peeking into the light-emitting/light-receiving unit (4) during output of the optical beam B.

FIG. 58 illustrates a control procedure of the control unit (100) based on output of the light-emitting/light-receiving unit (4). First, in step S21, emission of the optical beam B by the light-emitting/light-receiving unit (4) is suspended, and in a next step S22, the control unit (100) stands by at door opening completion (fully open state). Next, in step S23, the control unit (100) determines whether or not a door opening open period has expired. If not, the control unit (100) returns to step S22 and stands by at door opening completion.

When the door opening open period has expired and a determination of YES has been made in step S23, the control unit (100) proceeds to step S24 to, determine whether or not the current situation corresponds to a case where reverse door opening operations have been repeated a predetermined number of times N due to a generation of a foreign object detection signal or to a case where a door opening stand-by period has reached a predetermined period of time T. In other words, a determination is made as to whether or not a door closing operation of the car door has been completed.

When a determination of YES is made at this point, it is highly likely that the door closing operation of the car door cannot be completed due to a circumstance other than a string-like foreign object being present across the entrance. Therefore, the control unit (100) makes a transition to step S25 to issue a warning to persons to move away from the car doors (2) and (3) using a voice guidance system in the elevator car or a display guidance system in the elevator car or the landing. Subsequently, the reverse door opening operation is disabled and a door closing operation at low speed is forcibly executed while sounding a buzzer or the like regardless of whether or not a foreign object detection signal is generated. The sounding of the buzzer or the like at this point is for announcing the execution of the forced door closing operation. It is obvious that this announcement may alternatively be made before executing the forced door closing operation.

Next, during the execution of the door closing operation, in step 51, detection of a foreign object is performed at the light-emitting/light-receiving unit. At this point, when a foreign object detection signal is not generated during the execution of the door closing operation and a determination of NO is made, the control unit (100) makes a transition to step S52 where, after door closing is complete, a reverse door opening operation is enabled and the sounding of the buzzer or the like is terminated to restart a normal control operation. Subsequently, the procedure is concluded.

In contrast, when a foreign object detection signal is generated during the execution of the door closing operation and a determination of YES is made in step S51, the control unit (100) makes a transition to step S53 where, after door closing is complete, an announcement to the effect that a run of the elevator car is to be started is made using a voice guidance system in the elevator car or a display guidance system in the elevator car or the landing. When the start of the run is to be announced by voice, the volume may be increased in comparison to the voice used for the warning made in Step S25.

A stop state of the elevator car is maintained during the announcement of the start of run of the elevator car. Subsequently, in step S54, a determination is made as to whether or not a door open button in the elevator car or a landing call button on a stop floor where the elevator car is stopped has been pushed.

When the door open button in the elevator car or a landing call button has been pushed and a determination of YES is made in step S54, the control unit (100) makes a transition to step S57 where, after suspending emission of the optical beam B, a door opening operation is performed. Accordingly, a foreign object that had got caught due to a door closing operation forcibly performed in step S25 can now be removed. Subsequently, the control unit (100) returns to step S22 via step S21 and stands by at door opening completion.

In contrast thereto, when the door open button in the elevator car or the landing call button has not been pushed and a determination of NO is made in step S54, the control unit (100) makes a transition to step S55 to broadcast that a run of the elevator car is to be started using a voice guidance system in the elevator car while maintaining the stop states of the elevator car and the car doors. After the end of the broadcast, a determination is made as to whether or not a predetermined period of time has lapsed.

When a predetermined period of time has lapsed after the end of the broadcast and a determination of YES is made in step S55, the control unit (100) makes a transition to step S56 to restart a normal control operation. Subsequently, the procedure is concluded.

On the other hand, when a predetermined period of time has not lapsed after the end of the broadcast and a determination of NO is made in step S55, the control unit (100) returns to step S53 to maintain stop states of the elevator car and the car doors.

In this manner, even when a door closing operation of the car doors is forcibly executed in step S25, since the execution of the door closing operation is announced in step S25 and the start of a run of the elevator car is announced in step S53, an occurrence of an accident attributable to the forcible execution of the door closing operation can now be prevented.

When a determination of NO is made in step S24, a door closing operation is performed at normal speed (high speed) in step S26 and a determination is made in step S27 as to whether or not the gate switch (101) has been turned on. When a determination of NO is made in step S27, the control unit (100) returns to step S26. When a determination of YES is made in step S27, the control unit (100) makes a transition to step S28 to start emission of the optical beam B by the light-emitting/light-receiving unit (4), and performs detection of a foreign object by the light-emitting/light-receiving unit (4) in step S29.

When it is determined in step S29 that a foreign object detection signal has been generated, since it is extrapolated that a foreign object of some kind (for example, a string that straddles the elevator car and a landing floor) exists in the entrance of the elevator car, the control unit (100) makes a transition to step S30 to suspend emission of the optical beam B while maintaining a stop state of the elevator car and then executes a reverse door opening operation. Subsequently, the control unit (100) returns to step S22 via step S21 and stands by at door opening completion.

On the other hand, when it is determined in step S29 that a foreign object detection signal has not been generated, the control unit (100) makes a transition to step S31 to clear the number of reverse door opening operations and subsequently suspends emission of the optical beam. The series of procedures is then concluded.

According to the procedures described above, an abnormal circumstance can be avoided where a foreign object detection signal is generated and a car door remains open due to a foreign object other than a string-like foreign object.

As illustrated in FIGS. 59 and 60, a fourth elevator according to an embodiment of the present invention is a center-open type elevator similar to the third elevator described above and differs from the third elevator in a configuration of a reflecting member (50) and a configuration for cleaning a surface of the reflecting member (50). The configurations will be specifically described below. Moreover, since other configurations are similar to those of the third elevator, descriptions thereof will be omitted.

In the present embodiment, as illustrated in FIG. 61, the reflecting member (50) is provided on a horizontal arm portion of an L-shaped arm member (51) protrudingly provided on a lower end face of a right-side car door (3) and includes a reflecting surface that reflects an optical beam B vertically upward. As illustrated in FIG. 62, the horizontal arm portion of the arm member (51) is housed so as to be reciprocatable inside a groove (83) of a threshold (82) into which a guide shoe (32) of the right-side car door (3) fits. In other words, the reflecting member (50) is held inside the groove (83) of the threshold (82) so as to be movable along the groove (83).

In addition, the reflecting member (50) extends to the side of a left-side car door (2) from a position opposing a lower end face of the right-side car door (3), and protrudes by a predetermined distance (for example, 8 mm) from a position of an end face in a closing direction of the right-side car door (3). In other words, the reflecting member (50) is disposed facing upward at a lower end position of the end face in a closing direction (3*a*) of the right-side car door (3). Therefore, when both car doors (2) and (3) are in a fully closed state, the reflecting member (50) is to be arranged directly underneath a pathway (105) formed by the pair of depressed portions (2*b*) and (3*b*) or the pair of notched portions (2*c*) and (3*c*) described above.

In addition, in the present embodiment, a cleaning tool (77) constituted by a brush is mounted inside the groove (83) of the threshold (82) as illustrated in FIG. 62. Specifically, as illustrated in FIG. 63, the cleaning tool (77) is fixed to a side face of the groove (83) so that the cleaning tool (77) is separated from a bottom face of the groove (83) and the brush faces downward.

During closing of both car doors (2) and (3) to a fully closed state and during opening from the fully closed state as illustrated in FIG. 64, the cleaning tool (77) cleans a surface of the reflecting member (50) disposed on the right-side car door (3). Accordingly, the surface of the reflecting member (50) is constantly maintained as a favorable reflecting surface.

In the fourth elevator described above, since the reflecting member (50) protrudes from the position of the end face in a closing direction of the right-side car door (3) by a predetermined distance (for example, 8 mm), output of an optical beam B from the light-emitting/light-receiving unit (4) is started during closing of both car doors (2) and (3) when a tip of the reflecting member (50) reaches a vertical line (103) through which the optical beam B passes.

In addition, during closing of both car doors (2) and (3) from an almost-fully closed state to a fully closed state, the optical beam B outputted from the light-emitting/light-receiving unit (4) enters and is reflected by the reflecting member (50) and a reflected optical beam B returns to the light-emitting/light-receiving unit (4) unless a foreign object exists in a path of the optical beam B. Therefore, a foreign object detection signal is not generated.

In contrast thereto, if a string S is present across the entrance, when both car doors (2) and (3) reach a fully closed state as illustrated in FIG. 56 or 57 in the same manner as the third embodiment described above, an optical beam outputted from the light-emitting/light-receiving unit (4) is blocked by the string S and detection of the optical beam by the light-emitting/light-receiving unit (4) is interrupted. As a result, a foreign object detection signal is to be generated.

In addition, in the fourth elevator described above, since the light-emitting/light-receiving unit (4) is supported by the frame (81), the influence of a vibration, an impact made on the elevator car, or the like caused during opening or closing of both car doors (2) and (3) or the like can be avoided in the same manner as the third elevator described above.

Furthermore, in the fourth elevator described above, since output of the optical beam B from the light-emitting/light-receiving unit (4) is started when both car doors (2) and (3) reach an almost-fully closed state during closing, a person can be prevented from peeking into the light-emitting/light-receiving unit (4) during output of the optical beam B.

Moreover, in the present embodiment, while output of the optical beam B from the light-emitting/light-receiving unit (4) is started when the tip of the reflecting member (50) reaches the vertical line (103) through which the optical beam B passes, for example, output of the optical beam B may be started before the tip of the reflecting member (50) reaches the vertical line (103). In this case, a string detecting function is disabled before the tip of the reflecting member (50) reaches the vertical line (103) and the string detecting function is enabled when the tip of the reflecting member (50) reaches the vertical line (103).

As illustrated in FIGS. 65 and 66, a fifth elevator according to an embodiment of the present invention is a side-open type elevator including a high-speed car door (23) and a low-speed car door (33) that move in a direction approaching/separating from a doorstop frame (84) fixed to an elevator car to Open/Close an entrance, wherein a rail (11) is fixed to a frame (85) above the entrance, and both car doors (23) and (33) are respectively suspended from the rail (11) by hangers (24) and (34) and guided so as to reciprocate in a horizontal direction by guide shoes (25) and (35) which are protrudingly provided at lower end portions of the doors and which are fit into a threshold (86) so as to be slidable.

In addition, a control unit (100) that controls opening/closing operations of both car doors (23) and (33) is installed on the frame (85).

As illustrated in FIG. 65, on the doorstop frame (84), a light-emitting/light-receiving unit (4) is disposed facing vertically downward at an upper end position of a vertical line (113) that extends vertically at a position separated by a predetermined distance (for example, 12 mm) from an end face (84*a*) that the high-speed car door (23) is to abut toward the side of the high-speed car door (23), and a first reflecting member (61) is disposed facing vertically upward at a lower end position of the vertical line (113).

Moreover, the mounted states in which the light-emitting/light-receiving unit (4) faces vertically downward and the first reflecting member (61) faces vertically upward are assumed to include a mounted state having a slight incline with respect to the vertical line (113) depending on a configuration of the light-emitting/light-receiving unit (4) (arrangement of the light emitter and the light receiver, and the like), a variance in installation postures of the doorstop frame (84) and the car doors (23) and (33), and the like. Alternatively, the light-emitting/light-receiving unit (4) may be disposed facing vertically downward on the frame (85) above the entrance at a position on the vertical line (113).

The light-emitting/light-receiving unit (4) integrally includes a light emitter that is to output an optical beam B and a light receiver that is to detect an incident optical beam B, and is supported by a stay (42) fixed to the doorstop frame (84) as illustrated in FIG. 67.

As illustrated in FIG. 68, the first reflecting member (61) is provided on a horizontal arm portion of an L-shaped arm member (63) disposed at a lower end position of the doorstop frame (84) and includes a reflecting surface that reflects the optical beam B vertically upward. As illustrated in FIG. 69, the arm member (63) is mounted in a housed state inside a groove (87) of the threshold (86) into which the guide shoe (25) of the car door (23) fits. In other words, the reflecting member (61) is held inside the groove (87) of the threshold (86).

As illustrated in FIG. 70, a housing space (30) that opens on an end face in a closing direction (23*a*) that is to abut the doorstop frame (84) is formed on an upper end portion of the high-speed car door (23). The housing space (30) houses the light-emitting/light-receiving unit (4) in a closed state of the high-speed car door (23).

A second reflecting member (62) is disposed facing vertically upward at a bottom portion of the housing space (30). The second reflecting member (62) has a reflecting surface of a predetermined length (for example, 8 mm) that extends from the same position as the end face in a closing direction (23*a*) of the high-speed car door (23) toward the back of the housing space (30), and reflects, vertically upward, an optical beam B from the light-emitting/light-receiving unit (4) that penetrates into the housing space (30).

A cleaning tool (78) constituted by a brush is mounted facing downward as illustrated in FIG. 71 on a lower end portion of the high-speed car door (23).

During closing of both car doors (23) and (33) to a fully closed state and during opening from the fully closed state as illustrated in FIG. 72, the cleaning tool (78) cleans a surface of the first reflecting member (61) disposed at a lower end position of the doorstop frame (84). Accordingly, the surface of the first reflecting member (61) is constantly maintained as a favorable reflecting surface.

Furthermore, a cleaning tool (79) constituted by a brush is mounted facing downward as illustrated in FIG. 67 on an upper end portion of the doorstop frame. Specifically, the cleaning tool (79) is mounted to a tip of the stay (42) that is provided for supporting the light-emitting/light-receiving unit (4) to the doorstop frame (84).

During closing of both car doors (23) and (33) to a fully closed state and during opening from the fully closed state, the cleaning tool (79) cleans a surface of the second reflecting member (62) disposed on the bottom face of the housing space (30). Accordingly, the surface of the second reflecting member (62) is constantly maintained as a favorable reflecting surface.

In a similar manner to the third elevator described above, a foreign object penetration preventing member that fills up a gap formed between the end face in a closing direction (23*a*) of the high-speed car door (23) and the threshold (86) is mounted at a lower end portion of the car door (3) (refer to FIGS. 53 to 55).

In the fifth elevator described above, during closing of the high-speed car door (23) from a fully open state to an almost-fully closed state, the optical beam B outputted from the light-emitting/light-receiving unit (4) enters and is reflected by the first reflecting member (61) and a reflected optical beam B returns to the light-emitting/light-receiving unit (4) unless a foreign object exists in a path of the optical beam B.

Subsequently, during closing of the high-speed car door (23) from the almost-fully closed state to a fully closed state, the light-emitting/light-receiving unit (4) penetrates into the housing space (30) formed on the high-speed car door (23) and, as a result, the optical beam B outputted from the light-emitting/light-receiving unit (4) enters and is reflected by the second reflecting member (62) and the reflected optical beam B returns to the light-emitting/light-receiving unit (4).

In other words, during closing of the high-speed car door 123) from the fully open state to the fully closed state, the optical beam B outputted from the light-emitting/light-receiving unit (4) is reflected by the first reflecting member (61) or the second reflecting member (62) and returns to the light-emitting/light-receiving unit (4) unless a foreign object exists in a path of the optical beam B.

The light-emitting/light-receiving unit (4) does not generate a foreign object detection signal if an optical beam is being detected. In addition, the control unit (100) continues a closing operation of both car doors (23) and (33) unless a foreign object detection signal is generated by the light-emitting/light-receiving unit (4) during closing of the high-speed car door (23) from the fully open state to the fully closed state.

In contrast, when detection of an optical beam is interrupted, the light-emitting/light-receiving unit (4) generates a foreign object detection signal and outputs the same to the control unit (100). In response thereto, the control unit (100) reverses both car doors (23) and (33) from a closing operation to an opening operation.

In addition, in the fifth elevator described above, since the light-emitting/light-receiving unit (4) is disposed on the doorstop frame (84), the influence of a vibration, an impact made on the elevator car, or the like caused during opening or closing of both car doors (23) and (33) or, more specifically, a variance in an amount of light received of an incident optical beam, a displacement of an irradiation position of an optical beam, or the like can be avoided. As a result, foreign object detection accuracy can be enhanced. In a similar manner, since the first reflecting member (61) is disposed on the threshold (86), the influence of a vibration, an impact made on the elevator car, or the like caused during opening or closing of the car doors can be avoided.

Furthermore, in the fifth elevator described above, since a foreign object penetration preventing member is mounted to the lower end portion of the high-speed car door (23), penetration of a string S into a gap formed between the end face in a closing direction (23*a*) of the high-speed car door (23) and the threshold (86) can be prevented by the foreign object penetration preventing member. Therefore, the string S that is a foreign object can be reliably detected.

In the fifth elevator described above, the optical beam B is favorably outputted from the light-emitting/light-receiving unit (4) only during closing of the high-speed car door (23) for a period from immediately before the light-emitting/light-receiving unit (4) penetrates into the housing space (30) to the car door (23) entering a fully closed state. This is because a person can be prevented from peeking into the light-emitting/light-receiving unit (4) during output of the optical beam B.

FIGS. 73 and 74 illustrate a series of operations when the high-speed car door (23) and the landing door (15) close in the fifth elevator described above in a case where a safety shoe frame (29) is disposed on the high-speed car door (23) and in a state where a string S is stretched between the inside of the elevator car and the landing floor.

As illustrated in FIGS. 73(*a*) and 73(*b*), when the string S is caught on a tip of the safety shoe frame (29) during closing of the car door (23), the string S is guided toward an optical beam B by the safety shoe frame (29) (FIG. 73(*a*)) and, as a result, the string S transverses the optical beam B (FIG. 73(*b*)). At this point, since detection of the optical beam B by the light-emitting/light-receiving unit (4) is interrupted, a foreign Object detection signal is generated.

As illustrated in FIGS. 74(*a*) and 74(*b*), when the string S penetrates a gap formed between an end face in a closing direction (29*a*) of the safety shoe frame (29) and the threshold (86) during closing of the car door (23), the string S is guided toward the optical beam B by the foreign object penetration preventing member mounted at a lower end portion of the high-speed car door (23) (FIG. 74(*a*)) and, as a result, the string S transverses the optical beam B (FIG. 74(*b*)). At this point, since detection of the optical beam B by the light-emitting/light-receiving unit (4) is interrupted, a foreign object detection signal is generated.

FIGS. 75 and 76 illustrate an example of an improved structure of the fifth elevator described above. As illustrated, a foreign object pushing member (93) that protrudes further toward the side of the high-speed car door (23) than the end face (84*a*) of the doorstop frame (84) is disposed at a lower end portion of the doorstop frame (84). Specifically, the foreign object pushing member (93) is integrally formed with the L-shaped arm member (63) described above, and an upper end face of the foreign object pushing member (93) is obliquely cut so that a string S stretched and in contact with the upper end face is guided onto the vertical line (113).

FIG. 77 illustrates a series of operations when the car door (23) and the landing door (15) close in the fifth elevator having the improved structure described above in a state where the string S is stretched between the inside of the elevator car and the landing floor.

In the fifth elevator having the improved structure described above, the string S stretched through a space between the vertical line (113) through which the optical beam B passes and the end face (84*a*) of the doorstop frame (84) is pushed forward by the foreign object pushing member (93) (refer to FIG. 76) and, as a result, is guided onto the vertical line (113) (FIG. 77). Therefore, the optical beam B is to be invariably blocked by the string S during closing of the high-speed car door (23) and, as a result, the string S that is a foreign object can be reliably detected.

FIG. 78 illustrates another example of an improved structure of the fifth elevator described above. In addition, FIG. 78 illustrates a series of operations when the car door (23) and the landing door (15) close in a state where the string S is stretched between the inside of the elevator car and the landing floor.

As illustrated in FIG. 72, a safety shoe frame (29) that moves relative to the high-speed car door (23) is mounted on the car door (23), and a protruding member (94) extending along the vertical line (113) through which the optical beam B passes is formed on the end face (84*a*) of the doorstop frame (84). As illustrated in FIG. 78(*a*), the protruding member (94) is positioned on the side of the safety shoe frame (29) with respect to a position through which the optical beam B passes, and a protruding length L of the protruding member (94) from the end face (84*a*) of the doorstop frame (84) is shorter than a distance (for example, 12 mm) from the end face (84*a*) to the optical beam B. In addition, as illustrated in FIG. 77(*b*), the protruding member (94) overlaps the safety shoe frame (29) during closing of the high-speed car door (23).

In the fifth elevator having the improved structure described above, the protruding member (94) overlaps the safety shoe frame (29) during closing of the high-speed car door (23) as illustrated in FIG. 78(*b*) so as to sandwich a part of the string S that is a foreign object between itself and the safety shoe frame (29) and causes the part to follow the closing direction. Therefore, the string S is pushed by a tip of the protruding member (94) toward the side of the end face in a closing direction (23*a*) of the high-speed car door (23). As a result, the string S either moves to a position where the string S intersects the optical beam B or transverses the optical beam B. At this point, since detection of the optical beam B by the light-emitting/light-receiving unit (4) is interrupted, a foreign object detection signal is generated.

FIG. 79 illustrates yet another example of an improved structure of the fifth elevator described above. In addition, FIG. 79 illustrates a series of operations when the car door (23) and the landing door (15) close in a state where the string S is stretched between the inside of the elevator car and the landing floor.

As illustrated in FIG. 79, a guide member (95) vertically extending from an upper end position to a lower end position of the end face in a closing direction (23*a*) is mounted on a side face of the high-speed car door (23) so as to protrude from the end face in a closing direction (23*a*) toward the side of the doorstop frame (84).

In the fifth elevator having the improved structure described above, as illustrated in FIGS. 79(*a*) and 79(*b*), when the string S is caught on a tip of the guide member (95) during closing of the car door (23), the string S is guided toward an optical beam B by the guide member (95) (FIG. 79(*a*)) and, as a result, the string S transverses the optical beam B (FIG. 79(*b*)). At this point, since detection of the optical beam B by the light-emitting/light-receiving unit (4) is interrupted, a foreign object detection signal is generated.

FIGS. 80 to 83 illustrate an embodiment that uses a signal from a gate switch (101) in order to detect a failure of the light-emitting/light-receiving unit (4) in the fifth elevator described above.

In this case, as illustrated in FIG. 81, the second reflecting member (62) includes a reflecting portion (621) that reflects, with an amount of light equal to or exceeding a certain level, an optical beam outputted from the light-emitting/light-receiving unit (4), and a non-reflecting portion (622) that does not reflect, with an amount of light equal to or exceeding a certain level, an optical beam outputted from the light-emitting/light-receiving unit (4). For example, the reflecting portion (621) may be configured by applying reflective tape on a surface of a non-reflective member and the non-reflecting portion (622) can be constituted by a region where the reflective tape is not applied.

As illustrated in FIG. 80, the gate switch (101) is disposed on the rail (11), and a protruding piece (26) for switching the gate switch (101) from OFF to ON is mounted on the hanger (24) of the high-speed car door (23).

As illustrated in FIG. 81, when the end face in a closing direction (23*a*) of the high-speed car door (23) closes to a position 12 mm short of the end face (84*a*) of the doorstop frame (84) (first almost-fully closed state), the optical beam B outputted from the light-emitting/light-receiving unit (4) makes a transition from a state incident to the first reflecting member (61) to a state incident to the reflecting portion (621) of the second reflecting member (62). Subsequently, the optical beam B reflected by the reflecting portion (621) is to be detected by the light-emitting/light-receiving unit (4). Therefore, a foreign object detection signal is not generated. At this point, the gate switch (101) remains turned off.

As illustrated in FIG. 82, when the end face in a closing direction (23*a*) of the car door (23) closes to a position 8 mm short of the end face (84*a*) of the doorstop frame (84), the gate switch (101) is turned on. At this point, the optical beam B outputted from the light-emitting/light-receiving unit (4) is still in a state incident to the reflecting portion (621) of the second reflecting member (62), and the optical beam B reflected by the reflecting portion (621) is detected by the light-emitting/light-receiving unit (4).

Furthermore, as illustrated in FIG. 83, when the end face in a closing direction (23*a*) of the car door (23) closes to a position 4 mm short of the end face (84*a*) of the doorstop frame (84) (second almost-fully closed state), the optical beam B outputted from the light-emitting/light-receiving unit (4) makes a transition from a state incident to the reflecting portion (621) of the second reflecting member (62) to a state incident to the non-reflecting portion (622). Subsequently, the optical beam B does not enter the light-emitting/light-receiving unit (4) with an amount of light equal to or exceeding a certain level until the car door (23) reaches a fully closed state. As a result, a foreign object detection signal is to be generated. At this point, the gate switch (101) remains turned on.

Therefore, as long as the light-emitting/light-receiving unit (4) is operating normally, the gate switch (101) is switched on in the second almost-fully closed state and, at the same time, a foreign object detection signal is generated. In this case, the control unit (100) continues a door closing operation regardless of a foreign object detection signal.

However, if some kind abnormality has occurred at the light-emitting/light-receiving unit (4), the gate switch (101) is switched on but a foreign object detection signal is not generated. In this case, the control unit (100) determines that an abnormality has occurred at the light-emitting/light-receiving unit (4) when a foreign object detection signal is not supplied after the gate switch (101) is switched on.

In a similar manner to the first embodiment, a control procedure of the control unit (100) based on outputs of the light-emitting/light-receiving unit (4) and the gate switch (101) is executed according to the aforementioned flow chart illustrated in FIG. 21.

According to the procedure described above, a failure of the light-emitting/light-receiving unit (4) can be detected using an ON/OFF signal from the gate switch (101) that has conventionally been used to detect a conclusion of a door closing operation. Consequently, an abnormal circumstance can be avoided where a foreign object detection signal is not generated and a risk aversion operation is not performed despite the presence of a foreign object such as a string in the entrance of the elevator.

Alternatively, in place of an ON/OFF signal from the gate switch (101), a CTL signal that enables detection of an almost-fully closed state more closer to a fully closed state can be used. While the gate switch (101) is a switch that detects closing of a door, a CTL is a switch that detects a position of a door. An elevator is equipped with both switches.

For example, since a CTL signal switches from OFF to ON at a point in time where the end face in a closing direction (23*a*) of the car door (23) has closed to within 4 mm from the end face (84*a*) of the doorstop frame (84), the length of the reflecting portion (621) of the second reflecting member (62) is altered so that an optical beam from the light-emitting/light-receiving unit (4) makes a transition from the reflecting portion (621) to the non-reflecting portion (622) in a state where the end face in a closing direction (23*a*) of the car door (23) has closed to within 2 mm from the end face (84*a*) of the doorstop frame (84).

In another example of detecting a failure of the light-emitting/light-receiving unit (4), after the gate switch (101) or the CTL switches from OFF to ON during closing of the car door (23), output of the optical beam B is turned off while a function of detecting an incident optical beam by the light-emitting/light-receiving unit (4) remains turned on.

In the other example, by turning off output of the optical beam B, the optical beam B no longer enters the light-emitting/light-receiving unit (4). Therefore, as long as the light-emitting/light-receiving unit (4) is operating normally, a foreign object detection signal is generated. In this case, the control unit (100) continues a door closing operation regardless of a foreign object detection signal.

However, if an abnormality of some kind has occurred at the light-emitting/light-receiving unit (4), an abnormality detection signal is not to be generated despite the optical beam B not entering the light-emitting/light-receiving unit (4). In this case, the control unit (100) determines that an abnormality has occurred at the light-emitting/light-receiving unit (4) if an abnormality detection signal is not supplied when output of an optical beam is turned off while a function of detecting an incident optical beam remains turned on.

According to the other example described above, a failure of the light-emitting/light-receiving unit (4) can be detected. Consequently, an abnormal circumstance can be avoided where a foreign object detection signal is not generated and a risk aversion operation is not performed despite the presence of a foreign object such as a string in the entrance of the elevator car.

Moreover, the reflecting portion (621) of the second reflecting member (62) need only extend from the same position as the end face in a closing direction (23*a*) of the high-speed car door (23) to a position where the'optical beam B can be reflected when the gate switch (101) or the CTL switches from OFF to ON, and the length of the reflecting portion (621) need not necessarily be accurately designed.

Alternatively, a technique according to the other example described above can be executed before starting output of the optical beam B. Accordingly, a failure of the light-emitting/light-receiving unit (4) can be detected in advance.

A sixth elevator according to an embodiment of the present invention is a side-open type elevator which is similar to the fifth elevator described above and which differs from the fifth elevator in positions of the light-emitting/light-receiving unit (4) and the first reflecting member (61) and in shapes of the end face in a closing direction (23*a*) of the high-speed car door (23) and the end face (84*a*) of the doorstop frame (84). These points will be specifically described below. Moreover, in the sixth elevator, the second reflecting member (62) and the foreign object pushing member (93) are not disposed. In addition, since other configurations are similar to those of the fifth elevator, descriptions thereof will be omitted.

In the present embodiment, the light-emitting/light-receiving unit (4) is disposed at an upper end position of the doorstop frame (84) on a vertical line extending vertically from an abutting position R1 (refer to FIG. 84) where the doorstop frame (84) and the high-speed car door (23) abut each other in a fully closed state. In addition, the first reflecting member (61) is disposed at a lower end position of the doorstop frame (84) on the vertical line.

Furthermore, in the present embodiment, as illustrated in FIG. 84, the end face (84*a*) of the doorstop frame (84) is formed by a doorstop rubber (841) that extends from the upper end position to the lower end position of the doorstop frame (84). In addition, a pair of depressed portions (84*b*) and (23*b*) extending along the vertical line described above are formed on the end face (84*a*) of the doorstop frame (84) and the end face in a closing direction (23*a*) of the high-speed car door (23). Accordingly, when the high-speed car door (23) is in a fully closed state, a pathway (115) through which the optical beam B passes is to be formed.

Alternatively, as illustrated in FIG. 85, a pair of notched portions (84*c*) and (23*c*) extending along the vertical line (103) may be formed on the end face (84*a*) of the doorstop frame (84) and the end face in a closing direction (23*a*) of the high-speed car door (23), and the pathway (115) through which the optical beam B passes may be formed by the pair of notched portions (84*c*) and (23*c*).

In the sixth elevator described above, during closing of the high-speed car door (23), the optical beam B outputted from the light-emitting/light-receiving unit (4) enters and is reflected by the first reflecting member (61) and a reflected optical beam B returns to the light-emitting/light-receiving unit (4) unless a foreign object exists in a path of the optical beam B. Therefore, a foreign object detection signal is not generated.

In contrast, when detection of an optical beam is interrupted, the light-emitting/light-receiving unit (4) generates a foreign object detection signal. Specifically, if a string S is present across the entrance, when the high-speed car door (23) reaches a fully closed state as illustrated in FIG. 86 or 87, an optical beam outputted from the light-emitting/light-receiving unit (4) is blocked by the string S and detection of the optical beam by the light-emitting/light-receiving unit (4) is interrupted. As a result, a foreign object detection signal is to be generated.

Moreover, configurations of the respective parts of the present invention are not limited to the embodiments described above, and various modifications can be made within the technical scope described in the claims. For example, the various aforementioned configurations adopted as a safety device of a center-open type elevator can also be adopted as a safety device of a side-open type elevator and, conversely, the various aforementioned configurations adopted as a safety device of a side-open type elevator can also be adopted as a safety device of a center-open type elevator.

In addition, with a type in which a depressed groove is not provided at a threshold, the light-emitting/light-receiving unit (4) and a reflecting member may be disposed on a vertical line that passes between a threshold of a landing floor and a threshold of an elevator car.

Furthermore, a positional relationship between the light-emitting/light-receiving unit (4) and the reflecting member need not necessarily be that of an upper end position and a lower end position on a vertical line, and an arrangement on a straight line slightly inclined with respect to a vertical line can also be adopted.

DESCRIPTION OF SYMBOLS (1) rail
(2) car door
(2*a*) end face in a closing direction
(3) car door
(3*a*) end face in a closing direction
(12) doorstop frame,
(12*a*) end face
(23) high-speed car door
(23*a*) end face in a closing direction
(29) safety shoe frame
(33) low-speed car door
(30) housing space
(4) light-emitting/light-receiving unit
(5) first reflecting member
(6) second reflecting member
(601) reflecting portion
(602) non-reflecting portion
(50) reflecting member
(61) first reflecting member
(62) second reflecting member
(621) reflecting portion
(622) non-reflecting portion
(70) cleaning tool
(701) cleaning tool
(7) cleaning mechanism
(71) cleaning tool
(72) spring member
(73) pressing unit (guide shoe)
(77)~(79) cleaning tool
(81) frame
(82) threshold
(84) doorstop frame
(84*a*) end face
(85) frame
(86) threshold
(87) groove
(9) foreign object penetration preventing member
(90) foreign object pushing member
(91), (92) foreign object penetration preventing member
(93) foreign object pushing member
(94) protruding member
(100) control unit
(101) gate switch
(105), (115) pathway.
B optical beam
S string

The invention claimed is:

1. A safety device for an elevator comprising a pair of car doors that move in a direction approaching/separating from each other to open/close an entrance, wherein a light-emitting/light-receiving unit is disposed facing downward on one car door at an upper end position of a straight line vertically extending from a position separated by a predetermined distance from an end face in a closing direction, which is to abut the other car door, toward the side of the other car door, a first reflecting member is disposed facing upward at a lower end position of the straight line, the light-emitting/light-receiving unit is capable of outputting an optical beam and detecting an incident optical beam, a housing space that houses the light-emitting/light-receiving unit in a state where both car doors are closed is formed on the other car door, a second reflecting member is disposed facing upward at a bottom portion of the housing space and extends from the same position as an end face in a closing direction of the other car door toward the back of the housing space, and a foreign object detection signal is generated when detection of an optical beam by the light-emitting/light-receiving unit is interrupted during closing of both car doors.

2. The safety device for an elevator according to claim 1, wherein a cleaning tool that cleans a surface of the first reflecting member during closing of both car doors from an almost-fully closed state to a fully closed state is mounted on the other car door.

3. The safety device for an elevator according to claim 1, wherein a cleaning tool that cleans a surface of the second reflecting member during closing of both car doors from an almost-fully closed state to a fully closed state is mounted on the one car door further toward the side of the other car door than the light-emitting/light-receiving unit.

4. The safety device for an elevator according to claim 1, wherein the first reflecting member is held inside a groove of a threshold, in which the one car door fits so as to be slidable, so as to be movable along the groove.

5. The safety device for an elevator according to claim 1, wherein a foreign object penetration preventing member that fills up a gap formed between a lower end of the end face in a closing direction of the other car door and a surface of a threshold is mounted at a lower end portion of the other car door.

6. The safety device for an elevator according to claim 1, wherein a foreign object pushing member which fills up a gap formed between a lower end of the end face in a closing direction of the one car door and the surface of the threshold and which protrudes further toward the side of the other car door than the gap is mounted at a lower end portion of the one car door.

7. The safety device for an elevator according to claim 1, wherein at least one of the car doors among the pair of car doors is mounted with a safety shoe frame that moves relative to the car door, and a lower end face of the safety shoe frame forms a slope which has a predetermined inclination angle with respect to a horizontal plane and which faces toward the side of the other car door.

8. The safety device for an elevator according to claim 1, wherein both car doors close from a fully open state to a fully closed state via a first almost-fully closed state and a second almost-fully closed state, and the safety device includes detecting means that switches from OFF to ON at a predetermined point in time during closing of both car doors from the first almost-fully closed state to the second almost-fully closed state, the second reflecting member reflects an optical beam outputted from the light-emitting/light-receiving unit during closing of both car doors from the first almost-fully closed state to the second almost-fully closed state and hardly reflects an optical beam outputted from the light-emitting/light-receiving unit during closing of both car doors from the second almost-fully closed state to the fully closed state, and a determination to the effect that an abnormality has occurred at the light-emitting/light-receiving unit is made when a foreign object detection signal is not generated after the detecting means is switched on.

9. A safety device for an elevator comprising at least one car door that moves in a direction approaching/separating from a doorstop frame to open/close an entrance, wherein a light-emitting/light-receiving unit is disposed facing downward at an upper end position of a straight line vertically extending from a position separated by a predetermined distance from an end face in a closing direction of the car door, which is to abut the doorstop frame, toward the side of the doorstop frame, a first reflecting member is disposed facing upward at a lower end position of the straight line, the light-emitting/light-receiving unit is capable of outputting an optical beam and detecting an incident optical beam, a housing space that houses the light-emitting/light-receiving unit in a state where the car door is closed is formed on the doorstop frame, a second reflecting member is disposed facing upward at a bottom portion of the housing space and extends from the same position as an end face of the doorstop frame, which the car door is to abut, toward the back of the housing space, and a foreign object detection signal is generated when detection of an optical beam by the light-emitting/light-receiving unit is interrupted during closing of the car door.

10. The safety device for an elevator according to claim 9, wherein a cleaning tool that cleans a surface of the first reflecting member during closing of the car door from an almost-fully closed state to a fully closed state is mounted on the doorstop frame.

11. The safety device for an elevator according to claim 9, wherein a cleaning tool that cleans a surface of the second reflecting member during closing of the car door from an almost-fully closed state to a fully closed state is mounted on the car door further toward the side of the doorstop frame than the light-emitting/light-receiving unit.

12. The safety device for an elevator according to claim 9, wherein the first reflecting member is held inside a groove of a threshold, in which the car door fits so as to be slidable, so as to be movable along the groove.

13. The safety device for an elevator according to claim 9, wherein a foreign object pushing member which fills up a gap formed between a lower end of the end face in a closing direction of the car door and a surface of the threshold and which protrudes further toward the side of the doorstop frame than the gap is mounted at a lower end portion of the car door.

14. The safety device for an elevator according to claim 9, wherein the car door is mounted with a safety shoe frame that moves relative to the car door, and a lower end face of the safety shoe frame forms a slope which has a predetermined inclination angle with respect to a horizontal plane and which faces toward the side of another car door.

15. The safety device for an elevator according to claim 9, wherein the car door closes from a fully open state to a fully closed state via a first almost-fully closed state and a second almost-fully closed state, the safety device includes detecting means that switches from OFF to ON at a predetermined point in time during closing of the car door from the first almost-fully closed state to the second almost-fully closed state, the second reflecting member reflects an optical beam outputted from the light-emitting/light-receiving unit during closing of the car door from the first almost-fully closed state to the second almost-fully closed state and hardly reflects an optical beam outputted from the light-emitting/light-receiving unit during closing of the car door from the second almost-fully closed state to the fully closed state, and a determination to the effect that an abnormality has occurred at the light-emitting/light-receiving unit is made when a foreign object detection signal is not generated after the detecting means is switched on.

16. The safety device for an elevator according to claim 1, wherein a foreign object penetration preventing member that fills up a gap formed between a lower end of an end face in a closing direction of a landing door and a surface of a threshold is further mounted at a lower end portion of the landing door.

17. A safety device for an elevator comprising a pair of car doors that move in a direction approaching/separating from each other to open/close an entrance, and a frame disposed above the entrance, wherein a light-emitting/light-receiving unit is disposed facing downward on the frame at a position on a straight line vertically extending from an abutting position where the pair of car doors abut each other in a fully closed state, a reflecting member is disposed facing upward on one car door at a lower end position of an end face in a closing direction that is to abut the other car door, the light-emitting/light-receiving unit is capable of outputting an optical beam and detecting an incident optical beam, and a foreign object detection signal is generated when detection of an optical beam by the light-emitting/light-receiving unit is interrupted during closing of both car doors from an almost-fully closed state to a fully closed state.

18. The safety device for an elevator according to claim 17, wherein the reflecting member is held inside a groove of a threshold, in which the one car door fits so as to be slidable, so as to be movable along the groove.

19. The safety device for an elevator according to claim 18, wherein a cleaning tool that cleans a surface of the reflecting member during closing of both car doors is mounted inside the groove of the threshold.

20. The safety device for an elevator according to claim 17, wherein a pair of depressed portions or a pair of notched portions extending along the straight line are formed on the pair of car doors on end faces in a closing direction that are to abut each other in a fully closed state of the pair of car doors, and when the pair of car doors are in a fully closed state, a pathway through which an optical beam passes is formed by the pair of depressed portions or the pair of notched portions.

21. A safety device for an elevator comprising at least one car door that moves in a direction approaching/separating from a doorstop frame to open/close an entrance, wherein a light-emitting/light-receiving unit is disposed facing downward on the doorstop frame at an upper end position of a straight line vertically extending from a position separated by a predetermined distance from an end face, which the car door is to abut, toward the side of the car door, a first reflecting member is disposed facing upward at a lower end position of the straight line, the light-emitting/light-receiving unit is capable of outputting an optical beam and detecting an incident optical beam, a housing space that houses the light-emitting/light-receiving unit in a state where the car door is closed is formed on the car door, a second reflecting member is disposed facing upward at a bottom portion of the housing space and extends from the same position as an end face in a closing direction of the car door, which is to abut the doorstop frame, toward the back of the housing space, and a foreign object detection signal is generated when detection of an optical beam by the light-emitting/light-receiving unit is interrupted during closing of the car door.

22. The safety device for an elevator according to claim 21, wherein a safety shoe frame that moves relative to the car door is mounted on the car door, a protruding member that extends along the straight line is formed on the end face of the doorstop frame, the protruding member has a protruding length from the end face that is shorter than the predetermined distance, and the protruding member is positioned on the side of the safety shoe frame with respect to the position of the straight line and overlaps the safety shoe frame during closing of the car door.

23. The safety device for an elevator according to claim 21, wherein a foreign object pushing member that protrudes further toward the side of the car door than the end face of the doorstop frame is disposed at a lower end portion of the doorstop frame.

24. The safety device for an elevator according to claim 21, wherein a cleaning tool that cleans a surface of the first reflecting member during closing of the car door is mounted on the car door.

25. The safety device for an elevator according to claim 21, wherein a cleaning tool is mounted on the doorstop frame further toward the side of the car door than the light-emitting/light-receiving unit, and the cleaning tool cleans a surface of the second reflecting member during closing of the car door.

26. The safety device for an elevator according to claim 21, wherein the first reflecting member is held inside a groove of a threshold in which the car door fits so as to be slidable.

27. The safety device for an elevator according to claim 21, wherein the car door closes from a fully open state to a fully closed state via a first almost-fully closed state and a second almost-fully closed state, the safety device includes detecting means that switches from OFF to ON at a predetermined point in time during closing of the car door from the first almost-fully closed state to the second almost-fully closed state, the second reflecting member reflects an optical beam outputted from the light-emitting/light-receiving unit during closing of the car door from the first almost-fully closed state to the second almost-fully closed state and hardly reflects an optical beam outputted from the light-emitting/light-receiving unit during closing of the car door from the second almost-fully closed state to the fully closed state, and a determination to the effect that an abnormality has occurred at the light-emitting/light-receiving unit is made when a foreign object detection signal is not generated after the detecting means is switched on.

28. The safety device for an elevator according to claim 17, wherein output of an optical beam by the light-emitting/light-receiving unit is executed during closing of the car door from an almost-fully closed state to a fully closed state.

29. The safety device for an elevator according to claim 17, wherein foreign object penetration preventing members that fill up a gap formed between a lower end of an end face in a closing direction of the car door and a surface of a threshold are mounted at a lower end portion of the car door.

30. The safety device for an elevator according to claim 1 comprising:

reverse door opening means which, when a foreign object detection signal is generated during closing of the car door, reverses the operation and executes a reverse door opening operation for opening the car door;

forced door closing means that disables a reverse door opening operation by the reverse door opening means and forcibly executes a door closing operation of the car door regardless of whether a foreign object detection signal is generated or not; and announcing means that announces execution of the forced door closing operation either before the execution of the forced door closing operation by the forced door closing means or in parallel with the execution of the forced door closing operation by the forced door closing means.

31. The safety device for an elevator according to claim 30, further comprising:

elevator car controlling means that causes a run of an elevator car to start after completion of a forced door closing operation by the forced door closing means; and second announcing means which, when a foreign object detection signal is generated during an execution of a forced door closing operation by the forced door closing means, announces a start of a run of the elevator car before the run of the elevator car is started by the elevator car controlling means.

* * * * *